US008793124B2

(12) United States Patent
Hidaka et al.

(10) Patent No.: US 8,793,124 B2
(45) Date of Patent: Jul. 29, 2014

(54) SPEECH PROCESSING METHOD AND APPARATUS FOR DECIDING EMPHASIZED PORTIONS OF SPEECH, AND PROGRAM THEREFOR

(75) Inventors: Kota Hidaka, Yokohama (JP); Shinya Nakajima, Miura (JP); Osamu Mizuno, Yokosuka (JP); Hidetaka Kuwano, Yokosuka (JP); Haruhiko Kojima, Yokohama (JP)

(73) Assignee: Nippon Telegraph and Telephone Corporation, Tokyo (JP)

( * ) Notice: Subject to any disclaimer, the term of this patent is extended or adjusted under 35 U.S.C. 154(b) by 0 days.

(21) Appl. No.: 11/397,803

(22) Filed: Apr. 5, 2006

(65) Prior Publication Data

US 2006/0184366 A1 Aug. 17, 2006

Related U.S. Application Data

(63) Continuation of application No. 10/214,232, filed on Aug. 8, 2002, now abandoned.

(30) Foreign Application Priority Data

| | | |
|---|---|---|
| Aug. 8, 2001 | (JP) | 2001-241278 |
| Feb. 25, 2002 | (JP) | 2002-047597 |
| Mar. 5, 2002 | (JP) | 2002-059188 |
| Mar. 6, 2002 | (JP) | 2002-060844 |
| Mar. 27, 2002 | (JP) | 2002-088582 |

(51) Int. Cl.

| | |
|---|---|
| ***G10L 21/00*** | (2013.01) |
| ***G10L 25/93*** | (2013.01) |
| ***G10L 19/06*** | (2013.01) |
| ***G10L 15/00*** | (2013.01) |
| ***G10L 15/14*** | (2006.01) |

(52) U.S. Cl.
USPC ..... 704/208; 704/209; 704/210; 704/231; 704/256.1

(58) Field of Classification Search
USPC ..... 704/208–210, 231, 256.1
See application file for complete search history.

(56) References Cited

U.S. PATENT DOCUMENTS

| | | | | |
|---|---|---|---|---|
| 5,175,799 | A * | 12/1992 | Shimura | 704/243 |
| 5,293,584 | A | 3/1994 | Brown et al. | 704/277 |

(Continued)

FOREIGN PATENT DOCUMENTS

| | | |
|---|---|---|
| JP | 03-80782 | 4/1991 |
| JP | 8-79491 | 3/1996 |

(Continued)

OTHER PUBLICATIONS

Francine Chen, Margaret Withgott, "The Use of Emphasis to Automatically Summarize a Spoken Discourse", IEEE 1992.*

(Continued)

*Primary Examiner* — Eric Yen
(74) *Attorney, Agent, or Firm* — Oblon, Spivak, McClelland, Maier & Neustadt, L.L.P.

(57) ABSTRACT

A scheme to judge emphasized speech portions, wherein the judgment is executed by a statistical processing in terms of a set of speech parameters including a fundamental frequency, power and a temporal variation of a dynamic measure and/or their derivatives. The emphasized speech portions are used for clues to summarize an audio content or a video content with a speech.

28 Claims, 31 Drawing Sheets

(56) References Cited

U.S. PATENT DOCUMENTS

| | | | | |
|---|---|---|---|---|
| 5,627,939 | A * | 5/1997 | Huang et al. | 704/256 |
| 5,638,543 | A * | 6/1997 | Pedersen et al. | 704/1 |
| 5,751,905 | A | 5/1998 | Chen et al. | 704/254 |
| 5,963,903 | A * | 10/1999 | Hon et al. | 704/254 |
| 5,999,899 | A * | 12/1999 | Robinson | 704/222 |
| 6,006,188 | A | 12/1999 | Bogdashevsky et al. | |
| 6,173,260 | B1 | 1/2001 | Slaney | |
| 6,275,806 | B1 | 8/2001 | Pertrushin | |
| 6,487,534 | B1 | 11/2002 | Thelen et al. | 704/270 |
| 6,912,495 | B2 | 6/2005 | Griffin et al. | 704/208 |
| 8,386,257 | B2 * | 2/2013 | Irie et al. | 704/270 |

FOREIGN PATENT DOCUMENTS

| | | |
|---|---|---|
| JP | 08-279273 | 10/1996 |
| JP | 8-292965 | 11/1996 |
| JP | 9-182019 | 7/1997 |
| JP | 10-254484 | 9/1998 |
| JP | 10-276395 | 10/1998 |
| JP | 11-88807 | 3/1999 |
| JP | 11-177962 | 7/1999 |
| JP | 2000-023062 | 1/2000 |
| JP | 2000-253351 | 9/2000 |
| JP | 2001-024980 | 1/2001 |
| JP | 2001-045395 | 2/2001 |
| JP | 2001-119671 | 4/2001 |
| JP | 2001-134290 | 5/2001 |
| JP | 2001-142480 | 5/2001 |
| JP | 2001-147697 | 5/2001 |
| JP | 2001-147919 | 5/2001 |
| JP | 2001-175685 | 6/2001 |
| JP | 2001-258005 | 9/2001 |
| JP | 2001-306599 | 11/2001 |
| JP | 2002-84492 | 3/2002 |
| JP | 2002-262230 | 9/2002 |
| JP | 2003-179845 | 6/2003 |
| JP | 2003-316378 | 11/2003 |

OTHER PUBLICATIONS

F.R. Chen, et al., Proceedings of the International Conference on Accoustics, Speech and Signal, vol. 5 Conf. 17, pp. 229-232, XP-010058674, "The Use of Emphasis to Automatically Summarize a Spoken Discourse", Mar. 23-26, 1992.

L. He, et al., Proceedings of the 7th Acm International Conference on Multimedia (Part 1), pp. 489-498, XP-002217991, "Auto-Summarization of Audio-Video Presentations", 1999.

B. Arons, et al., ACM Transactions on Computer-Human Interaction, vol. 4, No. 1, pp. 3-38, XP-002217992, "Speechskimmer: A System for Interactively Skimming Recorded Speech", Mar. 1997.

Yasuo Ariki., "Pattern Recognition Viewed from Media Analysis", Technical Report of IEICE, vol. 99, No. 514, Dec. 16, 1999, pp. 43-50.

Arons, "Pitch-Based Emphasis Detection for Segmenting Speech Recordings", 1994. Proceedings of International Conference on Spoken Language Processing (Sep. 18-22), vol. 4, 1994, pp. 1931-1934.

Yuko Tone, et al., "HMM Based Emotion Discrimination for Speech Dialog System", IEICE Technical Report, vol. 100, No. 137, SP2000-22, Jun. 16, 2000, pp. 47-53 and 1 end page. (with English Abstract).

* cited by examiner

CODEBOOK

| CODE No. | SPEECH PARAMETER VECTOR | INDEPENDENT APPEARANCE PROBABILITY | | CONDITIONAL PROBABILITY | | | | | | | | | | | |
|---|---|---|---|---|---|---|---|---|---|---|---|---|---|---|---|
| | | | | C1 | | C2 | | C3 | | C2, C3 | | C3, C4 | | | |
| | | EMP | NORMAL | EMP | NORMAL | EMP | NORMAL | EMP | NORMAL | EMP | NORMAL | EMP | NORMAL | | |
| C1 | | | | | | | | | | | | | | | |
| C2 | | | | | | | | | | | | | | | |
| C3 | | | | | | | | | | | | | | | |
| ..... | ..... | | | | | | | | | | | | | | |

FIG. 12

FIG. 14

| $C_i$=Ch | $C_{i-1}$ | $P_{emp}(Ch \mid C_{i-1})$ | $P_{nrm}(Ch \mid C_{i-1})$ |
|---|---|---|---|
| 0 | 0 | 0.428571 | 0 |
| 0 | 1 | 0 | 0 |
| 0 | 2 | 0 | 0 |
| 0 | 3 | 0 | 0 |
| 0 | 4 | 0 | 0 |
| 0 | 5 | 0 | 0 |
| 0 | 6 | 0 | 0 |
| 0 | 7 | [illegible] | [illegible] |
| 0 | 8 | 0 | 0 |
| 0 | 9 | 0 | 0 |
| [illegible] | [illegible] | 0 | 0 |
| 0 | 27 | 0 | 0 |
| 0 | 28 | 0 | 0 |
| 0 | 29 | 0 | 0 |
| 0 | 30 | 0 | 0 |
| 0 | 31 | 0 | 0 |
| 1 | 0 | 0 | 0 |
| 1 | 1 | 0.514151 | 0.368421 |
| 1 | 2 | 0 | 0 |
| 1 | 3 | 0 | 0 |
| 1 | 4 | 0 | 0 |
| 1 | 5 | 0.03066 | 0.043344 |
| 1 | 6 | 0 | 0 |
| 1 | 7 | 0 | 0 |
| 1 | 8 | 0 | 0 |
| 1 | 9 | 0.044811 | 0.057792 |
| 1 | 10 | 0 | 0.002064 |
| 1 | 11 | [illegible] | 0.02064 |
| [illegible] | 12 | [illegible] | [illegible] |
| [illegible] | [illegible] | 0 | 0 |
| 1 | 24 | 0.002358 | 0.001032 |
| 1 | 25 | 0.007075 | 0.021672 |
| 1 | 26 | 0.023585 | 0.021672 |
| 1 | 27 | 0.014151 | 0.03612 |
| 1 | 28 | 0.004717 | 0.00516 |
| 1 | 29 | 0.014151 | 0.018576 |
| 1 | 30 | 0.115566 | 0.136223 |
| 1 | 31 | 0 | 0 |
| 2 | 0 | 0 | 0 |
| 2 | 1 | 0.029412 | 0 |

FIG. 15

| $C_i$=Ch | $C_{i-1}$ | $P_{emp}(Ch \mid C_{i-1})$ | $P_{nrm}(Ch \mid C_{i-1})$ |
|---|---|---|---|
| 2 | 0 | 0.647059 | 0.333333 |
| 2 | 1 | 0 | 0.083333 |
| 2 | 2 | 0 | 0 |
| 2 | 3 | 0 | 0 |
| 2 | 4 | 0 | 0 |
| 2 | 5 | 0 | 0.041667 |
| 2 | 6 | 0 | 0 |
| 2 | 7 | [illegible] | [illegible] |
| 2 | 8 | 0 | [illegible] |
| 2 | 9 | 0 | 0 |
| [illegible] | [illegible] | 0.029412 | 0 |
| 2 | 27 | 0 | 0 |
| 2 | 28 | 0 | 0 |
| 2 | 29 | 0 | 0 |
| 2 | 30 | 0 | 0 |
| 2 | 31 | 0 | 0.041667 |
| 3 | 0 | 0 | 0 |
| 3 | 1 | 0 | 0 |
| 3 | 2 | 0 | 0 |
| 3 | 3 | 0.023256 | 0.098246 |
| 3 | 4 | 0.069767 | 0.035088 |
| 3 | 5 | 0.069767 | 0.031579 |
| 3 | 6 | 0.023256 | 0.010526 |
| 3 | 7 | 0.093023 | 0.066667 |
| 3 | 8 | 0 | 0.003509 |
| 3 | 9 | 0 | 0 |
| 3 | 10 | 0.046512 | 0.017544 |
| 3 | 11 | [illegible] | [illegible] |
| [illegible] | [illegible] | 0 | 0 |
| 6 | 25 | 0 | 0 |
| 6 | 26 | 0.036232 | 0.037196 |
| 6 | 27 | 0 | 0 |
| 6 | 28 | 0.115942 | 0.057225 |
| 6 | 29 | 0 | 0 |
| 6 | 30 | 0 | 0 |
| 6 | 31 | 0.007246 | 0.014306 |
| 7 | 0 | 0 | 0 |
| 7 | 1 | 0 | 0 |
| 7 | 2 | 0 | 0 |
| 7 | 3 | 0.010101 | 0.00743 |
| 7 | 4 | 0.020202 | 0.013622 |
| 7 | 5 | 0 | 0 |
| 7 | 6 | 0.025253 | 0.024149 |
| 7 | 7 | 0.590909 | 0.508359 |

FIG. 16

| $C_i$=Ch | $C_{i-1}$ | $P_{emp}(Ch \mid C_{i-1})$ | $P_{nrm}(Ch \mid C_{i-1})$ |
|---|---|---|---|
| 26 | 23 | 0.011799 | 0.03209 |
| 26 | 24 | 0 | 0 |
| 26 | 25 | 0 | 0 |
| 26 | 26 | 0.374631 | 0.366418 |
| 26 | 27 | 0.011799 | 0.008955 |
| 26 | 28 | 0.056047 | 0.031343 |
| 26 | 29 | 0.023599 | 0.017164 |
| 26 | 30 | 0.061947 | 0.055224 |
| 26 | 31 | 0.014749 | 0.036567 |
| 27 | 0 | 0 | 0 |
| 27 | 1 | 0.045872 | 0.034026 |
| 27 | 2 | 0.009174 | 0 |
| 27 | 3 | 0 | 0 |
| 27 | 4 | 0 | 0.003781 |
| 27 | 5 | 0.082569 | 0.098299 |
| 27 | 6 | 0 | 0 |
| 27 | 7 | 0 | 0 |
| 27 | 8 | 0 | 0 |
| 27 | 9 | 0.110092 | 0.05293 |
| 27 | 10 | 0.009174 | 0.009452 |
| 27 | 11 | 0.018349 | 0.011342 |
| 27 | 12 | [illegible] | 0 |
| 27 | 13 | [illegible] | [illegible] |
| [illegible] | [illegible] | 0 | 0.00189 |
| 27 | [illegible] | 0.183486 | 0.20794 |
| 27 | 26 | 0.018349 | 0.005671 |
| 27 | 27 | 0.045872 | 0.10586 |
| 27 | 28 | 0 | 0.003781 |
| 27 | 29 | 0.055046 | 0.066163 |
| 27 | 30 | 0.009174 | 0.007561 |
| 27 | 31 | 0 | 0 |
| 28 | 0 | 0 | 0 |
| 28 | 1 | 0.015267 | 0.024336 |
| 28 | 2 | 0.002545 | 0 |
| 28 | 3 | [illegible] | [illegible] |
| 28 | 4 | 0.003049 | 0.00042 |
| [illegible] | [illegible] | 0.006098 | 0.007566 |
| 31 | 22 | 0.015244 | 0.021858 |
| 31 | 23 | 0.091463 | 0.102984 |
| 31 | 24 | 0 | 0 |
| 31 | 25 | 0 | 0 |
| 31 | 26 | 0.015244 | 0.018495 |
| 31 | 27 | 0 | 0.000841 |
| 31 | 28 | 0.003049 | 0.00042 |
| 31 | 29 | 0.20122 | 0.126524 |
| 31 | 30 | 0.027439 | 0.02396 |
| 31 | 31 | 0.405488 | 0.375788 |

FIG. 17

| | COMBINATION OF PARAMETERS |
|---|---|
| 1 | f0", Δf0"(4), Δf0"(-4) |
| 2 | f0", Δf0"(4), Δf0"(-4), p" |
| 3 | f0", Δf0"(4), Δf0"(-4), p", Δp"(-4) |
| 4 | f0", Δf0"(4), Δf0"(-4), p", Δp"(-4), Δp"(4) |
| 5 | f0", Δf0"(1), Δf0"(-1), Δf0"(4), Δf0"(-4), p", Δp"(-4), Δp"(4) |
| 6 | f0", Δf0"(1), Δf0"(-1), Δf0"(4), Δf0"(-4), p", Δp"(-4), Δp"(4), $d_p$, $\Delta d_p$(-T) |
| 7 | f0", Δf0"(1), Δf0"(-1), Δf0"(4), Δf0"(-4), p", Δp"(-1), Δp"(1), Δp"(-4), Δp"(4), $d_p$, $\Delta d_p$(-T) |
| 8 | f0", Δf0"(1), Δf0"(-1), Δf0"(2), Δf0"(-2), Δf0"(4), Δf0"(-4), p", Δp"(-1), Δp"(1), Δp"(-4), Δp"(4), $d_p$, $\Delta d_p$(-T) |
| 9 | f0", Δf0"(1), Δf0"(-1), Δf0"(2), Δf0"(-2), Δf0"(4), Δf0"(-4), p", Δp"(-1), Δp"(1), Δp"(-2), Δp"(2), Δp"(-4), Δp"(4), $d_p$, $\Delta d_p$(-T) |
| 10 | f0", Δf0"(1), Δf0"(-1), Δf0"(2), Δf0"(-2), Δf0"(4), $\Delta f_0$"(-4), p", Δp"(-1), Δp"(1), Δp"(-2), Δp"(2), Δp"(-4), Δp"(4), $d_p$, $\Delta d_p$(-T), $\Delta d_p$(T) |
| 11 | Δf0"(1), Δf0"(-1), Δf0"(2), Δf0"(-2), Δf0"(4), Δf0"(-4), Δp"(-1), Δp"(1), Δp"(-2), Δp"(2), Δp"(-4), Δp"(4), $d_p$, $\Delta d_p$(-T), $\Delta d_p$(T) |
| 12 | Δf0"(1), Δf0"(-1), Δf0"(2), Δf0"(-2), Δf0"(3), Δf0"(-3), Δf0"(4), Δf0"(-4), Δp"(-1), Δp"(1), Δp"(-2), Δp"(2), Δp"(-4), Δp"(4), $d_p$, $\Delta d_p$(-T), $\Delta d_p$(T) |
| 13 | Δf0"(1), Δf0"(-1), Δf0"(2), Δf0"(-2), Δf0"(3), Δf0"(-3), Δf0"(4), Δf0"(-4), Δp"(-1), Δp"(1), Δp"(-2), Δp"(2), Δp"(-3), Δp"(3), Δp"(-4), Δp"(4), $d_p$, $\Delta d_p$(-T), $\Delta d_p$(T) |
| 14 | f0", Δf0"(1), Δf0"(-1), Δf0"(2), Δf0"(-2), Δf0"(3), Δf0"(-3), Δf0"(4), Δf0"(-4), p", Δp"(-1), Δp"(1), Δp"(-2), Δp"(2), Δp"(-3), Δp"(3), Δp"(-4), Δp"(4), $d_p$, $\Delta d_p$(-T), $\Delta d_p$(T) |
| 15 | Δf0"(1), Δf0"(-1), Δf0"(4), Δf0"(-4), Δp"(-1), Δp"(1), Δp"(-4), Δp"(4), $d_p$, $\Delta d_p$(-T), $\Delta d_p$(T) |
| 16 | Δp"(-1), Δp"(1), Δp"(-4), Δp"(4), $d_p$, $\Delta d_p$(-T), $\Delta d_p$(T) |
| 17 | f0", p", $d_p$ |
| 18 | f0", Δf0"(4),Δf0"(-4), p", Δp"(-4), Δp"(4), $d_p$ |

FIG. 23A

| CODE Cm | $\pi_{emp}$ (Cm) | $\pi_{nrm}$ (Cm) |
|---|---|---|
| 1 | | |
| 2 | | |
| 3 | | |
| ⋮ | | |
| m | | |

FIG. 23B $a_{emp\ ij}$

| $S_{emp\ i}$ \ $S_{emp\ j}$ | $S_{emp1}$ | $S_{emp2}$ | $S_{emp3}$ | $S_{emp4}$ |
|---|---|---|---|---|
| $S_{emp1}$ | $a_{emp11}$ | $a_{emp12}$ | $a_{emp13}$ | $a_{emp14}$ |
| $S_{emp2}$ | | $a_{emp22}$ | $a_{emp23}$ | $a_{emp24}$ |
| $S_{emp3}$ | | | $a_{emp33}$ | $a_{emp34}$ |

FIG. 23C $a_{nrm\ ij}$

| $S_{nrm\ i}$ \ $S_{nrm\ j}$ | $S_{nrm1}$ | $S_{nrm2}$ | $S_{nrm3}$ | $S_{nrm4}$ |
|---|---|---|---|---|
| $S_{nrm1}$ | $a_{nrm11}$ | $a_{nrm12}$ | $a_{nrm13}$ | $a_{nrm14}$ |
| $S_{nrm2}$ | | $a_{nrm22}$ | $a_{nrm23}$ | $a_{nrm24}$ |
| $S_{nrm3}$ | | | $a_{nrm33}$ | $a_{nrm34}$ |

FIG. 24

| STATE | C1 | C2 | • • • | Cm |
|---|---|---|---|---|
| $S_{emp1}$ | $b_{emp1}(C1)$ | $b_{emp1}(C2)$ | • • • | $b_{emp1}(Cm)$ |
| $S_{emp2}$ | $b_{emp2}(C1)$ | $b_{emp2}(C2)$ | • • • | $b_{emp2}(Cm)$ |
| $S_{emp3}$ | $b_{emp3}(C1)$ | $b_{emp3}(C2)$ | • • • | $b_{emp3}(Cm)$ |
| $S_{emp4}$ | $b_{emp4}(C1)$ | $b_{emp4}(C2)$ | • • • | $b_{emp4}(Cm)$ |
| $S_{nrm1}$ | $b_{nrm1}(C1)$ | $b_{nrm1}(C2)$ | • • • | $b_{nrm1}(Cm)$ |
| $S_{nrm2}$ | $b_{nrm2}(C1)$ | $b_{nrm2}(C2)$ | • • • | $b_{nrm2}(Cm)$ |
| $S_{nrm3}$ | $b_{nrm3}(C1)$ | $b_{nrm3}(C2)$ | • • • | $b_{nrm3}(Cm)$ |
| $S_{nrm4}$ | $b_{nrm4}(C1)$ | $b_{nrm4}(C2)$ | • • • | $b_{nrm4}(Cm)$ |

FIG. 25

| FRAME # | 1 | 2 | 3 | | $F_{N-1}$ | $F_N$ |
|---|---|---|---|---|---|---|
| CODE | $Cm_1$ | $Cm_2$ | $Cm_3$ | . . . | $Cm_{FN-1}$ | $Cm_{FN}$ |
| STATE | $S^k_{emp1}$ = $S_{emp1}$ | $S^k_{emp2}$ | $S^k_{emp3}$ | . . . | $S^k_{empFN-1}$ | $S^k_{empFN}$ = $S_{emp4}$ |
| STATE TRANSITION PROBABILITY | —— | $a_{empk1k2}$ | $a_{empk2k3}$ | . . . | $a_{empkFN-2kFN-1}$ | $a_{empkFN-1kFN}$ |
| OUTPUT PROBABILITY | $b_{empk1}(Cm_1)$ | $b_{empk2}(Cm_2)$ | $b_{empk3}(Cm_3)$ | . . . . . | | $b_{empkFN}(Cm_{FN})$ |

SPEECH PROCESSING METHOD AND APPARATUS FOR DECIDING EMPHASIZED PORTIONS OF SPEECH, AND PROGRAM THEREFOR

CROSS REFERENCE TO RELATED APPLICATION

This application is a continuation of and claims the benefit of priority from U.S. Ser. No. 10/214,232, filed Aug. 8, 2002, and is based upon and claims the benefit of priority from the prior Japanese Patent Applications No. 2001-241278, filed on Aug. 8, 2001, No. 2002-047597, filed on Feb. 25, 2002, No. 2002-059188, filed on Mar. 5, 2002, No. 2002-060844, filed on Mar. 6, 2002, and No. 2002-088582, filed on Mar. 27, 2002, the entire contents of each of which are incorporated herein by reference.

BACKGROUND OF THE INVENTION

The present invention relates to a method for analyzing a speech signal to extract emphasized portions from speech, a speech processing scheme for implanting the method, an apparatus embodying the scheme and a program for implementing the speech processing scheme.

It has been proposed to determine those portions of speech content emphasized by the speaker as being important and automatically provide a summary of the speech content. For example, Japanese Patent Application Laid-Open Gazette No. 39890/98 describes a method in which: a speech signal is analyzed to obtain speech parameters in the form of an FFT spectrum or LPC cepstrum; DP matching is carried out between speech parameter sequences of an arbitrary and another voiced portions to detect the distance between the both sequences; and when the distance is shorter than a predetermined value, the both voiced portions are decided as phonemically similar portions and are added with temporal position information to provide important portions of the speech. This method makes use of a phenomenon that words repeated in speech are of importance in many cases.

Japanese Patent Application Laid-Open Gazette No. 284793/00 discloses a method in which: speech signals in a conversation between at least two speakers, for instance, are analyzed to obtain FFT spectrums or LPC cepstrums as speech parameters; the speech parameters used to recognize phoneme elements to obtain a phonetic symbol sequence for each voiced portion; DP matching is performed between the phonetic symbol sequences of two voiced portions to detect the distance between them; closely-spaced voiced portions, that is, phonemically similar voiced portions are decided as being important portions; and a thesaurus is used to estimate a plurality of topic contents.

To determine or spot a sentence or word in speech, there is proposed a method utilizing a common phenomenon with Japanese that the frequency of a pitch pattern, composed of a tone and an accent component of the sentence or word in speech, starts low, then rises to the highest point near the end of the first half portion of utterance, then gradually lowers in the second half portion, and sharply drops to zero at the ending of the word. This method is disclosed in Itabashi et al., "A Method of Utterance Summarization Considering Prosodic Information," Proc. I 239~240, Acoustical Society of Japan 200 Spring Meeting.

Japanese Patent Application Laid-Open Gazette No. 80782/91 proposes utilization of a speech signal to determine or spot an important scene from video information accompanied by speech. In this case, the speech signal is analyzed to obtain such speech parameters as spectrum information of the speech signal and its sharp-rising and short-term sustaining signal level; the speech parameters are compared with preset models, for example, speech parameters of a speech signal obtained when the audience raised a cheer; and speech signal portions of speech parameters similar or approximate to the preset parameters are extracted and joined together.

The method disclosed in Japanese Patent Application Laid-Open Gazette No/39890/98 is not applicable to speech signals of an unspecified speakers and conversations between an unidentified number of speakers since the speech parameters such as the FFT spectrum and the LPC cepstrum are speaker-dependent. Further, the use of spectrum information makes it difficult to apply the method to natural spoken language or conversation; that is, this method is difficult of implementation in an environment where a plurality of speakers speak at the same time.

The method proposed in Japanese Patent Application Laid-Open Gazette No. 284793/00 recognizes an important portion as a phonetic symbol sequence. Hence, as is the case with Japanese Patent Application Laid-Open Gazette No. 39890/98, this method is difficult of application to natural spoken language and consequently implementation in the environment of simultaneous utterance by a plurality of speakers. Further, while adapted to provide a summary of a topic through utilization of phonetically similar portions of speech and a thesaurus, this method does not perform a quantitative evaluation and is based on the assumption that important words are high in the frequency of occurrence and long in duration. Hence, nonuse of linguistic information gives rise to a problem of spotting words that are irrelevant to the topic concerned.

Moreover, since natural spoken language is often improper in grammar and since utterance is speaker-specific, the aforementioned method proposed by Itabashi et al. presents a problem in determining speech blocks, as units for speech understanding, from the fundamental frequency.

The method disclosed in Japanese Patent Application Laid-Open Gazette No. 80782/91 requires presetting models for obtaining speech parameters, and the specified voiced portions are so short that when they are joined together, speech parameters become discontinuous at the joints and consequently speech is difficult to hear.

SUMMARY OF THE INVENTION

It is therefore an object of the present invention to provide a speech processing method with which it is possible to stably determine whether speech is emphasized or normal even under noisy environments without the need for presetting the conditions therefor and without dependence on the speaker and on simultaneous utterance by a plurality of speakers even in natural spoken language, and a speech processing method that permits automatic extraction of a summarized portion of speech through utilization of the above method. Another object of the present invention is to provide apparatuses and programs for implementing the methods.

According to an aspect of the present invention, a speech processing method for deciding emphasized portion based on a set of speech parameters for each frame comprises the steps of:

(a) obtaining an emphasized-state appearance probability for a speech parameter vector, which is a quantized set of speech parameters for a current frame by using a codebook which stores, for each code, a speech parameter vector and an emphasized-state appearance probability, each of said speech parameter vectors including at least one of the fundamental frequency, power and a temporal variation of a dynamic-measure and/or an inter-frame difference in each of the parameters;

(b) calculating an emphasized-state likelihood based on said emphasized-state appearance probability; and (c) deciding whether a portion including said current frame is emphasized or not based on said calculated emphasized-state likelihood.

According to another aspect of the present invention, there is provided a speech processing apparatus comprising:

a codebook which stores, for each code, a speech parameter vector and an emphasized-state appearance probability, each of said speech parameter vectors including at least one of fundamental frequency, power and temporal variation of a dynamic-measure and/or an inter-frame difference in each of the parameters;

an emphasized-state likelihood calculating part for calculating an emphasized-state likelihood of a portion including a current frame based on said emphasized-state appearance probability; and an emphasized state deciding part for deciding whether said portion including said current frame is emphasized or not based on said calculated emphasized-state likelihood.

In the method and apparatus mentioned above, the normal-state appearance probabilities of the speech parameter vectors may be prestored in the codebook in correspondence to the codes, and in this case, the normal-state appearance probability of each speech sub-block is similarly calculated and compared with the emphasized-state appearance probability of the speech sub-block, thereby deciding the state of the speech sub-block. Alternatively, a ratio of the emphasized-state appearance probability and the normal-state appearance probability may be compared with a reference value to make the decision.

A speech block including the speech sub-block decided as emphasized as mentioned above is extracted as a portion to be summarized, by which the entire speech portion can be summarized. By changing the reference value with which the weighted ratio is compared, it is possible to obtain a summary of a desired summarization rate.

As mentioned above, the present invention uses, as the speech parameter vector, a set of speech parameters including at least one of the fundamental frequency, power, a temporal variation characteristic of a dynamic measure, and/or an inter-frame difference in at least one of these parameters. In the field of speech processing, these values are used in normalized form, and hence they are not speaker-dependent. Further, the invention uses: a codebook having stored therein speech parameter vectors each of such a set of speech parameters and their emphasized-state appearance probabilities; quantizes the speech parameters of input speech; reads out from the codebook the emphasized-state appearance probability of the speech parameter vector corresponding to a speech parameter vector obtained by quantizing a set of speech parameters of the input speech; and decides whether the speech parameter vector of the input speech is emphasized or not, based on the emphasized-state appearance probability read out from the codebook. Since this decision scheme is semantic processing free, a language-independent summarization can be implemented. This also guarantees that the decision of the utterance state in the present invention is speaker-independent even for natural language or conversation.

Moreover, since it is decided whether the speech parameter vector for each frame is emphasized or not based on the emphasized-state appearance probability of the speech parameter vector read out of the codebook, and since the speech block including even only one speech sub-block is determined as a portion to be summarized, the emphasized state of the speech block and the portion to be summarized can be determined with appreciably high accuracy in natural language or in conversation.

BRIEF DESCRIPTION OF THE DRAWINGS

FIG. 12 is a table depicting an example of the storage of the codebook;

FIG. 14 is a table showing examples of bigrams of vector-quantized speech parameters;

FIG. 15 is a continuation of FIG. 14;

FIG. 16 is a continuation of FIG. 15;

FIG. 17 is a diagram showing examples of actual combinations of speech parameters;

FIG. 23A is a table showing initial state probabilities of emphasized and normal states for each code;

FIG. 23B is a table showing state transition probabilities provided for respective transition states in the emphasized state;

FIG. 23C is a table showing state transition probabilities provided for respective transition states in the normal state;

FIG. 24 is a table showing output probabilities of respective codes in respective transition states of the emphasized and normal states;

FIG. 25 is a table showing a code sequence derived from a sequence of frames in one speech sub-block, one state transition sequence of each code and the state transition probabilities and output probabilities corresponding thereto;

DETAILED DESCRIPTION OF THE PREFERRED EMBODIMENTS

A description will be given, with reference to the accompanying drawings, of the speech processing method for deciding emphasized speech according to the present invention and a method for extracting emphasized speech by use of the speech processing method.

Embodiment 1

Figure 1:
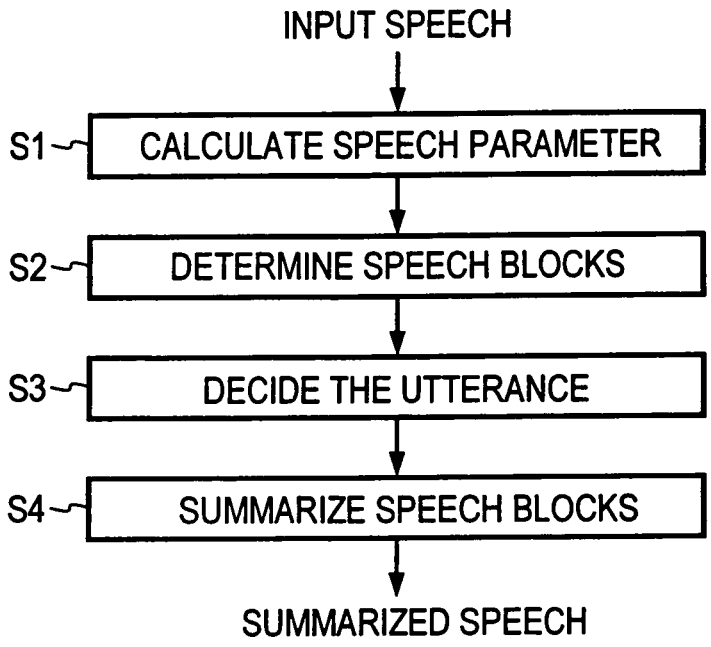
FIG. 1 is a flowchart showing an example of the basic procedure of an utterance summarization method according to a first embodiment of the present invention.

FIG. 1 shows the basic procedure for implementing the speech summarizing method according to the present invention. Step S1 is to analyze an input speech signal to calculate its speech parameters. The analyzed speech parameters are often normalized, as described later, and used for a main part of a processing. Step S2 is to determine speech sub-blocks of the input speech signal and speech blocks each composed of a plurality of speech sub-blocks. Step S3 is to determine whether the utterance of a frame forming each speech sub-block is normal or emphasized. Based on the result of determination, step S4 is to summarize speech blocks, providing summarized speech.

A description will be given of an application of the present invention to the summarization of natural spoken language or conversational speech. This embodiment uses speech parameters that can be obtained more stably even under a noisy environment and are less speaker-dependent than spectrum information or the like. The speech parameters to be calculated from the input speech signal are the fundamental frequency f0, power p, a time-varying characteristic d of a dynamic measure of speech and a pause duration (unvoiced portion) $T_S$. A method for calculating these speech parameters is described, for example, in S. FURUI (1989), Digital Processing, Synthesis, and Recognition, MARCEL DEKKER, INC., New York and Basel. The temporal variation of the dynamic measure of speech is a parameter that is used as a measure of the articulation rate, and it may be such as described in Japanese Patent No. 2976998. Namely, a time-varying characteristics of the dynamic measure is calculated based on an LPC spectrum, which represents a spectral envelope. More specifically, LPC cepstrum coefficients $C_1(t), \ldots, C_K(t)$ are calculated for each frame, and a dynamic measure d at time t, such as given by the following equation, is calculated.

$$d(t) = \sum_{k=1}^{K} \left\{ \sum_{F=t-F_0}^{t+F_0} [F \times C_k(t)] \Big/ \left( \sum_{F=t-F_0}^{t+F_0} F^2 \right) \right\}^2 \tag{1}$$

where $\pm F_0$ is the number of frames preceding and succeeding the current frame (which need not always be an integral number of frames but may also be a fixed time interval) and k denotes an order of a coefficient of LPC cepstrum, k=1, 2, . . . , K. A coefficient of the articulation rate used here is the number of time-varying maximum points of the dynamic measure per unit time, or its changing ratio per unit time.

In this embodiment, one frame length is set to 100 ms, for instance, and an average fundamental frequency f0' of the input speech signal is calculated for frame while shifting the frame starting point by steps of 50 ms. An average power p' for each frame is also calculated. Then, differences in the fundamental frequency between the current frame and those $F_0$' and f0' preceding and succeeding it by i frames, Δf0'(−i) and Δf0'(i), are calculated. Similarly, differences in the average power p' between the current frame and the preceding and succeeding frames, Δp'(−i) and Δp'(i), are calculated. Then, f0', Δf0'(−i), Δf0'(i) and p', Δp'(−i), Δp'(i) are normalized. The normalization is carried out, for example, by dividing Δf0'(−i) and Δf0'(i), for instance, by the average fundamental frequency of the entire waveform of the speech to be determined about the state of utterance. The division may also be made by an average fundamental frequency of each speech sub-bock or each speech block described later on, or by an average fundamental frequency every several seconds or several minutes. The thus normalized values are expressed as f0", Δf0"(−i) and Δf0"(i). Likewise, p', Δp'(−i) and Δp'(i) are also normalized by dividing them, for example, by the average power of the entire waveform of the speech to be determined about the state of utterance. The normalization may also be done through division by the average power of each speech sub-block or speech block, or by the average power every several seconds or several minutes. The normalized values are expressed as p", Δp"(−i) and Δp"(i). The value i is set to 4, for instance.

A count is taken of the number of time-varying peaks of the dynamic measure, i.e. the number of $d_p$ of varying maximum points of the dynamic measure, within a period$\pm T_1$ ms (time width $2T_1$) prior and subsequent to the starting time of the current frame, for instance. (In this case, since $T_1$ is selected sufficiently longer than the frame length, for example, approximately 10 times longer, the center of the time width 2T may be set at any point in the current frame). A difference component, $\Delta d_p(-T_2)$, between the number $d_p$ and that $d_p$ within the time width $2T_1$ ms about the time $T_1$ ms that is earlier than the starting time of the current frame by $T_2$ ms is obtained as the temporal variation of the dynamic measure.

Similarly, a difference component, $\Delta d_p(-T_2)$, between the number $d_p$ within the above-mentioned time width $\pm T_1$ ms and the number $d_p$ within a period of the time width $2T_1$ about the time $T_3$ ms elapsed after the termination of the current frame. These values $T_1$, $T_2$ and $T_3$ are sufficiently larger than the frame length and, in this case, they are set such that, for example, $T_1=T_2=T_3=450$ ms. The length of unvoiced portions before and after the frame are identified by $T_{SR}$ and $T_{SF}$. In step S1 the values of these parameters are calculated for each frame.

Figure 2:
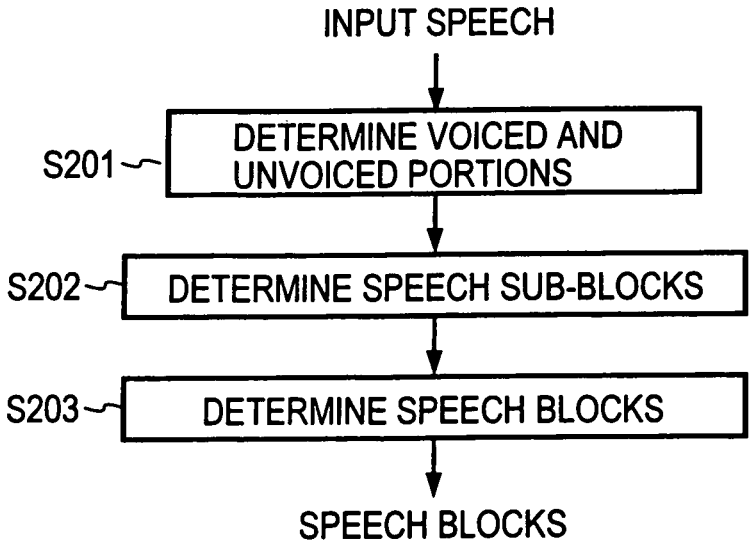
FIG. 2 is a flowchart showing an example of the procedure for determining voiced portions, speech sub-blocks and speech blocks from input speech in step S2 in FIG. 1.

FIG. 2 depicts an example of a method for determining speech sub-block and speech block of the input speech in step S2. The speech sub-block is a unit over which to decide the state of utterance. The speech block is a portion immediately preceded and succeeded by unvoiced portions, for example, 400 ms or longer.

In step S201 unvoiced and voiced portions of the input speech signal are determined. Usually, a voiced-unvoiced decision is assumed to be an estimation of a periodicity in terms of a maximum of an autocorrelation function, or a modified correlation function. The modified correlation function is an autocorrelation function of a prediction residual obtained by removing the spectral envelope from a short-time spectrum of the input signal. The voiced-unvoiced decision is made depending on whether the peak value of the modified correlation function is larger than a threshold value. Further, a delay time that provides the peak value is used to calculate a pitch period 1/f0 (the fundamental frequency f0).

While in the above each speech parameter is analyzed from the speech signal for each frame, it is also possible to use a speech parameter represented by a coefficient or code obtained when the speech signal is already coded for each frame (that is, analyzed) by a coding scheme based on CELP (Code-Excited Linear Prediction) model, for instance. In general, the code by CELP coding contains coded versions of a linear predictive coefficient, a gain coefficient, a pitch period and so forth. Accordingly, these speech parameters can be decoded from the code by CELP. For example, the absolute or squared value of the decoded gain coefficient can be used as power for the voiced-unvoiced decision based on the gain coefficient of the pitch component to the gain coefficient of an aperiodic component. A reciprocal of the decoded pitch period can be used as the pitch frequency and consequently as the fundamental frequency. The LPC cepstrum for calculation of the dynamic measure, described previously in connection with Eq. (1), can be obtained by converting LPC coefficients obtained by decoding. Of course, when LSP coefficients are contained in the code by CELP, the LPC cepstrum can be obtained from LPC coefficients once converted from the LSP coefficients. Since the code by CELP contains speech parameters usable in the present invention as mentioned above, it is recommended to decode the code by CELP, extract a set of required speech parameters in each frame and subject such a set of speech parameters to the processing described below.

In step S202, when the durations, $t_{SR}$ and $T_{SF}$, of unvoiced portions preceding and succeeding voiced portions are each longer than a predetermined value $t_s$ sec, the portion containing the voiced portions between the unvoiced portions is defined as a speech sub-block block S. The duration $t_s$ of the unvoiced portion is set to 400 ms or more, for instance.

In step S203, the average power p of one voiced portion in the speech sub-block, preferably in the latter half thereof, is compared with a value obtained by multiplying the average power $P_S$ of the speech sub-block by a constant β. If $p<\beta P_S$, the speech sub-block is decided as a final speech sub-block, and the interval from the speech sub-block subsequent to the immediately preceding final speech sub-block to the currently detected final speech sub-block is determined as a speech block.

Figure 3:
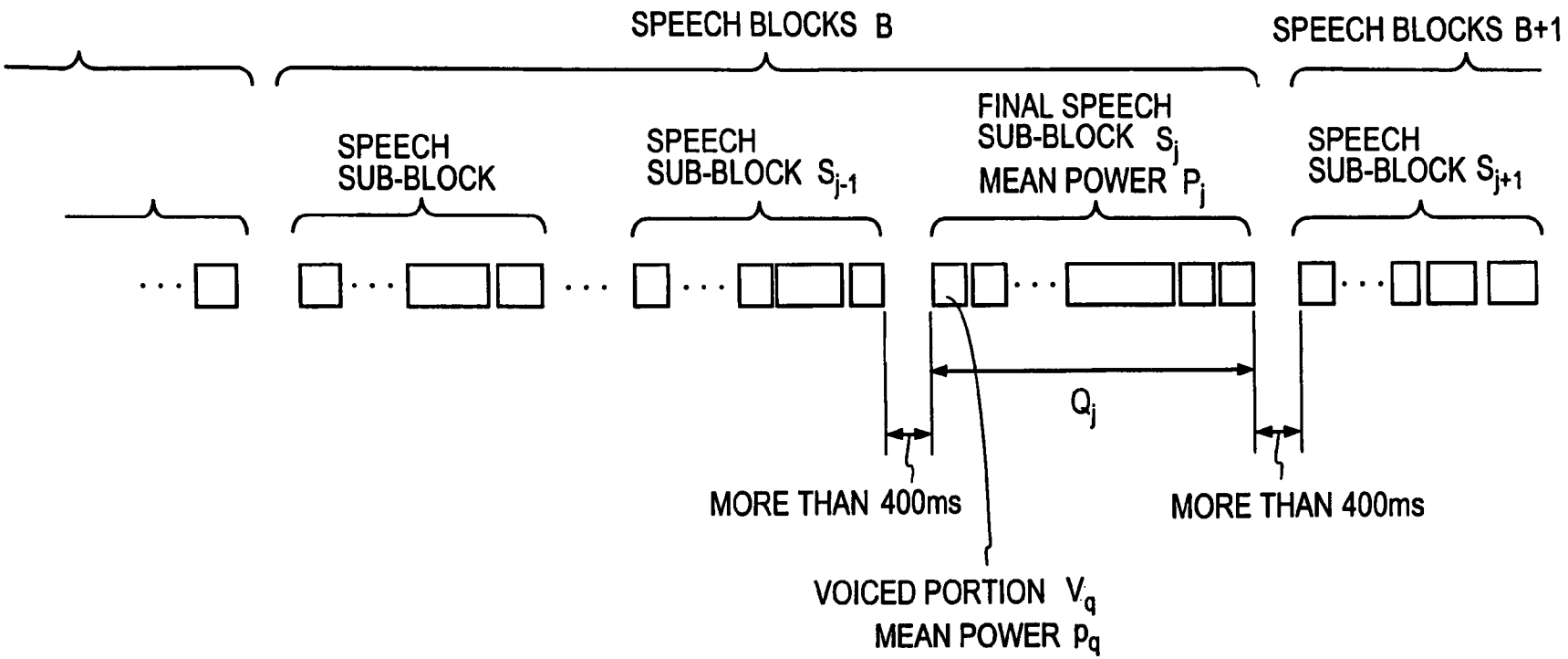
FIG. 3 is a diagram for explaining the relationships between the unvoiced portions, the speech sub-blocks and the speech blocks.

FIG. 3 schematically depicts the voiced portions, the speech sub-block and the speech block. The speech sub-block is determined when the aforementioned duration of each of the unvoiced portions immediately preceding and succeeding the voiced portion is longer than $t_s$ sec. In FIG. 3 there are shown speech sub-blocks $S_{j-1}$, $S_j$ and $S_{j+1}$. Now, the speech sub-block $S_j$ will be described. The speech sub-block $S_j$ is composed of $Q_j$ voiced portions, and its average power will hereinafter be identified by $P_j$ as mentioned above. An average power of a q-th voiced portion $V_q$ (where $q=1, 2, \ldots, Q_j$) contained in the speech sub-block $S_j$ will hereinafter be denoted as $p_q$. Whether the speech sub-block $S_j$ is a final speech sub-block of the speech block B is determined based on the average power of voiced portions in the latter half portion of the speech sub-block $S_j$. When the average power $p_q$ of voiced portions from $q=Q_j-a$ to $Q_j$ is smaller than the average power $P_j$ of the speech sub-block $S_j$, that is, when $$\sum_{q=Q_j-\alpha}^{Q_j} p_q/(\alpha+1) < \beta P_j \tag{2}$$

the speech sub-block $S_j$ is defined as a final speech sub-block of the speech block B. In Eq. (2), α and β are constants, and α is a value equal to or smaller than $Q_j/2$ and β is a value, for example, about 0.5 to 1.5. These values are experimentally predetermined with a view to optimizing the determination of the speech sub-block. The average power $p_q$ of the voiced portions is an average power of all frames in the voiced portions, and in this embodiment $\alpha=3$ and $\beta=0.8$. In this way, the speech sub-block group between adjoining final speech sub-blocks can be determined as a speech block.

Figure 4:
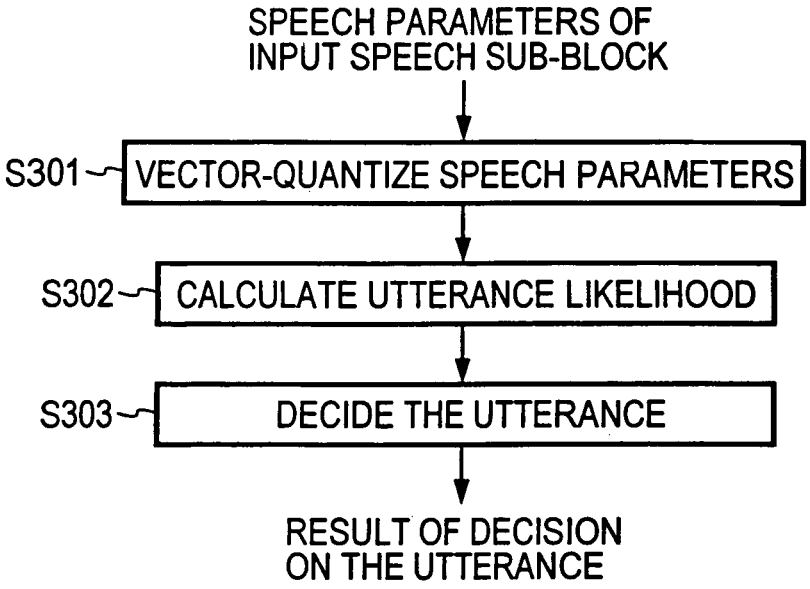
FIG. 4 is a flowchart showing an example of the procedure for deciding the utterance of input speech sub-blocks in step S3 in FIG. 1.

FIG. 4 shows an example of a method for deciding the state of utterance of the speech sub-block in step S3 in FIG. 1. The state of utterance herein mentioned refers to the state in which a speaker is making an emphatic or normal utterance. In step S301 a set of speech parameters of the input speech sub-block is vector-quantized (vector-coded) using a codebook prepared in advance. As described later on, the state of utterance is decided using a set of speech parameters including a predetermined one or more of the aforementioned speech parameters: the fundamental frequency f0" of the current frame, the differences Δf0"(−i) and Δf0"(i) between the current frame and those preceding and succeeding it by i frames, the average power p" of the current frame, the differences Δp"(−i) and Δp"(i) between the current frame and those preceding and succeeding it by i frames, the temporal variation of the dynamic measure $d_p$ and its inter-frame differences $\Delta d_p(-T)$, $\Delta d_p(T)$. Examples of such a set of speech parameters will be described in detail later on. In the codebook there are stored, as speech parameter vectors, values of sets of quantized speech parameters in correspondence to codes (indexes), and that one of the quantized speech parameter vectors stored in the codebook which is the closest to the set of speech parameters of the input speech or speech already obtained by analysis is specified. In this instance, it is common to specify a quantized speech parameter vector that minimizes the distortion (distance) between the set of speech parameters of the input signal and the speech parameter vector stored in the codebook.

Production of Codebook

Figure 5:
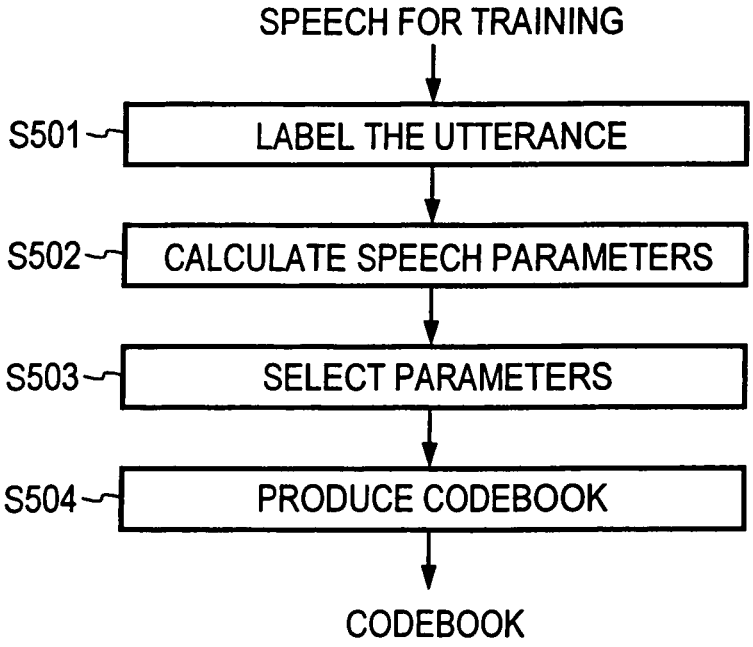
FIG. 5 is a flowchart showing an example of the procedure for producing a codebook for use in the present invention.

FIG. 5 shows an example of a method for producing the codebook. A lot of speech for training use is collected from a test subject, and emphasized speech and normal speech are labeled accordingly in such a manner that they can be distinguished from each other (S501).

For example, in utterances often spoken in Japanese, the subject's speech is determined as being emphasized in such situations as listed below. When the subject:

(a) Slowly utters a noun and a conjunction in a loud voice;

(b) Starts to slowly speak in a loud voice in order to insist a change of the topic of conversation;

(c) Raises his voice to emphasize an important noun and so on;

(d) Speaks in a high-pitched but not so loud voice;

(e) While smiling a wry smile out of impatience, speaks in a tone as if he tries to conceal high real intention;

(f) Speaks in a high-pitched voice at the end of his sentence in a tone he seeks approval of or puts a question to the people around him;

(g) Slowly speaks in a loud, powerful voice at the end of his sentence in an emphatic tone;

(h) Speaks in a loud, high-pitched voice, breaking in other people's conversation and asserting himself more loudly than other people;

(i) Speaks in a low voice about a confidential matter, or speaks slowly in undertones about an important matter although he usually speaks loudly.

In this example, normal speech is speech that does not meet the above conditions (a) to (i) and that the test subject felt normal.

While in the above speech is determined as to whether it is emphasized or normal, emphasis in music can also be specified. In the case of song with accompaniment, emphasis is specified in such situations as listed below. When a singing voice is:

(a') Loud and high-pitched;

(b') Powerful;

(c') Loud and strongly accented;

(d') Loud and varying in voice quality;

(e') Slow-tempo and loud;

(f') Loud, high-pitched and strongly accented;

(g') Loud, high-pitched and shouting;

(h') Loud and variously accented.

(i') Slow-tempo, loud and high-pitched at the end of a bar, for instance;

(j') Loud and slow-tempo;

(k') Slow-tempo, shouting and high-pitched;

(l') Powerful at the end of a bar, for instance;

(m') Slow and a little strong;

(n') Irregular in melody;

(o') Irregular in melody and high-pitched;

Further, the emphasized state can also be specified in a musical piece without a song for the reasons listed below.

(a") The power of the entire emphasized portion increases.

(b") The difference between high and low frequencies is large.

(c") The power increases.

(d") The number of instrument changes.

(e") Melody and tempo change.

With a codebook produced based on such data, it is possible to summarize a song and an instrumental music as well as speech. The term "speech" used in the accompanied claims are intended to cover songs and instrumental music as well as speech.

For the labeled portion of each of the normal and emphasized speech, as in step S1 in FIG. 1, speech parameters are calculated (S502) and a set of parameters for use as speech parameter vector is selected (S503). The parameter vectors of the labeled portions of the normal and emphasized speech are used to produce a codebook by an LBG algorithm. The LBG algorithm is described, for example, in Y. Linde, A. Buzo and R. M. Gray, "An algorithm for vector quantizer design," IEEE Trans. Commun., vol. Com-28, pp. 84-95, 1980. The codebook size is variable to $2^m$ (where m is an integer equal to or greater than 1), and quantized vectors are predetermined which correspond to m-bit codes C=00, . . . , 0~C=11 . . . 1. The codebook may preferably be produced using $2^m$ speech parameter vectors that are obtained through standardization of all speech parameters of each speech sub-block, or all speech parameters of each suitable portion longer than the speech sub-block or speech parameters of the entire training speech, for example, by its average value and a standard deviation.

Turning back to FIG. 4, in step S301 the speech parameters obtainable for each frame of the input speech sub-blocks are standardized by the average value and standard deviation used to produce the codebook, and the standardized speech parameters are vector-quantized (coded) using the codebook to obtain codes corresponding to the quantized vectors, each for one frame. Of speech parameters calculated from the input speech signal, the set of parameters to be used for deciding the state of utterance is the same as the set of parameters used to produce the aforementioned codebook.

To specify a speech sub-block containing an emphasized voiced portion, a code C (an index of the quantized speech parameter vector) in the speech sub-block is used to calculate the utterance likelihood for each of the normal and the emphasized state. To this end, the probability of occurrence of an arbitrary code is precalculated for each of the normal and the emphasized state, and the probability of occurrence and the code are prestored as a set in the codebook. Now, a description will be given of an example of a method for calculating the probability of occurrence. Let n represent the number of frames in one labeled portion in the training speech used for the preparation of the aforementioned codebook. When codes of speech parameter vectors obtainable from the respective frame are $C_1, C_2, C_3, \ldots, C_n$ in temporal order, the probabilities $P_{Aemp}$ and $P_{Anrm}$ of the labeled portion A becoming emphasized and normal, respectively, are given by the following equations:

$$P_{Aemp} = P_{emp}(C_1)P_{emp}(C_2 \mid C_1) \cdots P_{emp}(C_n \mid C_1 \cdots C_{n-1}) = \sum_{i=1}^{n} P_{emp}(C_i \mid C_1 \cdots C_{i-1}) \quad (3)$$

$$P_{Anrm} = P_{nrm}(C_1)P_{nrm}(C_2 \mid C_1) \cdots P_{nrmp}(C_n \mid C_1 \cdots C_{n-1}) = \sum_{i=1}^{n} P_{enrm}(C_i \mid C_1 \cdots C_{i-1}) \quad (4)$$

where $P_{emp}(C_i|C_1 \ldots C_{i-1})$ is a conditional probability of the code $C_i$ becoming emphasized after a code sequence $C_1 \ldots C_{i-1}$ and $P_{nrm}(C_i|C_1 \ldots C_{i-1})$ is a conditional probability of the code $C_i$ similarly becoming normal with respect to the code sequence $C_1 \ldots C_{i-1}$. $P_{emp}(C_1)$ is a value obtained by quantizing the speech parameter vector for each frame with respect to all the training speech by use of the codebook, then counting the number of codes $C_1$ in the portions labeled as emphasized, and dividing the count value by the total number of codes (=the number of frames) of the entire training speech labeled as emphasized. $P_{nrm}(C_1)$ is a value obtained by dividing the number of codes $C_1$ in the portion labeled as normal by the total number of codes in the entire training speech labeled as normal.

To simplify the calculation of the conditional probability, this example uses a well-known N-gram model (where N<i). The N-gram model is a model that the occurrence of an event at a certain point in time is dependent on the occurrence of N−1 immediately receding events; for example, the probability $P(C_i)$ that a code $C_i$ occurs in an i-th frame is calculated as $P(C_i)=P(C_i|C_{i-N+1} \ldots C_{i-1})$. By applying the N-gram model to the conditional probabilities $P_{emp}(C_i|C_1 \ldots C_{i-1})$ and $P_{nrm}(C_i|C_1 \ldots C_{i-1})$ in Eqs. (3) and (4), they can be approximated as follows.

$$P_{emp}(C_i|C_1 \ldots C_{i-1})=P_{emp}(C_{i-N+1} \ldots C_{i-1}) \quad (5)$$

$$P_{nrm}(C_i|C_1 \ldots C_{i-1})=P_{nrm}(C_i|C_{i-N+1} \ldots C_{i-1}) \quad (6)$$

Such conditional probabilities $P_{emp}(C_i|C_1 \ldots C_{i-1})$ and $P_{nrm}(C_i|C_1 \ldots C_{i-1})$ in Eqs. (3) and (4) are all derived from the conditional probabilities $P_{emp}(C_i|C_{i-N+1} \ldots C_{i-1})$ and $P_{nrm}(C_i|C_{i-N+1} \ldots C_{i-1})$ approximated by the conditional probabilities $P_{emp}(C_i|C_1 \ldots C_{i-1})$ and $P_{nrm}(C_i|C_1 \ldots C_{i-1})$ in Eqs. (3) and (4) by use of the N-gram model, but there are cases where the quantized code sequences corresponding to those of the speech parameters of the input speech signal are not available from the training speech. In view of this, low-order conditional appearance probabilities are calculated by interpolation from a high-order (that is, long code-sequence) conditional appearance probability and an independent appearance probability. More specifically, a linear interpolation is carried out using a trigram for N=3, a bigram for N=2 and a unigram for N=1 which are defined below. That is, $$N=3(\text{trigram}): P_{emp}(C_i|C_{i-2}C_{i-1}), P_{nrm}(C_i|C_{i-2}C_{i-1})$$

$$N=2(\text{bigram}): P_{emp}(C_i|C_{i-1}), P_{nrm}(C_i|C_{i-1})$$

$$N=1(\text{unigram}): P_{emp}(C_i), P_{nrm}(C_i)$$

These three emphasized-state appearance probabilities of $C_i$ and the three normal-state appearance probabilities of $C_i$ are used to obtain $P_{emp}(C_i|C_{i-2}C_{i-1})$ and $P_{nrm}(C_i|C_{i-2}C_{i-1})$ by the following interpolation equations:

$$P_{emp}(C_i \mid C_{i-2}C_{i-1}) = \lambda_{emp1}P_{emp}(C_i \mid C_{i-2}C_{i-1}) + \lambda_{emp2}P_{emp}(C_i \mid C_{i-1}) + \lambda_{emp3}P_{emp}(C_i) \quad (7)$$

$$P_{nrm}(C_i \mid C_{i-2}C_{i-1}) = \lambda_{nrm1}P_{nrm}(C_i \mid C_{i-2}C_{i-1}) + \lambda_{nrm2}P_{nrm}(C_i \mid C_{i-1}) + \lambda_{nrm3}P_{nrm}(C_i) \quad (8)$$

Let n represent the number of frames of Trigram training data labeled as emphasized. When the codes $C_1, C_2, \ldots C_N$ are obtained in temporal order, re-estimation equations for $\lambda_{emp1}$, $\lambda_{emp2}$ and $\lambda_{emp3}$ become as follows:

$$\lambda_{emp1} = \frac{1}{n}\sum_{i=1}^{n}\lambda_{emp1}P_{emp}(C_i \mid C_{i-2}C_{i-1})/\{\lambda_{emp1}P_{emp}(C_i \mid C_{i-2}C_{i-1}) + \lambda_{emp2}P_{emp}(C_i \mid C_{i-1}) + \lambda_{emp3}P_{emp}(C_i)\}$$

$$\lambda_{emp2} = \frac{1}{n}\sum_{i=1}^{n}\lambda_{emp2}P_{emp}(C_i \mid C_{i-1})/\{\lambda_{emp1}P_{emp}(C_i \mid C_{i-2}C_{i-1}) + \lambda_{emp2}P_{emp}(C_i \mid C_{i-1}) + \lambda_{emp3}P_{emp}(C_i)\}$$

-continued $$\lambda_{emp3} = \frac{1}{n}\sum_{i=1}^{n}\lambda_{emp3}P_{emp}(C_i)/\{\lambda_{emp1}P_{emp}(C_i \mid C_{i-2}C_{i-1}) + \lambda_{emp2}P_{emp}(C_i \mid C_{i-1}) + \lambda_{emp3}P_{emp}(C_i)\}$$

Likewise, $\lambda_{nrm1}$, $\lambda_{nrm2}$ and $\lambda_{nrm3}$ can also be calculated.

In this example, when the number of frames of the labeled portion A is $F_A$ and the codes obtained are $C_1, C_2, \ldots, C_{FA}$, the probabilities $P_{Aemp}$ and $P_{Anrm}$ of the labeled portion A becoming emphasized and normal are as follows:

$$P_{Aemp}=P_{emp}(C_3|C_1C_2) \ldots P_{emp}(C_{FA}|C_{FA-2}C_{FA-1}) \quad (9)$$

$$P_{Anrm}=P_{nrm}(C_3|C_1C_2) \ldots P_{nrm}(C_{FA}|C_{FA-2}C_{FA-1}) \quad (10)$$

To conduct this calculation, the abovementioned trigram, bigram and unigram are calculated for arbitrary codes and stored in a codebook. That is, in the codebook sets of speech parameter vectors, emphasized-state appearance probabilities and normal-state appearance probabilities of the respective codes are each stored in correspondence to one of the codes. Used as the emphasized-state appearance probability corresponding of each code is the probability (independent appearance probability) that each code appears in the emphasized state independently of a code having appeared in a previous frame and/or a conditional probability that the code appears in the emphasized state after a sequence of codes selectable for a predetermined number of continuous frames immediately preceding the current frame. Similarly, the normal-state appearance probability is the independent appearance probability that the code appears in the normal state independently of a code having appeared in a previous frame and/or a conditional probability that the code appears in the normal state after a sequence of codes selectable for a predetermined number of continuous frames immediately preceding the current frame.

As depicted in FIG. 12, there is stored in the codebook, for each of the codes C1, C2, . . . , the speech parameter vector, a set of independent appearance probabilities for the emphasized and normal states and a set of conditional appearance probabilities for the emphasized and normal states. The codes C1, C2, C3, . . . each represent one of codes (indexes) corresponding to the speech parameter vectors in the codebook, and they have m-bit values "00 . . . 00," "00 . . . 01," "00 . . . 10," . . . , respectively. An h-th code in the codebook will be denoted by Ch; for example, Ci represents an i-th code.

Figure 6:
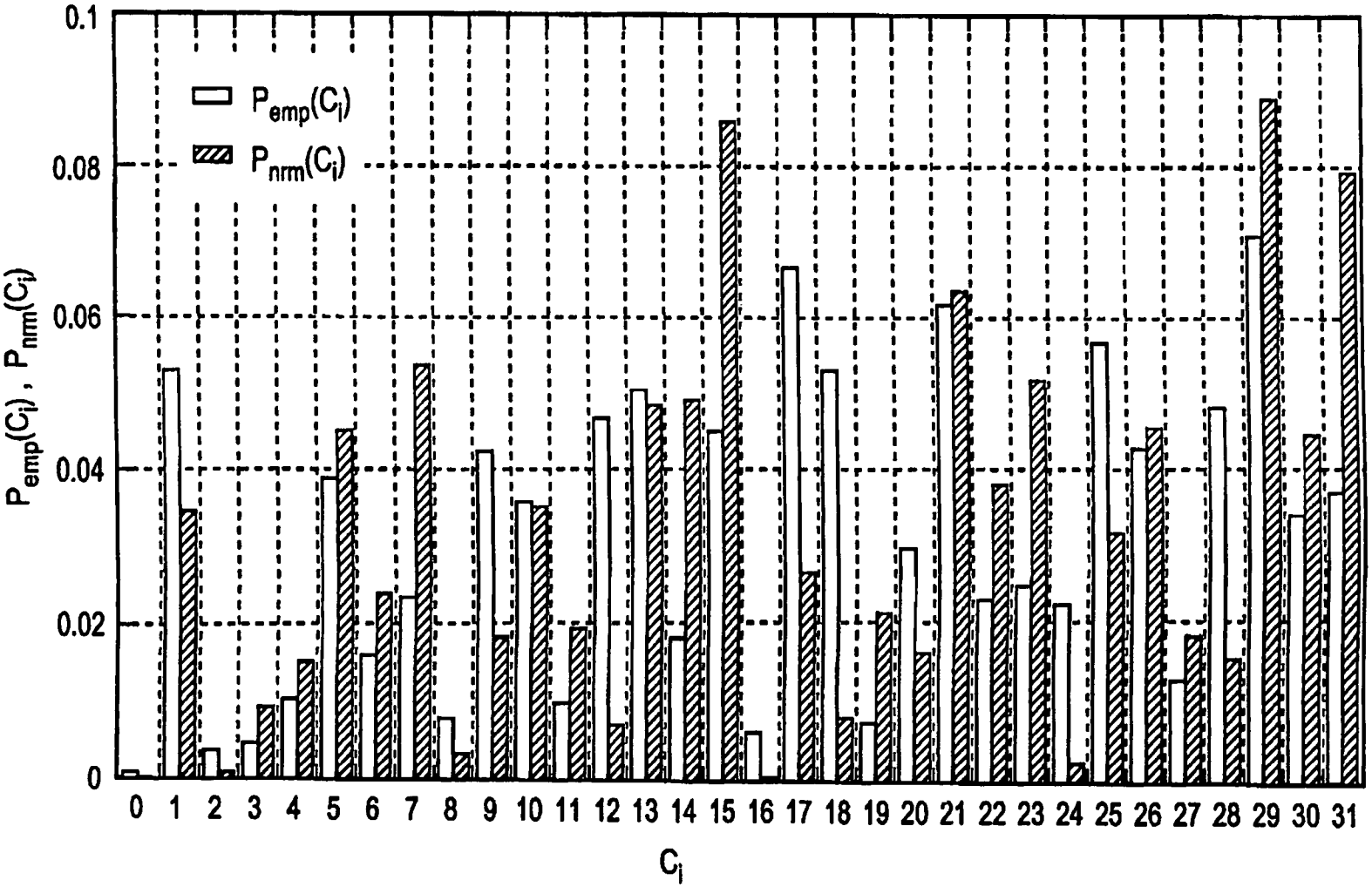
FIG. 6 is a graph showing, by way of example, unigrams of vector-quantized codes of speech parameters.

Now, a description will be given of examples of the unigram and bigram in the emphasized and normal state in the case where parameters f0", p" and $d_p$ are used as a set of speech parameters which are preferable to the present invention and the codebook size (the number of speech parameter vectors) is $2^5$. FIG. 6 shows the unigram. The ordinate represents $P_{emp}(Ch)$ and $P_{nrm}(Ch)$ and the abscissa represents value of the code Ch (where C0=0, C1=1, . . . , C31=31). The bar graph at the left of the value of each code Ch is $P_{emp}(Ch)$ and the right-hand bar graph is $P_{nrm}(Ch)$. In this example, the unigram of code C17 becomes as follows:

$$P_{emp}(C17)=0.065757$$

$$P_{nrm}(C17)=0.024974$$

Figure 7:
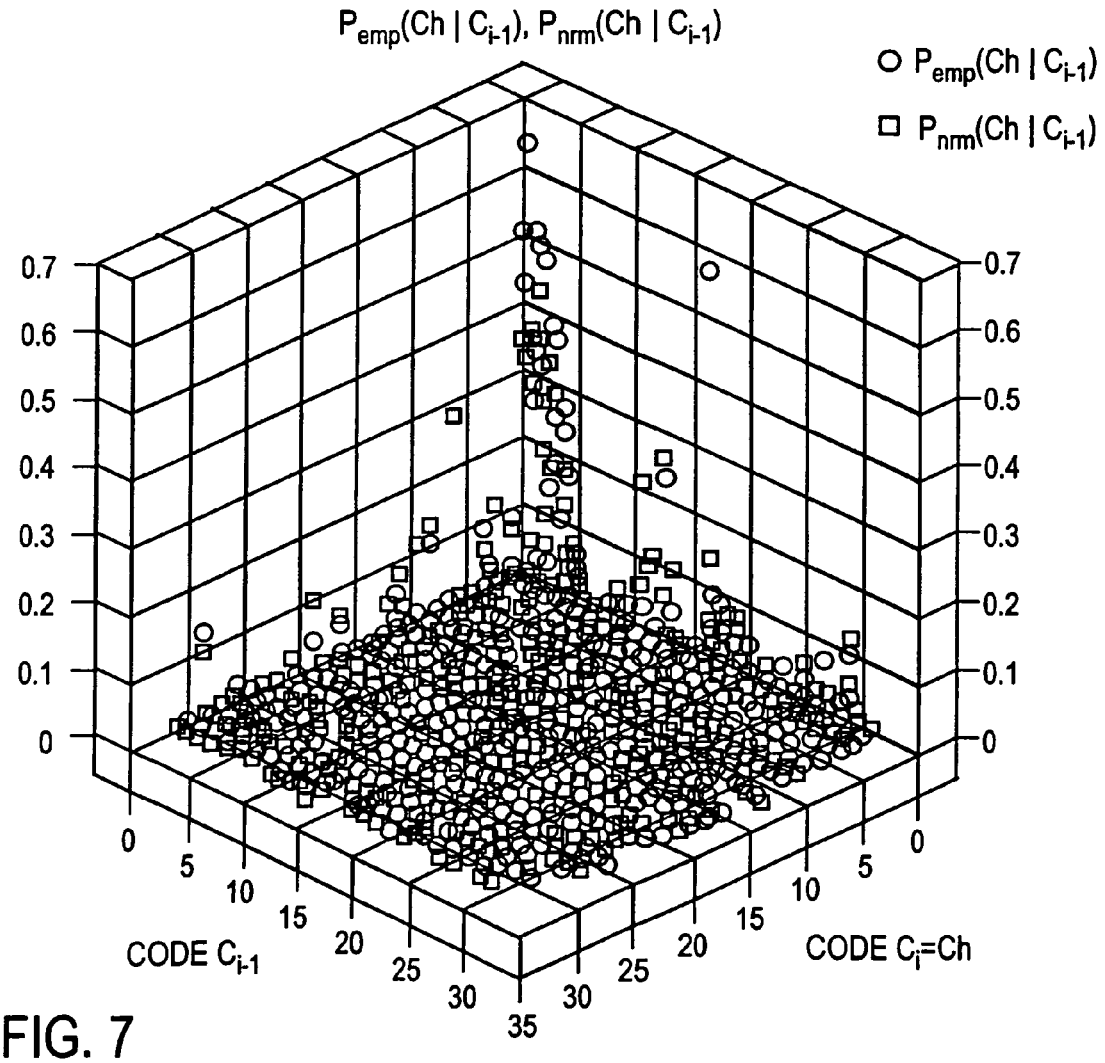
FIG. 7 is a graph showing examples of bigrams of vector-quantized codes of speech parameters.
Figure 8:
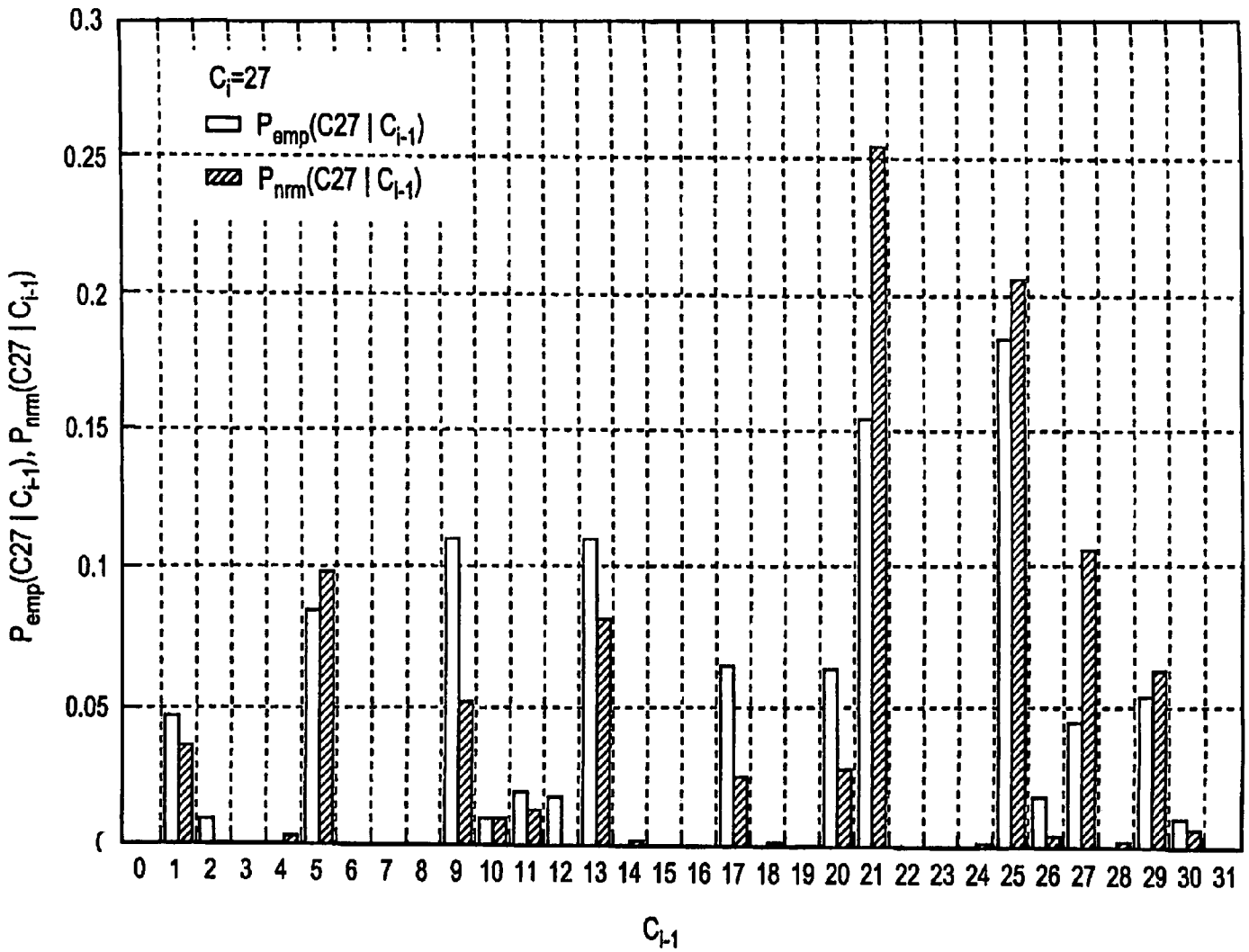
FIG. 8 is a graph showing a bigram of code Ch=27 in FIG. 7.

From FIG. 6 it can be seen that the unigrams of the codes of the vector-quantized sets of speech parameters for the emphasized and normal states differ from each other since there is a significant difference between $P_{emp}(Ch)$ and $P_{nrm}(Ch)$ for an arbitrary value i. FIG. 7 shows the bigram. Some values of $P_{emp}(C_i|C_{i-1})$ and $P_{nrm}(C_i|C_{i-1})$ are shown in FIGS. 14 through 16. In this case, i is the time series number corresponding to the frame number, and an arbitrary code Ch can be assigned to every code C. In this example, the bigram of code $C_i$=27 becomes as shown in FIG. 8. The ordinate represents $P_{emp}(C27|C_{i-1})$ and $P_{nrm}(C27|C_{i-1})$, and the abscissa represents a code $C_{i-1}$=Ch=0, 1, . . . , 31); the bar graph at the right of each $C_{i-1}$ is $P_{emp}(C27|C_{i-1})$ and the right-hand bar graph is $P_{nrm}(C27|C_{i-1})$. In this example, the probabilities of transition from the code$_{i-1}$=C9 to the code $C_i$=C27 are as follows:

$$P_{emp}(C27|C9)=0.11009$$

$$P_{nrm}(C27|C9)=0.05293$$

From FIG. 8 it can be seen that the bigrams of the codes of the vector-quantized sets of speech parameters for the emphasized and normal states take different values and hence differ from each other since $P_{emp}(C27|C_{i-1})$ and $P_{nrm}(C27|C_{i-1})$ significantly differ for an arbitrary code $C_{i-1}$ and since the same is true for an arbitrary code $C_i$ in FIGS. 14 to 16, too. This guarantees that the bigram calculated based on the codebook provides different probabilities for the normal and the emphasized state.

Figure 9:
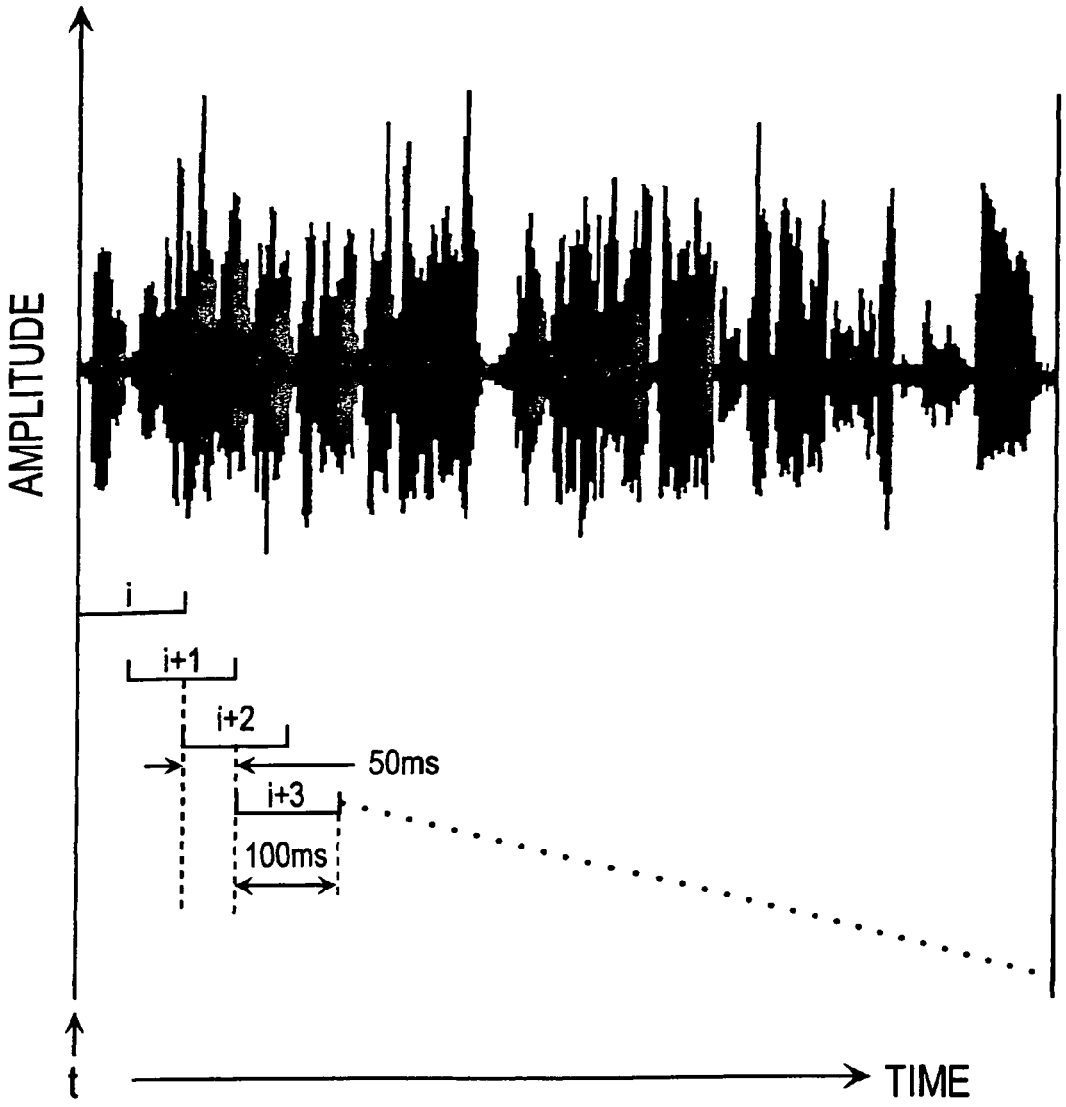
FIG. 9 is a graph for explaining an utterance likelihood calculation.

In step S302 in FIG. 4, the utterance likelihood for each of the normal and the emphasized state is calculated from the aforementioned probabilities stored in the codebook in correspondence to the codes of all the frames of the input speech sub-block. FIG. 9 is explanatory of the utterance likelihood calculation according to the present invention. In a speech sub-block starting at time t, first to fourth frames are designated by i to i+3. In this example, the frame length is 100 ms and the frame shift amount is 50 ms as referred to previously. The i-th frame has a waveform from time t to t+100, from which the code $C_1$ provided; the (i+1)-th frame has a waveform from time t+50 to t+150, from which the code $C_2$ is provided; the (i+2)-th frame has a waveform from time t+100 to t+200, from which the code $C_3$ is provided; and the (i+3)-th frame has a waveform from time t+150 to t+250, from which the code $C_4$ is provided. That is, when the codes are $C_1$, $C_2$, $C_3$, $C_4$ in the order of frames, trigrams can be calculated in frames whose frame numbers are i+2 and greater. Letting $P_{Semp}$ and $P_{Snrm}$ represent the probabilities of the speech sub-block S becoming emphasized and normal, respectively, the probabilities from the first to fourth frames are as follows:

$$P_{Semp}=P_{emp}(C_3|C_1C_2)P_{emp}(C_4|C_2C_3) \tag{11}$$

$$P_{Snrm}=P_{nrm}(C_3|C_1C_2)P_{nrm}(C_4|C_2C_3) \tag{12}$$

In this example, the independent appearance probabilities of the codes $C_3$ and $C_4$ in the emphasized and in the normal state, the conditional probabilities of the code $C_3$ becoming emphasized and normal after the code $C_2$, the conditional probabilities of the codes $C_3$ becoming emphasized or normal after immediately after two successive codes $C_1$ and $C_2$, and the conditional probabilities of the code $C_4$ becoming emphasized and normal immediately after the two successive codes $C_2$ and $C_3$, are obtained from the codebook as given by the following equations:

$$P_{emp}(C_3|C_1C_2)=\lambda_{emp1}P_{emp}(C_3|C_1C_2)+\lambda_{emp2}P_{emp}(C_3|C_2)+\lambda_{emp3}P_{emp}(C_3) \tag{13}$$

$$P_{emp}(C_4|C_2C_3)=\lambda_{emp1}P_{emp}(C_4|C_2C_3)+\lambda_{emp2}P_{emp}(C_4|C_3)+\lambda_{emp3}P_{emp}(C_4) \tag{14}$$

$$P_{nrm}(C_3|C_1C_2)=\lambda_{nrm1}P_{nrm}(C_3|C_1C_2)+\lambda_{nrm2}P_{nrm}(C_3|C_2)+\lambda_{nrm3}P_{nrm}(C_3) \tag{15}$$

$$P_{nrm}(C_4|C_2C_3)=\lambda_{nrm1}P_{nrm}(C_4|C_2C_3)+\lambda_{nrm2}P_{nrm}(C_4|C_3)+\lambda_{nrm3}P_{nrm}(C_4) \tag{16}$$

By using Eqs. (13) to (16), it is possible to calculate the possibilities $P_{Semp}$ and $P_{Snrm}$ of the speech sub-block becoming emphasized and normal in the first to the third frame. The possibilities $P_{emp}(C_3|C_1C_2)$ and $P_{nrm}(C_3|C_1C_2)$ can be calculated in the (i+2)-th frame.

The above has described the calculations for the first to the fourth frames, but in this example, when the codes obtained from respective frames of the speech sub-block S of $F_S$ frames are $C_1$, $C_2$, . . . , $C_{FS}$, the probabilities $P_{Semp}$ and $P_{Snrm}$ of the speech sub-block S becoming emphasized and normal are calculated by the following equations.

$$P_{Semp}=P_{emp}(C_3|C_1C_2)\ldots P_{emp}(C_{FS}|C_{FS-2}C_{FS-1}) \tag{17}$$

$$P_{Snrm}=P_{nrm}(C_3|C_1C_2)\ldots P_{nrm}(C_{FS}|C_{FS-2}C_{FS-1}) \tag{18}$$

If $P_{Semp}>P_{Snrm}$, then it is decided that the speech sub-block S is emphasized, whereas when $P_S(e)\leq P_S(n)$, it is decided that the speech sub-block S is normal.

The summarization of speech in step S4 in FIG. 1 is performed by joining together speech blocks each containing a speech sub-block decided as emphasized in step S302 in FIG. 4.

Experiments were conducted on the summarization of speech by this invention method for speech in an in-house conference by natural spoken language in conversations. In this example, the decision of the emphasized state and the extraction of the speech blocks to be summarized are performed under conditions different from those depicted in FIGS. 6 to 8.

In the experiments, the codebook size (the number of codes) was 256, the frame length was 50 ms, the frame shift amount was 50 ms, and the set of speech parameters forming each speech parameter vector stored in the codebook was [f0", Δf0"(1), Δf0"(−1), Δf0"(4), Δf0"(−4), p", Δp"(1), Δp"(−1), Δp"(4), Δp"(−4), $d_p$, Δ$d_p$(T), Δ$d_p$(−T)]. The experiment on the decision of utterance was conducted using speech parameters of voiced portions labeled by a test subject as emphasized and normal. For 707 voiced portions labeled as emphasized and 807 voiced portions labeled as normal which were used to produce the codebook, utterance of codes of all frames of each labeled portion was decided by use of Eqs. (9) and (10); this experiment was carried out as a speakers' closed testing.

On the other hand, for 173 voiced portions labeled as emphasized and 193 voiced portions labeled as normal which were not used for the production of the codebook, utterance of codes of all frames of each labeled voiced portion was decided by use of Eqs. (9) and (10); this experiment was performed as an speaker-independent testing. The speakers' closed testing is an experiment based on speech data which was used to produce the codebook, whereas the speaker-independent testing is an experiment based on speech data which was not used to produce the codebook.

The experimental results were evaluated in terms of a reappearance rate and a relevance rate. The reappearance rate mentioned herein is the rate of correct responses by the method of this embodiment to the set of correct responses set by the test subject. The relevance rate is the rate of correct responses to the number of utterances decided by the method of this embodiment.

Speakers' closed testing
Emphasized state:
Reappearance rate 89%
Relevance rate 90%
Normal state:
Reappearance rate 84%
Relevance rate 90%
Speaker-independent testing
Emphasized state:
Reappearance rate 88%
Relevance rate 90%
Normal state:
Reappearance rate 92%
Relevance rate 87%

In this case, $$\lambda_{emp1}=\lambda_{nrm1}=0.41$$

$$\lambda_{emp2}=\lambda_{nrm2}=0.41$$

$$\lambda_{emp3}=\lambda_{nrm3}=0.08$$

As referred to previously, when the number of reference frames preceding and succeeding the current frame is set to ±i (where i=4), the number of speech parameters is 29 and the number of their combinations is $\Sigma_{29}C_n$. The range $\Sigma$ is n=1 to 29, and ${}_{29}C_n$ is the number of combinations of n speech parameters selected from 29 speech parameters. Now, a description will be given of an embodiment that uses a codebook wherein there are prestored 18 kinds of speech parameter vectors each consisting of a combination of speech parameters. The frame length is 100 ms and the frame shift amount is 50 ms. FIG. 17 shows the numbers 1 to 18 of the combinations of speech parameters.

The experiment on the decision of utterance was conducted using speech parameters of voiced portions labeled by a test subject as emphasized and normal. In the speakers' closed testing, utterance was decided for 613 voiced portions labeled as emphasized and 803 voiced portions labeled as normal which were used to produce the codebook. In the speaker-independent testing, utterance was decided for 171 voiced portions labeled as emphasized and 193 voiced portions labeled as normal which were not used to produce the codebook. The codebook size is 128 and $$\lambda_{emp1}=\lambda_{nrm1}=0.41$$

$$\lambda_{emp2}=\lambda_{nrm2}=0.41$$

$$\lambda_{emp3}=\lambda_{nrm3}=0.08$$

Figure 10:
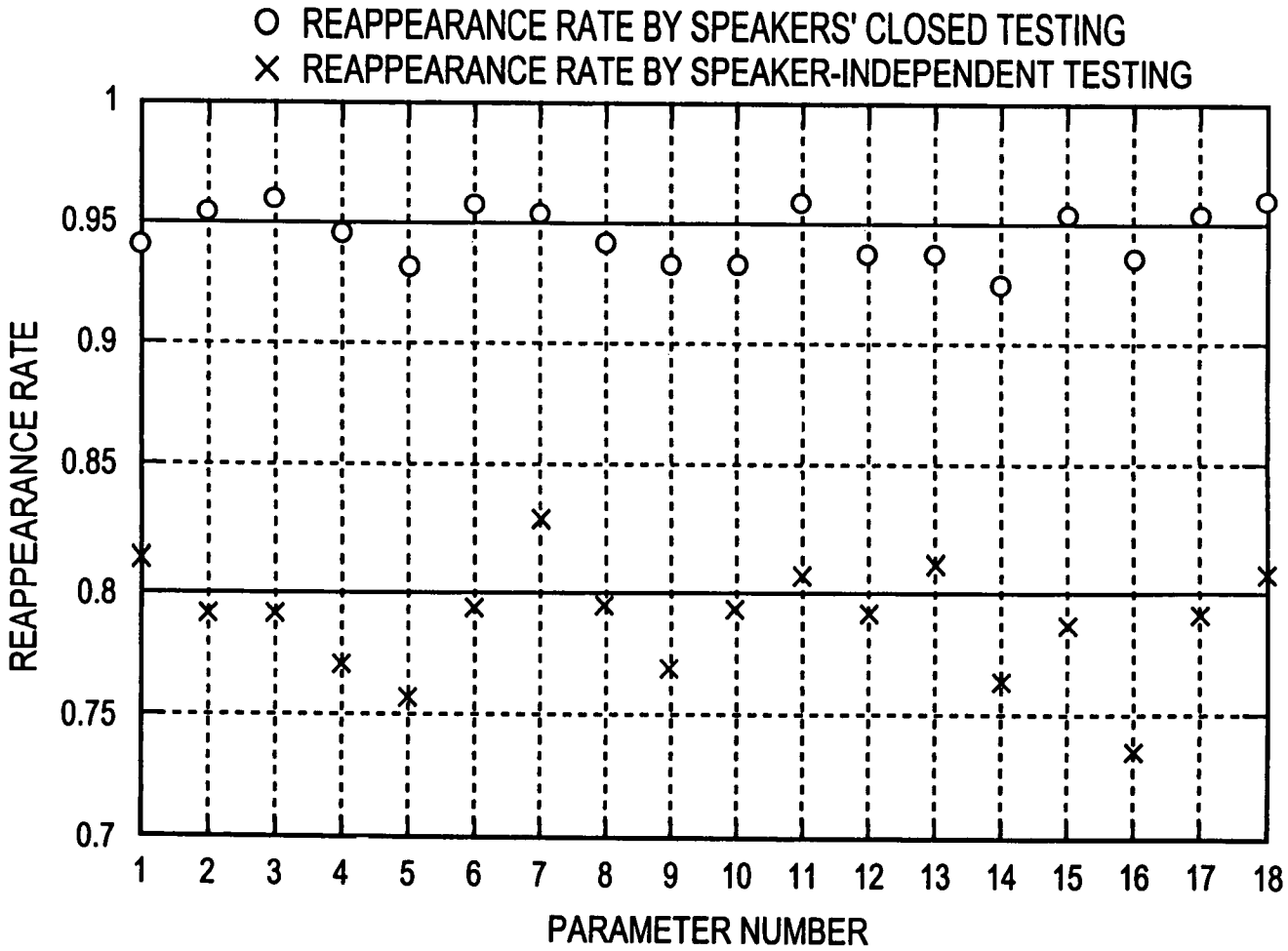
FIG. 10 is a graph showing reappearance rates in speakers' closed testing and speaker-independent testing using 18 combinations of parameter vectors.

FIG. 10 shows the reappearance rate in the speakers' closed testing and the speaker-independent testing conducted using 18 sets of speech parameters. The ordinate represents the reappearance rate and the abscissa the number of the combinations of speech parameters. The white circles and crosses indicate results of the speakers' closed testing and speaker-independent testing, respectively. The average and variance of the reappearance rate are as follows:

Speakers' closed testing: Average 0.9546, Variance 0.00013507

Speaker-independent testing: Average 0.78788, Variance 0.00046283

In FIG. 10 the solid lines indicate reappearance rates 0.95 and 0.8 corresponding to the speakers' closed testing and speaker-independent testing, respectively. Any combinations of speech parameters, for example, Nos. 7, 11 and 18, can be used to achieve reappearance rates above 0.95 in the speakers' closed testing and above 0.8 in the speaker-independent testing. Each of these three combinations includes a temporal variation of dynamic measure $d_p$, suggesting that the temporal variation of dynamic measure $d_p$ is one of the most important speech parameters. Each of the combinations No. 7 and No. 11 is characteristically including a fundamental frequency, a power, a temporal variation of dynamic measure, and their inter-frame differences. Although the reappearance rate of the combination No. 17 was slightly lower than 0.8, the combination No. 17 needs only three parameters and therefore requires less mount of processing. Hence, it can be seen that a suitable selection of the combination of speech parameters permits realization of a reappearance rate above 0.8 in the utterance decision for voiced portions labeled by a test subject as emphasized for the aforementioned reasons (a) to (i) and voiced portions labeled by the test subject as normal for the reasons that the aforementioned conditions (a) to (i) are not met. This indicates that the codebook used is correctly produced.

Figure 11:
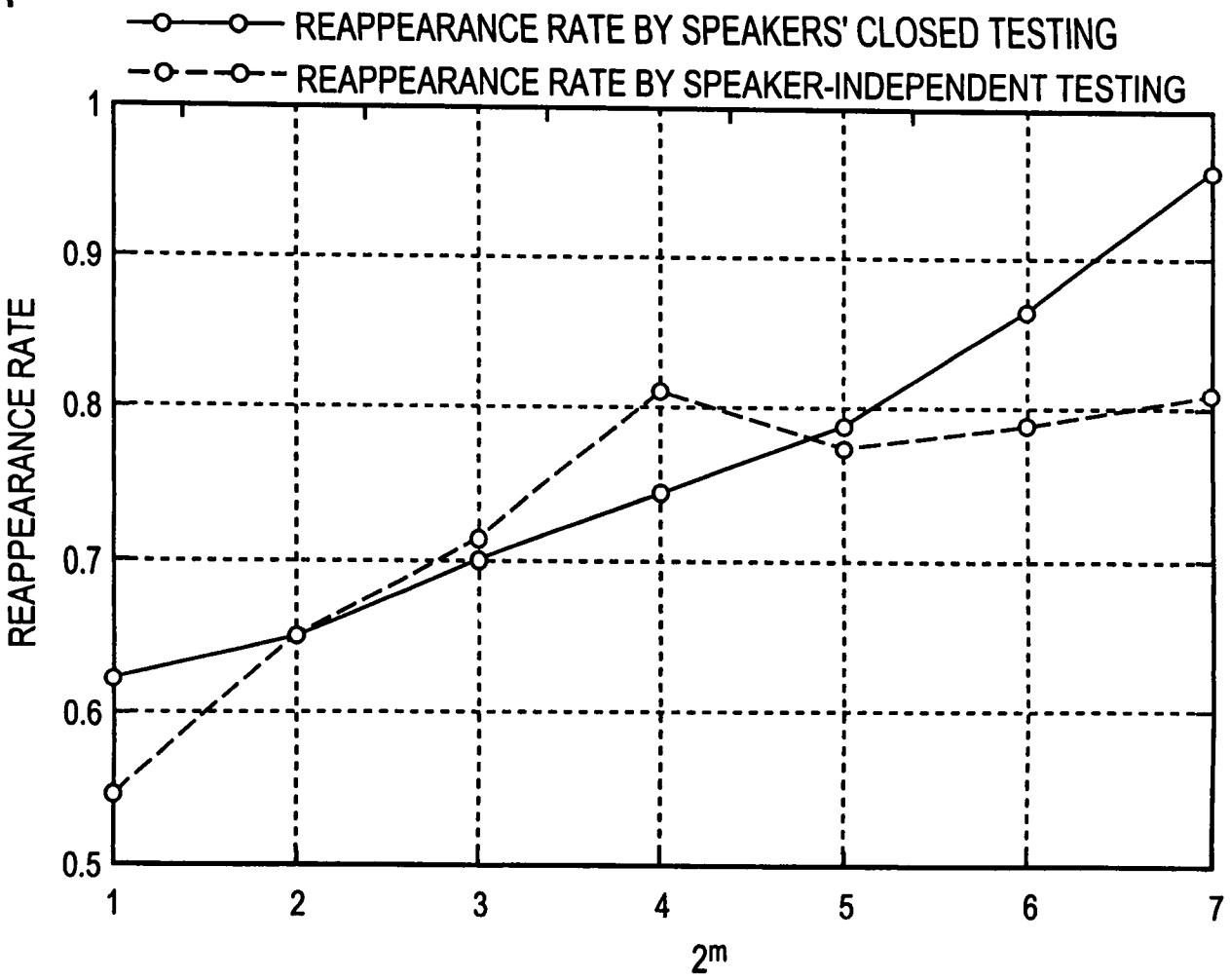
FIG. 11 is a graph showing reappearance rates in speakers' closed testing and speaker-independent testing conducted with various codebook sizes.

Next, a description will be given of experiments on the codebook size dependence of the No. 18 combination of speech parameters in FIG. 17. In FIG. 11 there are shown reappearance rates in the speakers' closed testing and speaker-independent testing obtained with codebook sizes 2, 4, 8, 16, 32, 64, 128 and 156. The ordinate represents the reappearance rate and the abscissa represents n in $2^n$. The solid line indicates the speakers' closed testing and the broken line the speaker-independent testing. In this case, $$\lambda_{emp1}=\lambda_{nrm1}=0.41$$

$$\lambda_{emp2}=\lambda_{nrm2}=0.41$$

$$\lambda_{emp3}=\lambda_{nrm3}=0.08$$

From FIG. 11 it can be seen that an increase in the codebook size increases the reappearance rate—this means that the reappearance rate, for example, above 0.8, could be achieved by a suitable selection of the codebook size (the number of codes stored in the codebook). Even with the codebook size of 2, the reappearance rate is above 0.5. This is considered to be because of the use of conditional probability. According to the present invention, in the case of producing the codebook by vector-quantizing the set of speech parameter vectors of the emphasized state and the normal state classified by the test subject based on the aforementioned conditions (a) to (i), the emphasized-state and normal-state appearance probabilities of an arbitrary code become statistically separate from each other; hence, it can be seen that the state of utterance can be decided.

Speech in a one-hour in-house conference by natural spoken language in conversations was summarized by this invention method. The summarized speech was composed of 23 speech blocks, and the time of summarized speech was 11% of the original speech. To evaluate the speech blocks, a test subject listened to 23 speech blocks and decided that 83% was understandable. To evaluate the summarized speech, the test subject listened to the summarized speech, then the minutes based on it and the original speech for comparison. The reappearance rate was 86% and the detection rate 83%. This means that the speech summarization method according to the present invention enables speech summarization of natural spoken language and conversation.

A description will be given of a modification of the method for deciding the emphasized state of speech according to the present invention. In this case, too, speech parameters are calculated for each frame of the input speech signal as in step S1 in FIG. 1, and as described previously in connection with FIG. 4, a set of speech parameter vector for each frame of the input speech signal is vector-quantized (vector-coded) using, for instance, the codebook shown in FIG. 12. The emphasized-state and normal-state appearance probabilities of the code, obtained by the vector-quantization, are obtained using the appearance probabilities stored in the codebook in correspondence to the code. In this instance, however, the appearance probability of the code of each frame is obtained as a probability conditional to being accompanied by a sequence of codes of two successive frames immediately preceding the current frame, and the utterance is decided as to whether it is emphasized or not. That is, in step S303 in FIG. 4, when the set of speech parameters is vector-coded as depicted in FIG. 9, the emphasized-state and normal-state probabilities in the (I+2)-th frame are calculated as follows:

$$P_e(i+2)=P_{emp}(C_3|C_1C_2)$$

$$P_n(i+2)=P_{nrm}(C_3|C_1C_2)$$

In this instance, too, it is preferable to calculate $P_{emp}(C_3|C_2C_3)$ by Eq. (13) and $P_{nrm}(C_3|C_2C_3)$ by Eq. (15). A comparison is made between the values $P_e(i+2)$ and $P_n(i+2)$ thus calculated, and if the former is larger than the latter, it is decided that the (i+2)-th frame is emphasized, and if not so, it is decided that the frame is not emphasized.

For the next (i+3)-th frame the following likelihood calculations are conducted.

$$P_e(i+3)=P_{emp}(C_4|C_2C_3)$$

$$P_n(i+3)=P_{nrm}(C_4|C_2C_3)$$

If $P_e(i+3)>P_n(i+3)$, then it is decided that this frame is emphasized. Similarly, the subsequent frames are sequentially decided as to whether they are emphasized or not.

The product $\Pi P_e$ of conditional appearance probabilities $P_e$ of those frames throughout the speech sub-block decided as emphasized and the product $\Pi P_n$ of conditional appearance probabilities $P_n$ of those frames throughout the speech sub-block decided as normal are calculated. If $\Pi P_e>\Pi P_n$, then it is decided that the speech sub-block is emphasized, whereas when $\Pi P_e\leq\Pi P_n$, it is decided that the speech sub-block is normal. Alternatively, the total sum, $\Sigma P_e$, of the conditional appearance probabilities $P_e$ of the frames decided as emphasized throughout the speech sub-block and the total sum, $\Sigma P_n$, of the conditional appearance probabilities $P_e$ of the frames decided as normal throughout the speech sub-block are calculated. When $\Sigma P_e>\Sigma P_n$, it is decided that the speech sub-block is emphasized, whereas when $\Sigma P_e<\Sigma P_n$, it is decided that the speech sub-block is normal. Also it is possible to decide the state of utterance of the speech sub-block by making a weighted comparison between the total products or total sums of the conditional appearance probabilities.

In this emphasized state deciding method, too, the speech parameters are the same as those used in the method described previously, and the appearance probability may an independent appearance probability or its combination with the conditional appearance probability; in the case of using this combination of appearance probabilities, it is preferable to employ a linear interpolation scheme for the calculation of the conditional appearance probability. Further, in this emphasized state deciding method, too, it is desirable that speech parameters each be normalized by the average value of the corresponding speech parameters of the speech sub-block or suitably longer portion or the entire speech signal to obtain a set of speech parameters of each frame for use in the processing subsequent to the vector quantization in step S301 in FIG. 4. In either of the emphasized state deciding method and the speech summarization method, it is preferable to use a set of speech parameters including at least one of f0", $p_0$", Δf0" (i), Δf0" (−i), Δp" (i), Δp" (−i), $d_p$, $\Delta d_p(T)$, and $\Delta d_p(-T)$.

A description will be given, with reference to FIG. 13, of the emphasized state deciding apparatus and the emphasized speech summarizing apparatus according to the present invention.

Input to an input part 11 is speech (an input speech signal) to be decided about the state of utterance or to be summarized. The input part 1 is also equipped with a function for converting the input speech signal to digital form as required. The digitized speech signal is once stored in a storage part 12. In a speech parameter analyzing part 13 the aforementioned set of speech parameters are calculated for each frame. The calculated speech parameters are each normalized, if necessary, by an average value of the speech parameters, and in a quantizing part 14 a set of speech parameters for each frame is quantized by reference to a codebook 15 to output a code, which is provided to an emphasized state probability calculating part 16 and a normal state probability calculating part 17. The codebook 15 is such, for example, as depicted in FIG. 12.

In the emphasized state probability calculating part 16 the emphasized-state appearance probability of the code of the quantized set of speech parameters is calculated, for example, by Eq. (13) or (14) through use of the probability of the corresponding speech parameter vector stored in the codebook 15. Similarly, in the normal state probability calculating part 17 the normal-state appearance probability of the code of the quantized set of speech parameters is calculated, for example, by Eq. (15) or (16) through use of the probability of the corresponding speech parameter vector stored in the codebook 15. The emphasized and normal state appearance probabilities calculated for each frame in the emphasized and normal state probability calculating parts 16 and 17 and the code of each frame are stored in the storage part 12 together with the frame number. An emphasized state deciding part 18 compares the emphasized state appearance probability with the normal state appearance probability, and it decides whether speech of the frame is emphasized or not, depending on whether the former is higher than the latter.

The abovementioned parts are sequentially controlled by a control part 19.

Figure 13:
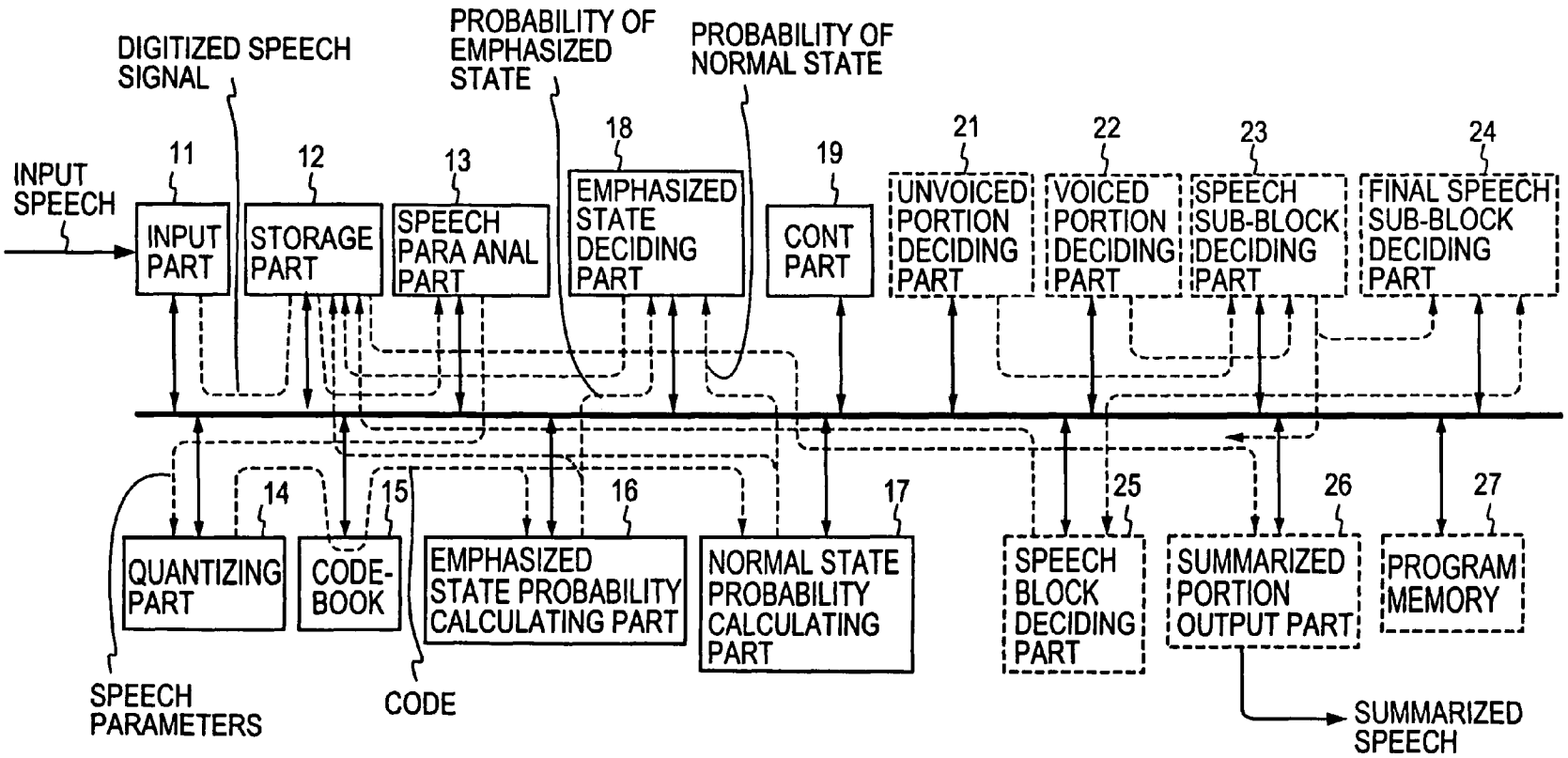
FIG. 13 is a block diagram illustrating examples of functional configurations of apparatuses for deciding emphasized speech and for extracting emphasized speech according to the present invention.

The speech summarizing apparatus is implemented by connecting the broken-line blocks to the emphasized state deciding apparatus indicated by the solid-line blocks in FIG. 13. That is, the speech parameters of each frame stored in the storage part 12 are fed to an unvoiced portion deciding part 21 and a voiced portion deciding part 22. The unvoiced portion deciding part 21 decides whether each frame is an unvoiced portion or not, whereas the voiced portion deciding part 22 decides whether each frame is a voiced portion or not. The results of decision by the deciding parts 21 and 22 are input to a speech sub-block deciding part 23.

Based on the results of decision about the unvoiced portion and the voiced portion, the speech sub-block deciding part 23 decides that a portion including a voiced portion preceded and succeeded by unvoiced portions each defined by more than a predetermined number of successive frames is a speech sub-block as described previously. The result of decision by the speech sub-block deciding part 23 is input to the storage part 12, wherein it is added to the speech data sequence and a speech sub-block number is assigned to a frame group enclosed with the unvoiced portions. At the same time, the result of decision by the speech sub-block deciding part 23 is input to a final speech sub-block deciding part 24.

In the final speech sub-block deciding part 23 a final speech sub-block is detected using, for example, the method described previously in respect of FIG. 3, and the result of decision by the deciding part 23 is input to a speech block deciding part 25, wherein a portion from the speech sub-block immediately succeeding each detected final speech sub-block to the end of the next detected final speech sub-block is decided as a speech block. The result of decision by the deciding part 25 is also written in the storage part 12, wherein the speech block number is assigned to the speech sub-block number sequence.

During operation of the speech summarizing apparatus, in the emphasized state probability calculating part 16 and the normal state probability calculating part 17 the emphasized and normal state appearance probabilities of each frame forming each speech sub-block are read out from the storage part 12 and the respective probabilities for each speech sub-block are calculated, for example, by Eqs. (17) and (18). The emphasized state deciding part 18 makes a comparison between the respective probabilities calculated for each speech sub-block, and decides whether the speech sub-block is emphasized or normal. When even one of the speech sub-blocks in the speech block is decided as emphasized, a summarized portion output part 26 outputs the speech block as a summarized portion. These parts are placed under control of the control part 19.

Either of the emphasized state deciding apparatus and the speech summarizing apparatus is implemented by executing a program on a computer. In this instance, the control part 19 formed by a CPU or microprocessor downloads an emphasized state deciding program or speech summarizing program to a program memory 27 via a communication line or from a CD-ROM or magnetic disk, and executes the program. Incidentally, the contents of the codebook may also be downloaded via the communication line as is the case with the abovementioned program.

Embodiment 2

With the emphasized state deciding method and the speech summarizing method according to the first embodiment, every speech block is decided to be summarized even when it includes only one speech sub-block whose emphasized state probability is higher than the normal state probability—this prohibits the possibility of speech summarization at an arbitrary rate (compression rate). This embodiment is directed to a speech processing method, apparatus and program that permit automatic speech summarization at a desired rate.

Figure 18:
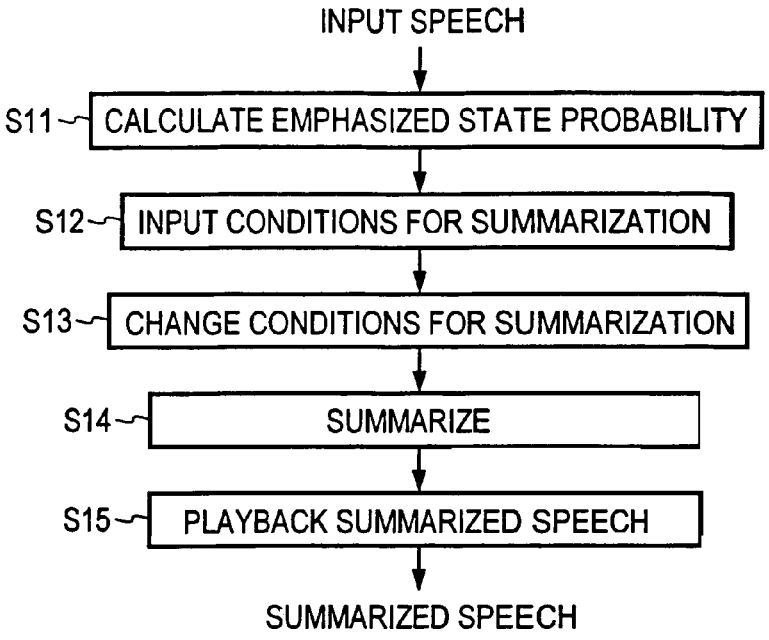
FIG. 18 is a flowchart for explaining a speech summarizing method according to a second embodiment of the present invention.

FIG. 18 shows the basic procedure of the speech processing method according to the present invention.

The procedure starts with step S11 to calculate the emphasized and normal state probabilities of a speech sub-block.

Step S12 is a step wherein to input conditions for summarization. In this step, information is presented, for example, to a user which urges him to input at least predetermined one of the time length of an ultimate summary and the summarization rate and compression rate. In this case, the user may also input his desired one of a plurality of preset values of the time length of the ultimate summary, the summarization rate, and the compression rate.

Step S13 is a step wherein to repeatedly change the condition for summarization to set the time length of the ultimate summary or summarization rate, or compression rate input in step S12.

Step S14 is a step wherein to determine the speech blocks targeted for summarization by use of the condition set in step S13 and calculate the gross time of the speech blocks targeted for summarization, that is, the time length of the speech blocks to be summarized.

Step S15 is a step for playing back a sequence of speech blocks determined in step S14.

Figure 19:
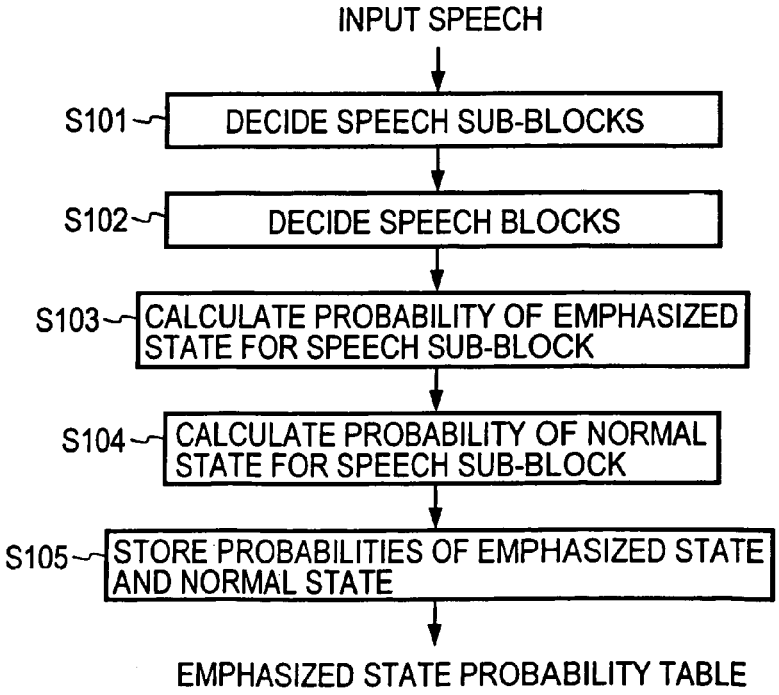
FIG. 19 is a flowchart showing a method for preparing an emphasized state probability table.

FIG. 19 shows in detail step S11 in FIG. 18.

In step S101 the speech waveform sequence for summarization is divided into speech sub-blocks.

In step S102 a speech block is separated from the sequence of speech sub-blocks divided in step S101. As described previously with reference to FIG. 3, the speech block is a speech unit which is formed by one or more speech sub-blocks and whose meaning can be understood by a large majority of listeners when speech of that portion is played back. The speech sub-blocks and speech block in steps S101 and S102 can be determined by the same method as described previously in respect of FIG. 2.

In steps S103 and S104, for each speech sub-block determined in step S101, its emphasized state probability $P_{Semp}$ and normal state probability $P_{Snrm}$ are calculated using the codebook described previously with reference to FIG. 18 and the aforementioned Eqs. (17) and (18).

In step S105 the emphasized and normal state probabilities $P_{Semp}$ and $P_{Snrm}$ calculated for respective speech sub-blocks in FIGS. S103 and S104 are sorted for each speech sub-block and stored as an emphasized state probability table in storage means.

Figure 20:
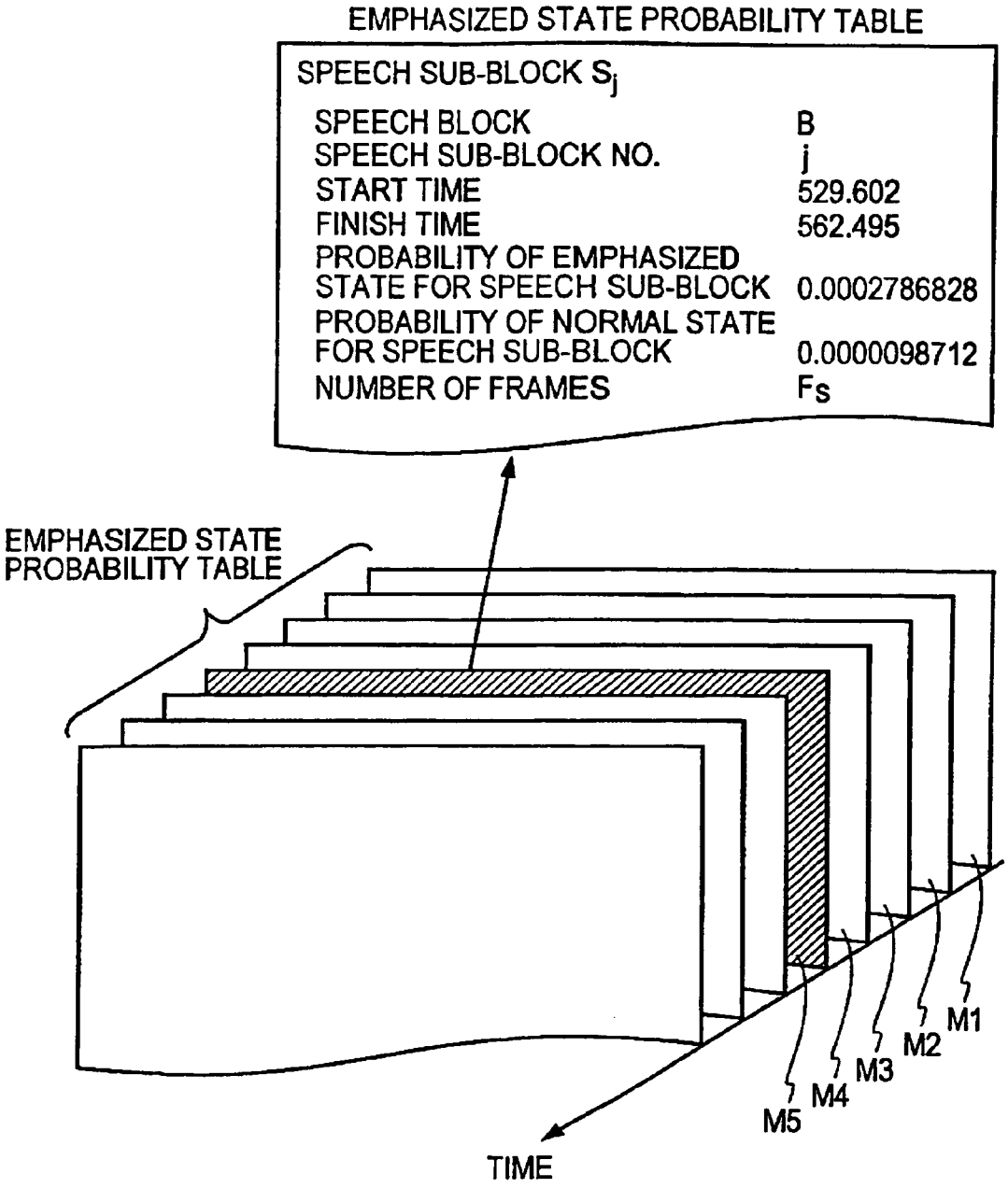
FIG. 20 is a diagram for explaining the emphasized state probability table.

FIG. 20 shows an example of the emphasized state probability table stored in the storage means. Reference characters M1, M2, M3, . . . denote speech sub-block probability storage parts each having stored therein the speech sub-block emphasized and normal state probabilities $P_{Semp}$ and $P_{Snrm}$ calculated for each speech sub-block. In each of the speech sub-block probability storage parts M1, M2, M3, . . . there are stored the speech sub-block number j assigned to each speech sub-block $S_j$, speech block number B to which the speech sub-block belongs, its starting time (time counted from the beginning of target speech to be summarized) and finishing time, its emphasized and normal state probabilities and the number of frame $F_S$ forming the speech sub-block.

The condition for summarization, which is input in step S12 in FIG. 18, is the summarization rate X (where X is a positive integer) indicating the time 1/X to which the total length of the speech content to be summarized is reduced, or the time $T_S$ of the summarized portion.

In step S13 a weighting coefficient W is set to 1 as an initial value for the condition for summarization input in step S12. The weighting coefficient is input in step S14.

In step S14 the emphasized and normal state probabilities $P_{Semp}$ and $P_{Snrm}$ stored for each speech sub-block in the emphasized state probability table are read out for comparison between them to determine speech sub-blocks bearing the following relationship $$P_{Semp} > P_{Snrm} \tag{19}$$

And speech blocks are determined which include even one such determined speech sub-block, followed by calculating the gross time $T_G$ (minutes) of the determined speech blocks.

Then a comparison is made between the gross time $T_G$ of a sequence of such determined speech blocks and the time of summary $T_S$ preset as the condition for summarization. If $T_G \approx T_S$ (if an error of TG with respect to $T_S$ is in the range of plus or minus several percentage or so, for instance), the speech block sequence is played back as summarized speech.

If the error value of the gross time $T_G$ of the summarized content with respect to the preset time $T_S$ is larger than a predetermined value and if they bear such relationship that $T_G > T_S$, then it is decided that the gross time TG of the speech block sequence is longer than the preset time $T_S$, and Step S18 in FIG. 18 is performed again. In step S18, when it is decided that the gross time $T_G$ of the sequence of speech blocks detected with the weighting coefficient W=1 is "longer" than the preset time $T_S$, the emphasized state probability $P_{Semp}$ is multiplied by a weighting coefficient W smaller than the current value. The weighting coefficient W is calculated by, for example, W=1−0.001×L (where L is the number of loops of processing).

That is, in the first loop of processing the emphasized state probabilities $P_{Semp}$ calculated for all speech sub-blocks of the speech block read out of the emphasized state probability table are weighted through multiplication by the weighting coefficient W=0.999 that is determined by W=1−0.001×1. The thus weighted emphasized state probability $P_{Semp}$ of every speech sub-block is compared with the normal state probability $P_{Snrm}$ of every speech sub-block to determine speech sub-blocks bearing a relationship $WP_{Semp}>WP_{Snrm}$.

In step S14 speech blocks including the speech sub-blocks determined as mentioned above are decided to obtain again a sequence of speech blocks to be summarized. At the same time, the gross time $T_G$ of this speech block sequence is calculated for comparison with the preset time $T_S$. If $T_G>T_S$, then the speech block sequence is decided as the speech to be summarized, and is played back.

When the result of the first weighting process is still $T_G>T_S$, the step of changing the condition for summarization is performed as a second loop of processing. At this time, the weighting coefficient is calculated by W=1−0.001×2. Every emphasized state probability $P_{Semp}$ is weighted with W=0.998.

By changing the condition for summarization to decrease the value of weighting coefficient W on a step-by-step basis upon each execution of the loop as described above, it is possible to gradually reduce the number of speech sub-blocks that meet the condition $WP_{Semp}>WP_{Snrm}$. This permits detection of the state $T_G \approx T_S$ that satisfies the condition for summarization.

When it is decided in the initial state that $T_G<T_S$, the weighting coefficient W is calculated to be smaller than the current value, for example, W=1−0.001×L, and a sequence of normal state probabilities $P_{Snrm}$ is weighted through multiplication by this weighting coefficient W. Also, the emphasized state probability $P_{Semp}$ may be multiplied by W=1+0.001×L. Either scheme is equivalent to extracting the speech sub-block that satisfies the condition that the probability ratio becomes $P_{Semp}/P_{Snrm}>1/W=W'$. Accordingly, in this case, the probability ratio $P_{Semp}/P_{Snrm}$ is compared with the reference value W' to decide the utterance of the speech sub-block, and the emphasized state extracting condition is changed with the reference value W' which is decreased or increased depending on whether the gross time $T_G$ of the portion to be summarized is longer or shorter than the set time length $T_S$. Alternatively, when it is decided in the initial state that $T_G>T_S$, the weighting coefficient is set to W=1+0.001×L, a value larger than the current value, and the sequence of normal state probabilities $P_{Snrm}$ by this weighting coefficient W.

While in the above the condition for convergence of the time $T_G$ has been described to be $T_G \approx T_S$, it is also possible to strictly converge the time $T_G$ such that $T_G=T_S$. For example, when 5 sec is short of the preset condition for summarization, an addition of one more speech block will cause an overrun of 10 sec; but playback for only 5 sec after the speech block makes it possible to bring the time $T_G$ into agreement with the user's preset condition. And, this 5-sec playback may be done near the speech sub-block decided as emphasized or at the beginning of the speech block.

Further, the speech block sequence summarized in step S14 has been described above to be played back in step S15, but in the case of audio data with speech, pieces of audio data corresponding to the speech blocks determined as the speech to be summarized are joined together and played back along with the speech—this permits summarization of the content of a TV program, movie, or the like.

Moreover, in the above either one of the emphasized state probability and the normal state probability calculated for each speech sub-block, stored in the emphasized probability table, is weighted through direct multiplication by the weighting coefficient W, but for detecting the emphasized state with higher accuracy, it is preferable that the weighting coefficient W for weighting the probability be raised to the F-th power where F is the number of frames forming each speech sub-block. The conditional emphasized state probability $P_{Semp}$, which is calculated by Eqs. (17) and (18), is obtained by multiplying the emphasized state probability calculated for each frame throughout the speech sub-block. The normal state probability $P_{Snrm}$ is also obtained by multiplying the normal state probability calculated for each frame throughout the speech sub-block. Accordingly, for example, the emphasized state probability $P_{Semp}$ is assigned a weight $W^F$ by multiplying the emphasized state probability for each frame throughout the speech sub-block after weighting it with the coefficient W.

As a result, for example, when W>1, the influence of weighting grows or diminishes according to the number F of frames. The larger the number of frames F, that is, the longer the duration, the heavier the speech sub-block is weighted.

In the case of changing the condition for extraction so as to merely decide he emphasized state, the product of the emphasized state probabilities or normal state probabilities calculated for respective speech sub-block needs only to be multiplied by the weighting coefficient W. Accordingly, the weighting coefficient W need not necessarily be raised to F-th power.

Furthermore, the above example has been described to change the condition for summarization by the method in which the emphasized or normal state probability $P_{Semp}$ or $P_{Snrm}$ calculated for each speech sub-block is weighted to change the number of speech sub-blocks that meet the condition $P_{Semp}>P_{Snrm}$. Alternatively, probability ratios $P_{Semp}/P_{Snrm}$ are calculated for the emphasized and normal state probabilities $P_{Semp}$ and $P_{Snrm}$ of all the speech sub-blocks; the speech blocks including the speech sub-blocks are each accumulated only once in descending order of probability ratio; the accumulated sum of durations of the speech blocks is calculated; and when the calculated sum, that is, the time of the summary, is about the same as the predetermined time of summary, the sequence of accumulated speech blocks in temporal order is decided to be summarized, and the speech blocks are assembled into summarized speech.

In this instance, when the gross time of the summarized speech is shorter or longer than the preset time of summary, the condition for summarization can be changed by changing the decision threshold value for the probability ratio $P_{Semp}/P_{Snrm}$ which is used for determination about the emphasized state. That is, an increase in the decision threshold value decreases the number of speech sub-blocks to be decided as emphasized and consequently the number of speech blocks to be detected as portions to be summarized, permitting reduction of the gross time of summary. By decreasing the threshold value, the gross time of summary can be increased. This method permits simplification of the processing for providing the summarized speech that meets the preset condition for summarization.

While in the above the emphasized state probability $P_{Semp}$ and the normal state probability $P_{Snrm}$, which are calculated for each speech sub-block, are calculated as the products of the emphasized and normal state probabilities calculated for the respective frames, the emphasized and normal state probabilities $P_{Semp}$ and $P_{Snrm}$ of each speech sub-block can also be obtained by calculating emphasized state probabilities for the respective frames and averaging those probabilities in the speech sub-block. Accordingly, in the case of employing this method for calculating the emphasized and normal state probabilities $P_{Semp}$ and $P_{Snrm}$, it is necessary only to multiply them by the weighting coefficient W.

Figure 21:
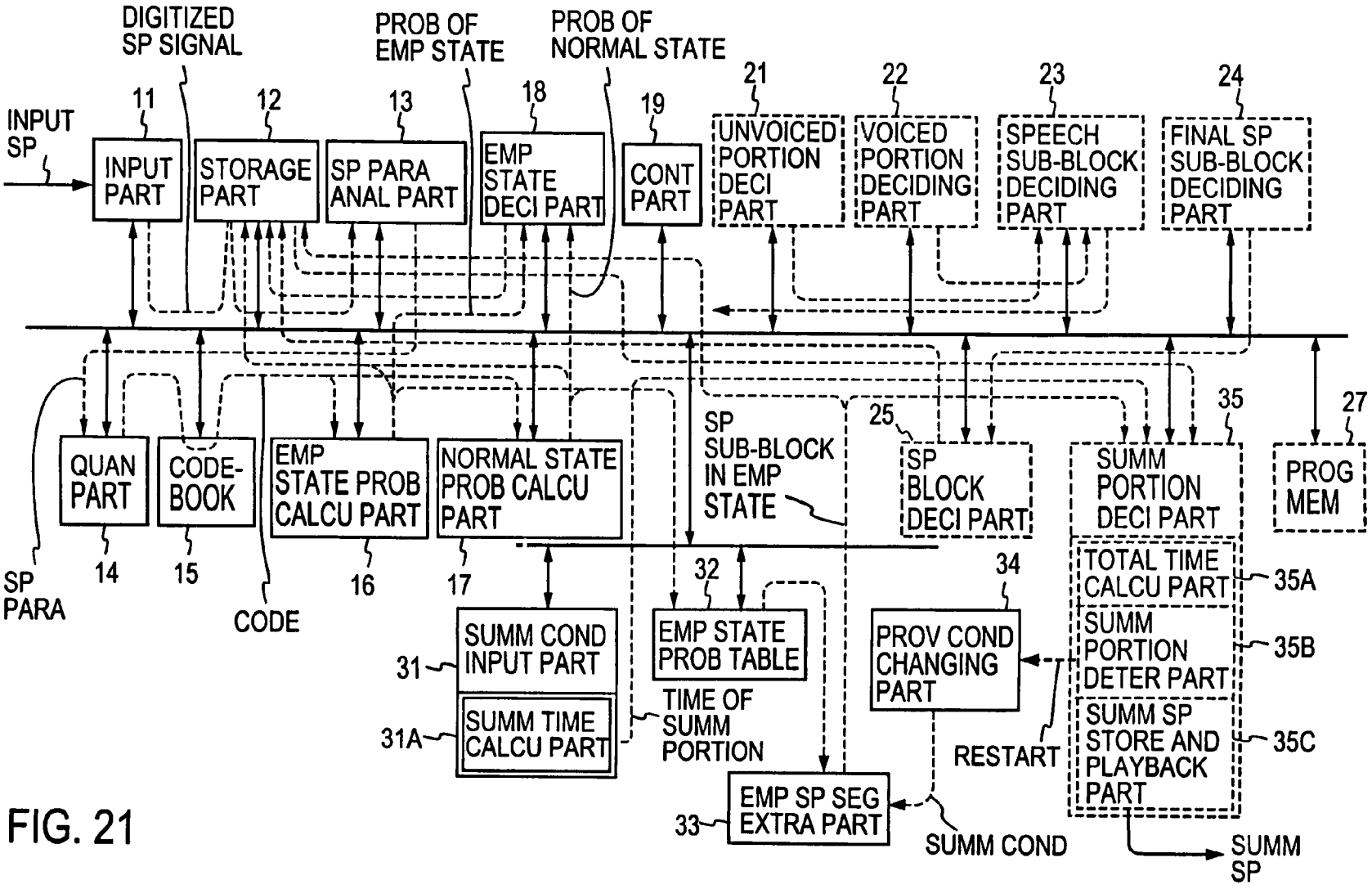
FIG. 21 is a block diagram illustrating examples of functional configurations of apparatuses for deciding emphasized speech and for extracting emphasized speech according to the second embodiment of the present invention.

Referring next to FIG. 21, a description will be given of a speech processing apparatus that permits free setting of the summarization rate according to Embodiment 2 of the present invention. The speech processing apparatus of this embodiment comprises, in combination with the configuration of the emphasized speech extracting apparatus of FIG. 13: a summarizing condition input part 31 provided with a time-of-summarized-portion calculating part 31A; an emphasized state probability table 32; an emphasized speech sub-block extracting part 33; a summarizing condition changing part 34; and a provisional summarized portion decision part 35 composed of a gross time calculating part 35A for calculating the gross time of summarized speech, a summarized portion deciding part 35B for deciding whether an error of the gross time of summarized speech calculated by the gross time calculating part 35A, with respect to the time of summary input by a user in the summarizing condition input part 31, is within a predetermined range, and a summarized speech store and playback part 35C for storing and playing back summarized speech that matches the summarizing condition.

As referred to previously in respect of FIG. 13, speech parameters are calculated from input speech for each frame, then these speech parameters are used to calculate emphasized ad normal state probabilities for each frame in the emphasized and normal state probability calculating parts 16 and 17, and the emphasized and normal state probabilities are stored in the storage part 12 together with the frame number assigned to each frame. Further, the frame number is accompanied with the speech sub-block number j assigned to the speech sub-block $S_j$ determined in the speech sub-block deciding part, a speech block number B to which the speech sub-block $S_j$ belongs and each frame and each speech sub-block are assigned an address.

In the speech processing apparatus according to this embodiment, the emphasized state probability calculating part 16 and the normal state probability calculating part 17 read out of the storage part 12 the emphasized state probability and normal state probability stored therein for each frame, then calculate the emphasized state probability $P_{Semp}$ and the normal state probability $P_{Snrm}$ for each speech sub-block from the read-out emphasized and normal state probabilities, respectively, and store the calculated emphasized and normal state probabilities $P_{Semp}$ and $P_{Snrm}$ in the emphasized state probability table 32.

In the emphasized state probability table 32 there are stored emphasized and normal state probabilities calculated for each speech sub-block of speech waveforms of various contents so that speech summarization can be performed at any time in response to a user's request. The user inputs the conditions for summarization to the summarizing condition input part 31. The conditions for summarization mentioned herein refer to the rate of summarization of the content to its entire time length desired to summarize. The summarization rate may be one that reduces the content to 1/10 in terms of length or time. For example, when the 1/10-summarization rate is input, the time-of-summarized portion calculating part 31A calculates a value 1/10 the entire time length of the content, and provides the calculated time of summarized portion to the summarized portion deciding part 35B of the provisional summarized portion determining part 35.

Upon inputting the conditions for summarization to the summarizing condition input part 31, the control part 19 starts the speech summarizing operation. The operation begins with reading out the emphasized and normal state probabilities from the emphasized state probability table 32 for the user's desired content. The read-out emphasized and normal state probabilities are provided to the emphasized speech sub-block extracting part 33 to extract the numbers of the speech sub-blocks decided as being emphasized.

The condition for extracting emphasized speech sub-blocks can be changed by a method that changes the weighting coefficient W relative to the emphasized state probability $P_{Semp}$ and the normal state probability $P_{Snrm}$, then extracts speech sub-blocks bearing the relationship $WP_{Semp}>P_{Snrm}$, and obtains summarized speech composed of speech blocks including the speech sub-blocks. Alternatively, it is possible to a method that calculates weighted probability ratios $WP_{Semp}/P_{Snrm}$ then changes the weighting coefficient, and accumulates the speech blocks each including the emphasized speech sub-block in descending order of the weighted probability ratio to obtain the time length of summarized portion.

In the case of changing the condition for extracting the speech sub-blocks by the weighting scheme, the initial value of the weighting coefficient W may also be set to W=1. Also in the case of deciding each speech sub-block as being emphasized in accordance with the value of the ratio $P_{Semp}/P_{Snrm}$ between the emphasized and normal state probabilities calculated for each speech sub-block, it is feasible to decide the speech sub-block as being emphasized when the initial value of the probability ratio is, for example, $P_{Semp}/P_{Snrm}\geq 1$.

Data, which represents the number, starting time and finishing time of each speech sub-block decided as being emphasized in the initial state, is provided from the emphasized speech sub-block extracting part 33 to the provisional summarized portion deciding part 35. In the provisional summarized portion deciding part 35 the speech blocks including the speech sub-blocks decided as emphasized are retrieved and extracted from the speech block sequence stored in the storage part 12. The gross time of the thus extracted speech block sequence is calculated in the gross time calculating part 35A, and the calculated gross time and the time of summarized portion input as the condition for summarization are compared in the summarized portion deciding part 35B. The decision as to whether the result of comparison meets the condition for summarization may be made, for instance, by deciding whether the gross time of summarized portion $T_G$ and the input time of summarized portion $T_S$ satisfy $|T_G-T_S|\leq\Delta T$, where $\Delta T$ is a predetermined allowable error, or whether they satisfy $0<|T_G-T_S|<\delta$, where $\delta$ is a positive value smaller than a predetermined value 1. If the result of comparison meets the condition for summarization, then the speech block sequence is stored and played back in the summarized portion store and playback part 36C. For the playback operation, the speech block is extracted based on the number of the speech sub-block decided as being emphasized in the speech sub-block extracting part 33, and by designating the starting time and finishing time of the extracted speech block, audio or video data of each content is read out and sent out as summarized speech or summarized video data.

When the summarized portion deciding part 35B decides that the condition for summarization is not met, it outputs an instruction signal to the summarizing condition changing part 34 to change the condition for summarization. The summarizing condition changing part 34 changes the condition for summarization accordingly, and inputs the changed condition to the emphasized speech sub-block extracting part 33. Based on the condition for summarization input thereto from the summarizing condition changing part 34, the emphasized speech sub-block extracting part 33 compares again the emphasized and normal state probabilities of respective speech sub-blocks stored in the emphasized state probability table 32.

The emphasized speech sub-blocks extracted by the emphasized speech sub-block extracting part 33 are provided again to the provisional summarized portion deciding part 35, causing it to decide the speech blocks including the speech sub-blocks decided as being emphasized. The gross time of the thus determined speech blocks is calculated, and the summarized portion deciding part 35B decides whether the result of calculation meets the condition for summarization. This operation is repeated until the condition for summarization is met, and the speech block sequence having satisfied the condition for summarization is read out as summarized speech and summarized video data from the storage part 12 and played back for distribution to the user.

The speech processing method according to this embodiment is implemented by executing a program on a computer. In this instance, this invention method can also be implemented by a CPU or the like in a computer by downloading the codebook and a program for processing via a communication line or installing a program stored in a CD-ROM, magnetic disk or similar storage medium.

Embodiment 3

This embodiment is directed to a modified form of the utterance decision processing in step S3 in FIG. 1. As described previously with reference to FIGS. 4 and 12, in Embodiment 1 the independent and conditional appearance probabilities, precalculated for speech parameter vectors of portions labeled as emphasized and normal by analyzing speech of a test subject, are prestored in a codebook in correspondence to codes, then the probabilities of speech sub-blocks becoming emphasized and normal are calculated, for example, by Eqs. (17) and (18) from a sequence of frame codes of input speech sub-blocks, and the speech sub-blocks are each decided as to whether it is emphasized or normal, depending upon which of the probabilities is higher than the other. This embodiment makes the decision by an HMM (Hidden Markov Model) scheme as described below.

In this embodiment, an emphasized HMM and a normal HMM are generated from many portions labeled emphasized and many portions labeled normal in training speech signal data of a test subject, and emphasized-state likelihood and normal-state HMM likelihood of the input speech sub-block are calculated, and the state of utterance is decided depending upon which of the emphasized-state likelihood and normal-state HMM likelihood is greater than the other. In general, HMM is formed by the parameters listed below.

S: Finite set of states; $S=\{S_i\}$

Y: Set of observation data; $Y=\{y_1, \ldots, y_t\}$

A: Set of state transition probabilities; $A=\{a_{ij}\}$

B: Set of output probabilities; $B=\{b_j(y_t)\}$

π: Set of initial state probabilities; $\pi=\{\pi_1\}$

Figure 22A:
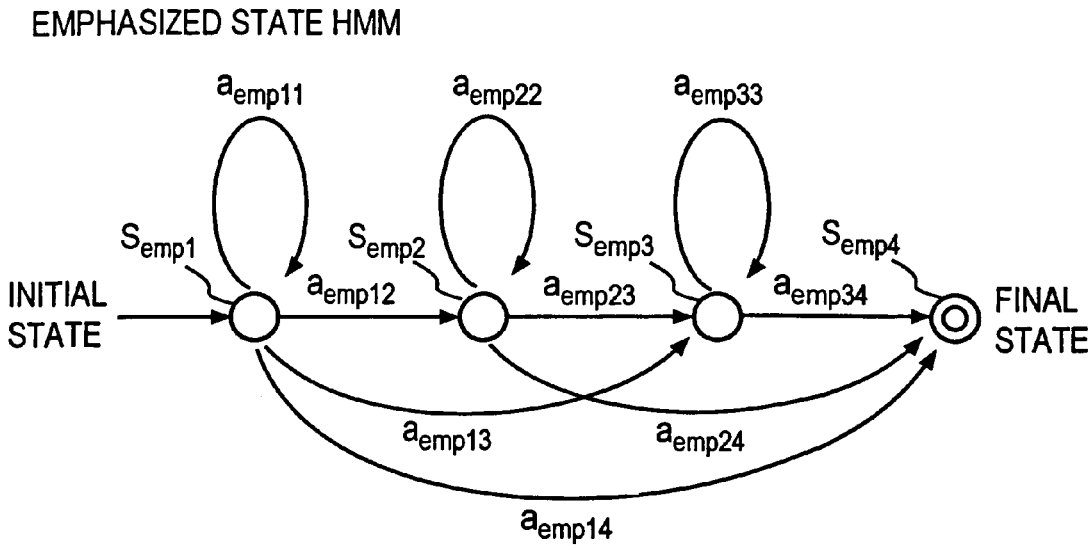
FIG. 22A is a diagram for explaining an emphasized state HMM in Embodiment 3.
Figure 22B:
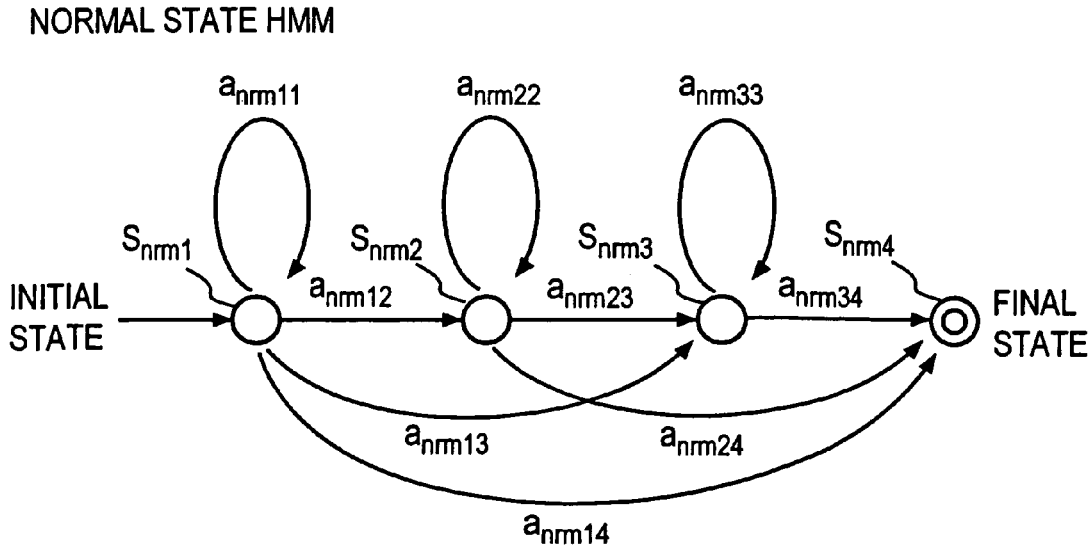
FIG. 22B is a diagram for explaining an normal state HMM in Embodiment 3.

FIGS. 22A and 22B show typical emphasized state and normal state HMMs in the case of the number of states being 4 (i=1, 2, 3, 4). In this embodiment, for example, in the case of modeling emphasized- and normal-labeled portion in training speech data to a predetermined number of states 4, a finite set of emphasized state HMMs, $S_{emp}=\{S_{empi}\}$, is $S_{emp1}$, $S_{emp2}$, $S_{emp3}$, $S_{emp4}$, whereas a finite set of normal state HMMs, $S_{nrm}=\{S_{nrmi}\}$, is $S_{nrm1}$, $S_{nrm2}$, $S_{nrm3}$, $S_{nrm4}$. Elements of a set Y of observation data, $\{y_1, \ldots, y_t\}$, are sets of quantized speech parameters of the emphasized- and normal-labeled portions. This embodiment also uses, as speech parameters, a set of speech parameters including at least one of the fundamental frequency, power, a temporal variation of a dynamic measure and/or an inter-frame difference in at least any one of these parameters. $a_{empij}$ indicates the probability of transition from state $S_{empi}$ to $S_{empj}$, and $b_{empj}(y_t)$ indicates the probability of outputting $y_t$ after transition to state $S_{empj}$. The initial state probabilities $\pi_{emp}(y_1)$ and $\pi_{nrm}(y_1)$. $a_{empij}$, $a_{nrmij}$, $b_{empj}(y_t)$ and $b_{nrmj}(y_t)$ are estimated from training speech by an EM (Expectation-Maximization) algorithm and a forward/backward algorithm.

The general outlines of an emphasized state HMM design will be explained below.

Step S1: In the first place, frames of all portions labeled emphasized or normal in the training speech data are analyzed to obtain a set of predetermined speech parameters for each frame, which is used to produce a quantized codebook. Let it be assumed here that the set of predetermined speech parameters be the set of 13 speech parameters used in the experiment of Embodiment 1, identified by a combination No. 17 in FIG. 17 described later on; that is, a 13-dimensional vector codebook is produced. The size of the quantized codebook is set to M and the code corresponding to each vector is indicated by Cm (where m−1, . . . , M). In the quantized codebook there are stored speech parameter vectors obtained by training.

Step S2: The sets of speech parameters of frames of all portions labeled emphasized and normal in the training speech data are quantized using the quantized codebook to thereby obtain a code sequence $Cm_t$ (where t=1, . . . , LN) of the speech parameter vectors of each emphasized-labeled portion, LN being the number of frames. As described previously in Embodiment 1, the emphasized-state appearance probability $P_{emp}(Cm)$ of each code Cm in the quantized codebook is obtained; this becomes the initial state probability $\pi_{emp}(Cm)$. Likewise, the normal state appearance probability $P_{nrm}(Cm)$ is obtained, which becomes the initial state probability $\pi_{nrm}(Cm)$. FIG. 23A is a table showing the relationship between the numbers of the codes Cm and the initial state probabilities $\pi_{emp}(Cm)$ and $\pi_{nrm}(Cm)$ corresponding thereto, respectively.

Step S3: The number of states of the emphasized state HMM may be arbitrary. For example, FIGS. 22A and 22B show the case where the number of states of each of the emphasized and normal state HMMs is set to 4. For the emphasized state HMM there are provided states $S_{emp1}$, $S_{emp2}$, $S_{emp3}$, $S_{emp4}$, and for the normal state HMM there are provided $S_{nrm1}$, $S_{nrm2}$, $S_{nrm3}$, $S_{nrm4}$.

A count is taken of the number of state transitions from the code sequence derived from a sequence of frames of the emphasized-labeled portions of the training speech data, and based on the number of state transitions, maximum likelihood estimations of the transition probabilities $a_{empij}$, $a_{nrmij}$ and the output probabilities $b_{empj}(Cm)$, $b_{nrmj}(Cm)$ are performed using the EM algorithm and the forward/backward algorithm. Methods for calculating them are described, for example, in Baum, L. E., "An Inequality and Associated Maximization Technique in Statistical Estimation of Probabilistic Function of a Markov Process," In-equalities, vol. 3, pp. 1-8 (1972). FIGS. 23B and 23C show in tabular form the transition probabilities $a_{empij}$ and $a_{nrmij}$ provided for the respective states, and FIG. 24 shows in tabular form the output probabilities $b_{empj}(Cm)$ and $b_{nrmj}(Cm)$ of each code in the respective states $S_{empj}$ and $S_{nrmj}$ (where j=1, . . . , 4).

These state transition probabilities $a_{empij}$, $a_{nrmij}$ and code output probabilities $b_{empj}(Cm)$ and $b_{nrmj}(Cm)$ are stored in tabular form, for instance, in the codebook memory 15 of the FIG. 13 apparatus for use in the determination of the state of utterance of the input speech signal described below. Incidentally, the table of the output probability corresponds to the codebooks in Embodiments 1 and 2.

With the thus designed emphasized state and the normal state HMMs, it is possible to decide the state of utterance of input speech sub-blocks as described below.

A sequence of sets of speech parameters derived from a sequence of frames (the number of which is identified by FN) of the input speech sub-block is obtained, and the respective sets of speech parameters are quantized by the quantized codebook to obtain a code sequence $\{Cm_1, Cm_2, \ldots, Cm_{FN}\}$. For the code sequence, a calculation is made of the emphasized-state appearance probability (likelihood) of the speech sub-block on all possible paths of transition of the emphasized state HMM from state $S_{emp1}$ to $S_{emp4}$. A transition path k will be described below. FIG. 25 shows the code sequence, the state, the state transition probability and the output probability for each frame of the speech sub-block. The emphasized-state probability $P(S^k_{emp})$ when the state sequence $S^k_{emp}$ on the path k for the emphasized state HMM is $S^k_{emp}=\{S^k_{emp1}, S^k_{emp2}, \ldots, S^k_{empFN}\}$ is given by the following equation.

$$P(S^k_{emp}) = \pi_{emp}(Cm_1)\sum_{f=1}^{FN} a_{empk_{f-1}k_f} b_{empk_f}(Cm_f) \tag{20}$$

Eq. (20) is calculated for all the paths k. Letting the emphasized-state probability (i.e., emphasized-state likelihood), $P_{empHMM}$, of the speech sub-block be the emphasized-state probability on the maximum likelihood path, it is given by the following equation.

$$P_{empHMM} = \underset{k}{argmax} P(S^k_{emp}) \tag{21}$$

Alternatively, the sum of Eq. (20) for all the paths may be obtained by the following equation.

$$P_{empHMM} = \sum_k P(S^k_{emp}) \tag{21'}$$

Similarly, the normal-state probability (i.e., normal-state likelihood) $P(S^k_{nrm})$ when the state sequence $S^k_{nrm}$ when the state sequence $S^k_{nrm}$ on the path k for the emphasized state HMM is $S^k_{nrm}=\{S^k_{nrm1}, S^k_{nrm2}, \ldots, S^k_{nrmFN}\}$ is given by the following equation.

$$P(S^k_{nrm}) = \pi_{nrm}(Cm_1)\sum_{f=1}^{FN} a_{nrmk_{f-1}k_f} b_{nrmpk_f}(Cm_f) \tag{22}$$

Letting the normal-state probability, $P_{nrmHMM}$, of the speech sub-block be the normal-state probability on the maximum likelihood path, it is given by the following equation.

$$P_{nrmHMM} = \underset{k}{\text{argmax}} P(S^k_{nrm}) \tag{23}$$

Alternatively, the sum of Eq. (22) for all the paths may be obtained by the following equation.

$$P_{nrmHMM} = \sum_k P(S^k_{nrm}) \tag{23'}$$

For the speech sub-block, the emphasized-state probability $P_{empHMM}$ and the normal-state probability $P_{nrmHMM}$ are compared; if the former is larger than the latter, the speech sub-block is decided as emphasized, and if the latter is larger, the speech sub-block is decided as normal. Alternatively, the probability ratio $P_{empHMM}/P_{nrmHMM}$ may be used, in which case the speech sub-block is decided as emphasized or normal depending on whether the ratio is larger than a reference value or not.

The calculations of the emphasized- and normal-state probabilities by use of the HMMs described above may be used to calculate the speech emphasized-state probability in step S11 in FIG. 18 mentioned previously with reference to Embodiment 2 that performs speech summarization, in more detail, in steps S103 and S104 in FIG. 19. That is, instead of calculating the probabilities $P_{Semp}$ and $P_{Snrm}$ by Eqs. (17) and (18), the emphasized-state probability $P_{empHMM}$ and the normal-state probability $P_{nrmHMM}$ calculated by Eqs. (21) and (23) or (21') and (23') may also be stored in the speech emphasized-state probability table depicted in FIG. 20. As is the case with Embodiment 2, the summarization rate can be changed by changing the reference value for comparison with the probability ratio $P_{empHMM}/P_{nrmHMM}$.

Embodiment 4

In Embodiment 2 the starting time and finishing time of the portion to be summarized are chosen as the starting time and finishing time of the speech block sequence decided as the portion to be summarized, but in the case of content with video, it is also possible to use a method in which: cut points of the video signal near the starting time and finishing time of the speech block sequence decided to be summarized are detected by the means described, for example, in Japanese Patent Application Laid-Open Gazette No. 32924/96, Japanese Patent Gazette No. 2839132, or Japanese Patent Application Laid-Open Gazette No 18028/99; and the starting time and finishing time of the summarized portion are defied by the times of the cut points (through utilization of signals that occur when scenes are changed). In the case of using the cut points of the video signal to define the starting and the finishing time of the summarized portion, the summarized portion is changed in synchronization with the changing of video—this increased viewability and hence facilitates a better understanding of the summary.

It is also possible to improve understanding of the summarized video by preferentially adding a speech block including a telop to the corresponding video. That is, the telop carries, in many cases, information of high importance such as the title, cast, gist of a drama or topics of news. Accordingly, preferential displaying of video including such a telop on the summarized video provides increased probability of conveying important information to a viewer—this further increases the viewer's understanding of the summarized video. For a telop detecting method, refer to Japanese Patent Application Laid-Open Gazette No. 167583/99 or 181994/00.

Now, a description will be given of a content information distribution method, apparatus and program according to the present invention.

Figure 26:
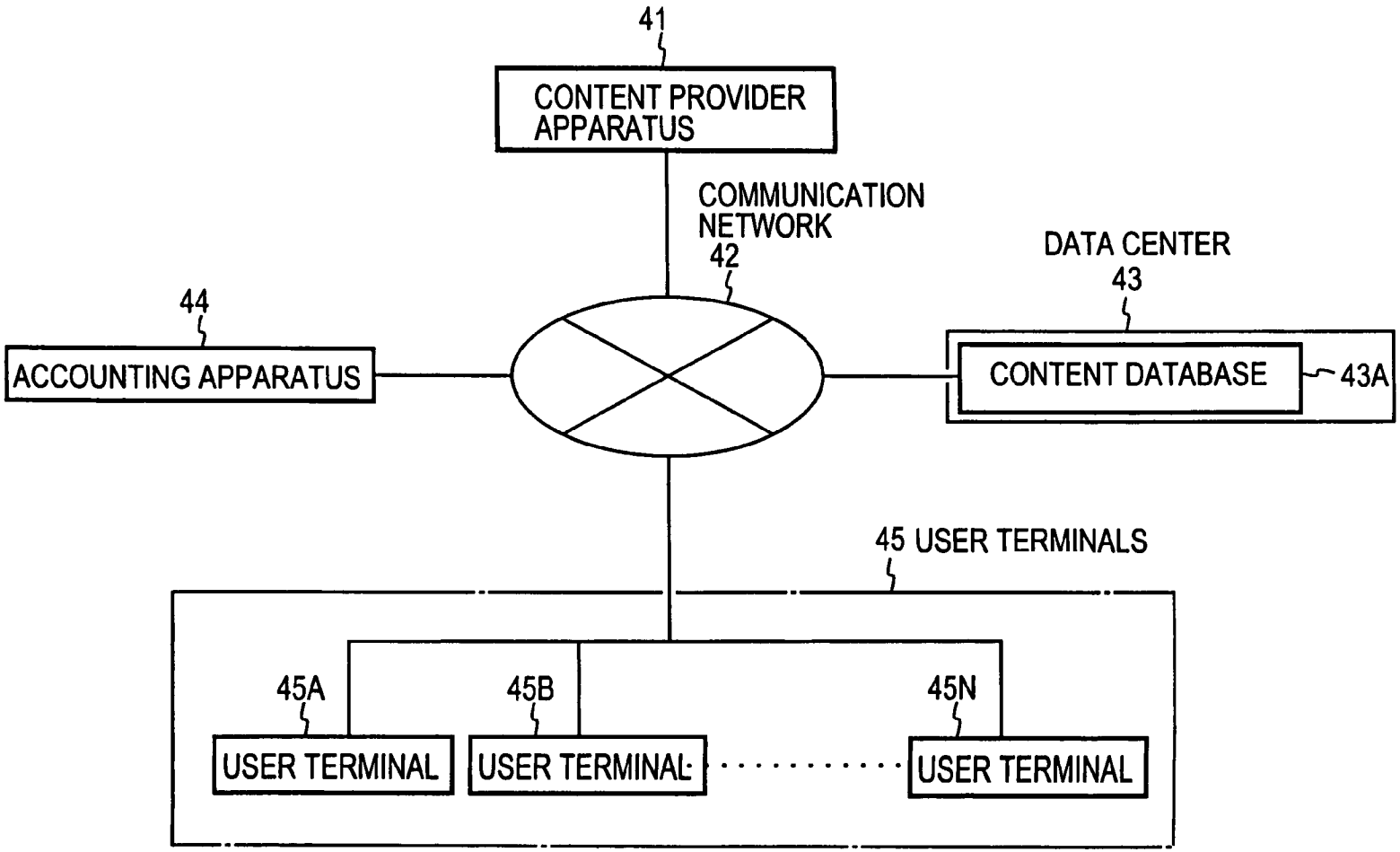
FIG. 26 is a block diagram illustrating the configuration of a summarized information distribution system according to a fourth embodiment of the present invention.

FIG. 26 illustrates in bock form the configuration of the content distribution apparatus according to the present invention. Reference numeral 41 denotes a content provider apparatus, 42 a communication network, 43 a data center, 44 an accounting apparatus, and 45 user terminals.

The content provider apparatus 41 refers to an apparatus of a content producer or dealer, more specifically, a server apparatus operated by a business which distributes video, music and like digital contents, such as a TV broadcasting company, video distributor, or rental video company.

The content provider apparatus 41 sends a content desired to sell to the data center 43 via the communication network 42 or some other recording media for storage in content database 43A provided in the data center 43. The communication network 42 is, for instance, a telephone network, LAN, cable TV network, or Internet.

The data center 43 can be formed by a server installed by a summarized information distributor, for instance. In response to a request signal from the user terminal group 43, the data center 43 reads out the requested content from the content database 43A and distributes it to that one of the user terminals 45A, 45B, . . . , 45N having made the request, and settles an account concerning the content distribution. That is, the user having received the content sends to the accounting apparatus 44 a signal requesting it to charge to a bank account of the user terminal the price or value concerning the content distribution.

The accounting apparatus 44 performs accounting associated with the sale of the content. For example, the accounting apparatus 44 deduces the value of the content from the balance in the bank account of the user terminal and adds the value of the content to the balance in the bank account of the content distributor.

In the case where the user wants to receive a content via the user terminal 45, it will be convenient if a summary of the content desired to receive is available. In particular, in the case of a content that continues as long as several hours, a summary compressed into of a desired time length, for example, 5 minutes or so, will be of great help to the user in deciding whether to receive the content.

Moreover, there is a case where it is desirable to compress a videotaped program into a summary of an arbitrary time length. In such an instance, it will be convenient if it is possible to implement a system in which, when receiving a user's instruction specifying his desired time of summary, the data center 43 sends data for playback use to the user, enabling him to play back the videotaped program in a compressed form of his desired compression rate.

In view of the above, this embodiment offers (a) a content distributing method and apparatus that provide a summary of a user's desired content and distributing it to the user prior to his purchase of the content, and (b) a content information distributing method and apparatus that produce data for playing back a content in a compressed form of a desired time length and distribute the playback data to the user terminal.

Figure 27:
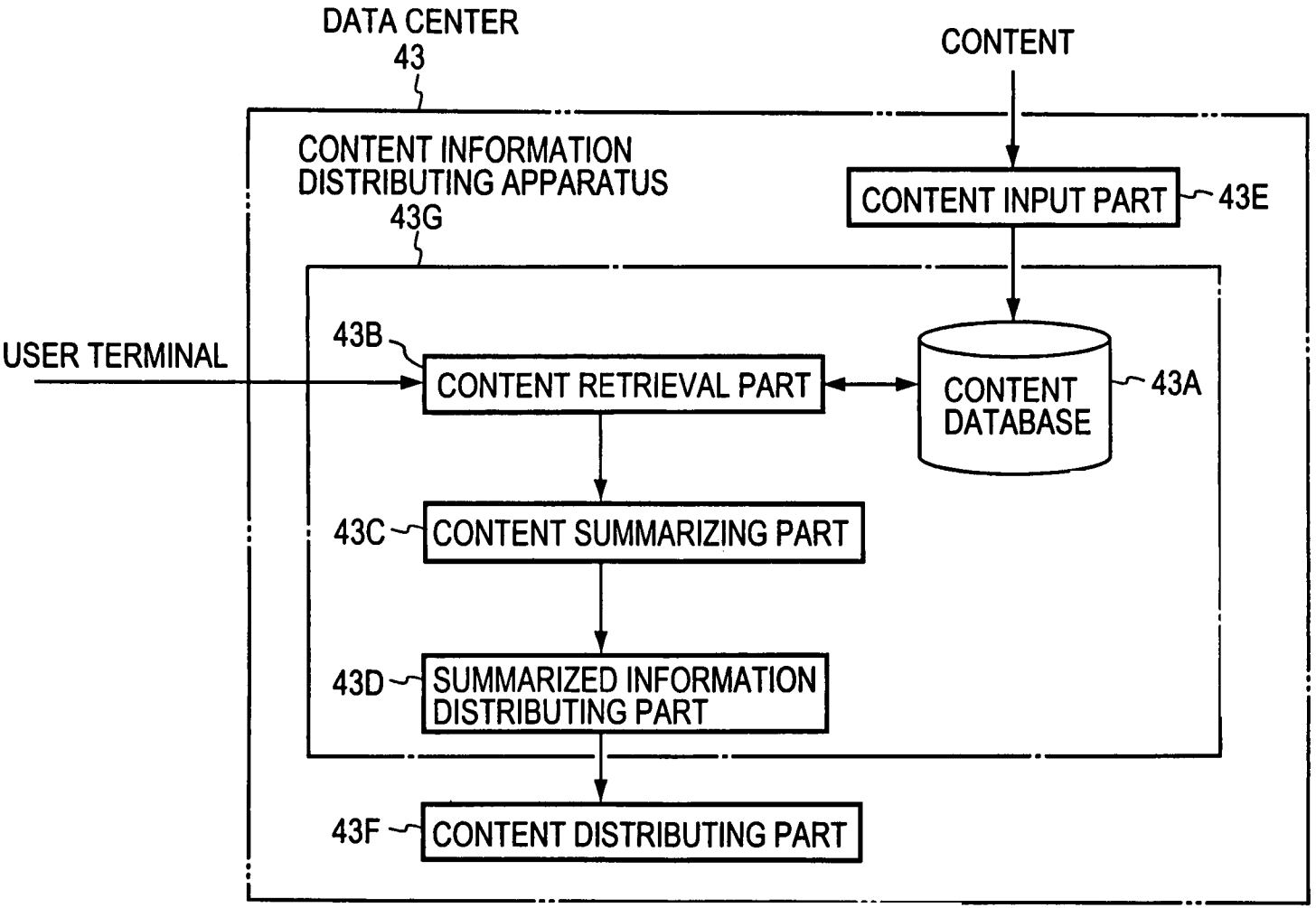
FIG. 27 is a block diagram depicting the configuration of a data center in FIG. 26.

In FIG. 27, reference numeral 43G denotes a content information distribution apparatus according to this embodiment. The content information distribution apparatus 43G is placed in the data center 43, and comprises a content database 43A, content retrieval part 43B, a content summarizing part 43C and a summarized information distributing part 43D.

Reference numeral 43E denotes content input part for inputting contents to the content database 43A, and 43F denotes a content distributing part that distributes to the user terminal the content that the user terminal group 45 desires to buy or summarized content of the desired content.

In the content database 43A contents each including a speech signal and auxiliary information indicating their attributes are stored in correspondence to each other. The content retrieval part 43B receives auxiliary information of a content from a user terminal, and retrieves the corresponding content from the content database 43A. The content summarizing part 43C extracts the portion of the retrieved content to be summarized. The content summarizing part 43C is provided with a codebook in which there are there are stored, in correspondence to codes, speech parameter vectors each including at least a fundamental frequency or pitch period, power, and a temporal variation characteristic of a dynamic measure, or an inter-frame difference in any one of them, and the probability of occurrence of each of said speech parameter vectors in emphasized state, as described previously. The emphasized state probability corresponding to the speech parameter vector obtained by frame-wise analysis of the speech signal in the content is obtained from the codebook, and based on this emphasized state probability the speech sub-block is calculated, and a speech block including the speech sub-block whose emphasized state probability is higher than a predetermined value is decided as a portion to be summarized. The summarized information distributing part 43D extracts, as a summarized content, a sequence of speech blocks decided as the portion to be summarized. When the content includes a video signal, the summarized information distributing part 43D adds the portion to be summarized with video in the portions corresponding to the durations of these speech blocks. The content distributing part 43F distributes the extracted summarized content to the user terminal.

Figure 28:
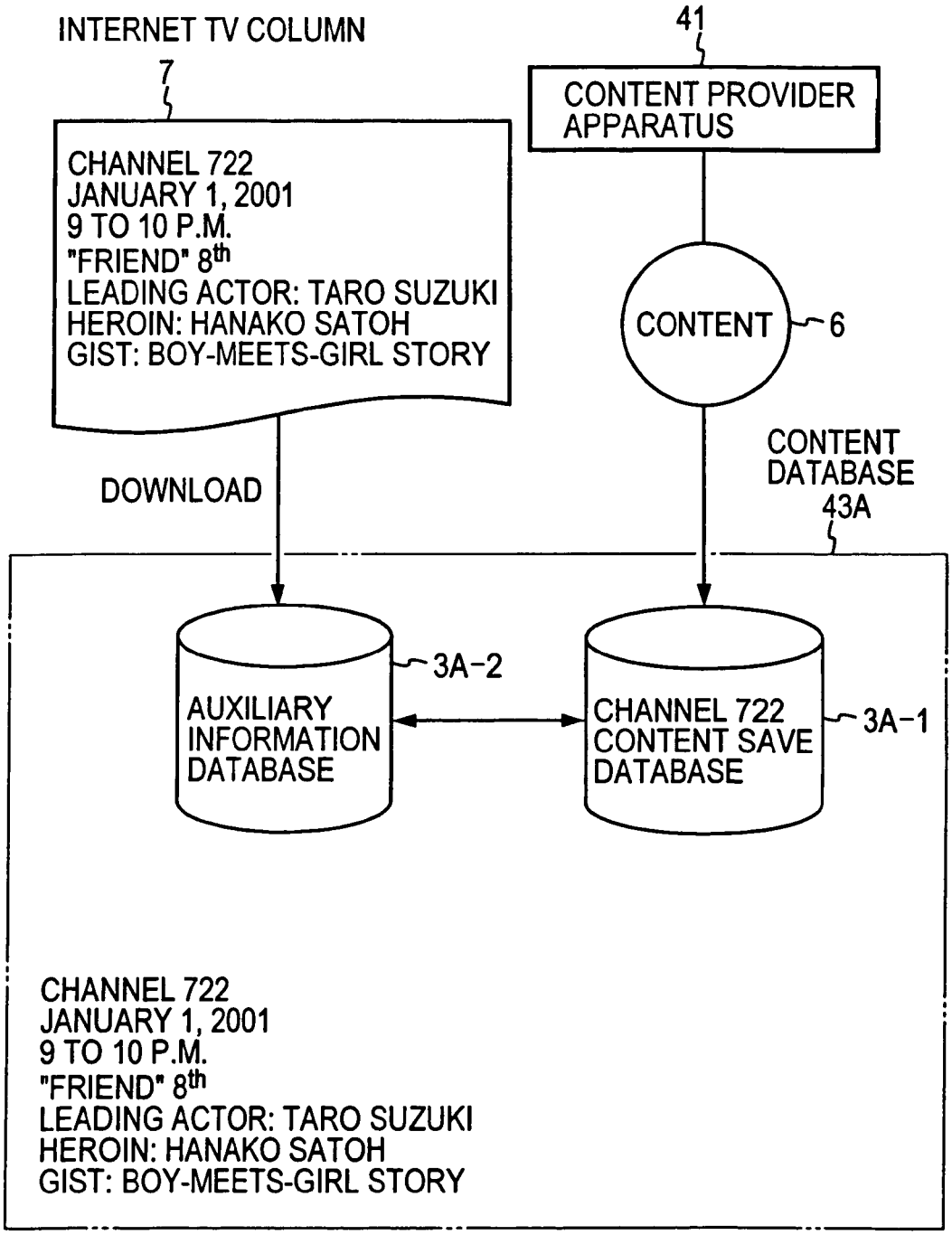
FIG. 28 is a block diagram depicting a detailed construction of a content retrieval part in FIG. 27.

The content database 43A comprises, as shown in FIG. 28, a content database 3A-1 for storing contents 6 sent from the content provider apparatus 41, and an auxiliary information database 3A-2 having stored therein auxiliary information indicating the attribute of each content stored in the content database 3A-1. An Internet TV column operator may be the same as or different from a database operator.

For example, in the case of TV programs, the contents in the content database 3A-1 are sorted according to channel numbers of TV stations and stored according to the airtime for each channel. FIG. 28 shows an example of the storage of Channel 722 in the content database 3A-1. An auxiliary information source for storage in the auxiliary information database 3A-2 may be data of an Internet TV column 7, for instance. The data center 43 specifies "Channel: 722; Date: Jan. 1, 2001; Airtime: 9~10 p.m." in the Internet TV column, and downloads auxiliary information such as "Title: Friend, $8^{th}$; Leading actor: Taro SUZUKI; Heroin: Hanako SATOH; Gist: Boy-meets-girl story" to the auxiliary database 3A-1, wherein it is stored in association with the telecasting contents for Jan. 1, 2001, 9~10 p.m. stored in the content database 3A-1.

Figure 29:
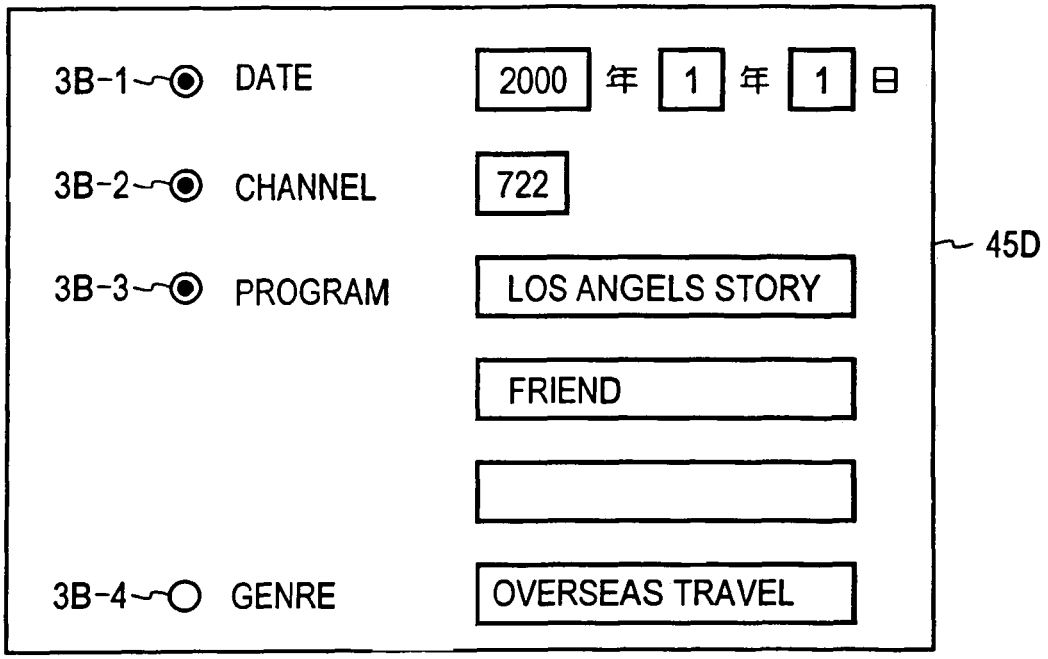
FIG. 29 is a diagram showing an example of a display screen for setting conditions for retrieval.

A user accesses the data center 43 from the user terminal 45A, for instance, and inputs to the content retrieval part 43B data about the program desired to summarize, such as the date and time of telecasting, the channel number and the title of the program. FIG. 29 shows examples of entries displayed on a display 45D of the user terminal 45A. In the FIG. 29 example, the date of telecasting is Jan. 1, 2001, the channel number is 722 and the title is "Los Angels Story" or "Friend." Black circles in display portions 3B-1, 3B-2 and 3B-3 indicate the selection of these items.

The content retrieval part 43B retrieves the program concerned from the content database 3A-1, and provides the result of retrieval to the content summarizing part 43C. In this case, the program "Friend" telecast on Jan. 1, 2001, 9 to 10 p.m. is retrieved and delivered to the content summarizing part 43C.

Figure 30:
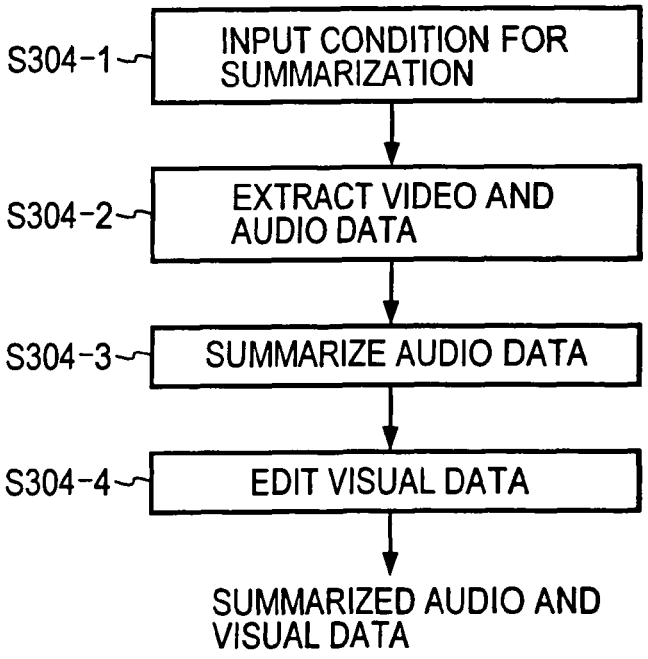
FIG. 30 is a flowchart for explaining the operation of the content summarizing part in FIG. 27.

The content summarizing part 43C summarizes the content fed thereto from the content retrieval part 43B. The content summarization by the content summarizing part 43C follows the procedure shown in FIG. 30.

In step S304-1 the condition for summarization is input by the operation of a user. The condition for summarization is the summarization rate or the time of summary. The summarization rate herein mentioned refers to the rate of the playback time of the summarized content to the playback time of the original content. The time of summary refers to the gross time of the summarized content. For example, an hour-long content is summarized based on the user's input arbitrary or preset summarization rate.

Upon input of the condition for summarization, video and speech signals are separated in step S304-2. In step S304-3 summarization is carried out using the speech signal. Upon completion of summarization, the summarized speech signal and the corresponding video signal are extracted and joined thereto, and the summary is delivered to the requesting user terminal, for example, 45A.

Having received the summarized speech and video signals, the user terminal 45A can play back, for example, an hour-program in 90 sec. When desirous of receiving the content after the playback, the user sends a distribution request signal from the user terminal 45A. The data center 43 responds to the request to distribute the desired content to the user terminal 45A from the content distributing part 43E (see FIG. 27). After the distribution, the accounting part 44 charges the price of the content to the user terminal 45A.

While in the above the present invention has been described as being applied to the distribution of a summary intended to sell contents, but the invention is applicable to the distribution of playback data for summarization as described below.

The processing from the reception of the auxiliary information from the user terminal 45A to the decision of the portion to be summarized is the same as in the case of the content information distributing apparatus described above. In this case, however, a set of starting and finishing times of every speech block forming the portion to be summarized is distributed in place of the content. That is, the starting and finishing times of each speech block forming the portion to be summarized, determined by analyzing the speech signal as described previously, and the time of the portion to be summarized are obtained by accumulation for each speech block. The starting and finishing times of each speech block and, if necessary, the gross time of the portion to be summarized are sent to the user terminal 45A. If the content concerned has already been received at the user terminal 45A, the user can see the content by playing it back for speech block from the starting to the finishing time.

That is, the user sends the auxiliary information and the summarization request signal from the user terminal, and the data center generates a summary of the content corresponding to the auxiliary information, then determines the starting and finishing times of each summarized portion, and sends these times to the user terminal. In other words, the data center 43 summarizes the user's specified program according to his requested condition for summarization, and distributes playback data necessary for summarization (the starting and finishing times of the speech blocks to be used for summarization, etc.) to the user terminal 45A. The user at the user terminal 45A sees the program by playing back its summary for the portions of the starting and finishing times indicated by the playback data distributed to the user terminal 45A. Accordingly, in this case, the user terminal 45A sends an accounting request signal to the accounting apparatus 44 with respect to the distribution of the playback data. The accounting apparatus 44 performs required accounting, for example, by deducing the value of the playback data from the balance in the bank account of the user terminal concerned and adding the data value to the balance in the bank account of the data center operator.

The processing method by the content information distributing apparatus described above is implemented by executing a program on a computer that constitutes the data center 43. The program is downloaded via a communication circuit or installed from a magnetic disk, CD-ROM or like magnetic medium into such processing means as CPU.

As described above, according to Embodiment 4, it is possible for a user to see a summary of a desired content reduced in time as desired before his purchase of the content. Accordingly, the user can make a correct decision on the purchase of the content.

Furthermore, as described previously the user can request summarization of a content recorded during his absence, and playback data for summarization can be distributed in response to the request. Hence, this embodiment enables summarization at the user terminals 45A to 45N without preparing programs for summarization at the terminals.

As described above, according to a first aspect of Embodiment 4, there is provided a content information distributing method, which uses content database in which contents each including a speech signal and auxiliary information indicating their attributes are stored in correspondence with each other, the method comprising steps of:

(A) receiving auxiliary information from a user terminal;

(B) extracting the speech signal of the content corresponding to said auxiliary information;

(C) quantizing a set of speech parameters obtained by analyzing said speech for each frame, and obtaining an emphasized-state appearance probability of the speech parameter vector corresponding to said set of speech parameters from a codebook which stores, for each code, a speech parameter vector and an emphasized-state appearance probability of said speech parameter vector, each of said speech parameter vectors including at least one of fundamental frequency, power and temporal variation of a dynamic measure and/or an inter-frame difference in at least any one of these parameters;

(D) calculating the emphasized state likelihood of a speech sub-block based on said emphasized-state appearance probability obtained from said codebook;

(E) deciding that speech blocks each including a speech sub-block whose emphasized-state likelihood is higher than a predetermined value are summarized portions; and (F) sending content information corresponding to each of said summarized portions of said content to said user terminal.

According to a second aspect of Embodiment 4, in the method of the first aspect, said codebook has further stored therein the normal-state appearance probabilities of said speech parameter vectors in correspondence to said codes, respectively;

said step (C) includes a step of obtaining from said codebook the normal-state appearance probability of the speech parameter vector corresponding to the set of speech parameter obtained by analyzing the speech signal for each frame;

said step (D) includes a step of calculating a normal-state likelihood of said speech sub-block based on said normal-state appearance probability obtained from said codebook; and said step (E) includes steps of:

(E-1) calculating a likelihood ratio of said emphasized-state likelihood to said normal-state likelihood for each of speech sub-blocks;

(E-2) calculating the sum total of the durations of said summarized portions in descending order of said likelihood ratio; and (E-3) deciding that a speech block is said summarized portion for which a summarization rate, which is the ratio of the sum total of the durations of said summarized portions to the entire speech signal portion, is equal to a summarization rate received from said user terminal or predetermined summarization rate.

According to a third aspect of Embodiment 4, in the method of the second aspect, said step (C) includes steps of:

(C-1) deciding whether each frame of said speech signal is a voiced or unvoiced portion;

(C-2) deciding that a portion including a voiced portion preceded and succeeded by more than a predetermined number of unvoiced portions is a speech sub-block; and (C-3) deciding that a speech sub-block sequence, which terminates with a speech sub-block including voiced portions whose average power is smaller than a multiple of a predetermined constant of the average power of said speech sub-block, is a speech block; and said step (E-3) includes a step of obtaining the total sum of the durations of said summarized portions by accumulation for each speech block.

According to a fourth aspect of Embodiment 4, there is provided a content information distributing method, which uses content database in which contents each including a speech signal and auxiliary information indicating their attributes are stored in correspondence with each other, the method comprising steps of:

(A) receiving auxiliary information from a user terminal;

(B) extracting the speech signal of the content corresponding to said auxiliary information;

(C) quantizing a set of speech parameters obtained by analyzing said speech for each frame, and obtaining an emphasized-state appearance probability of the speech parameter vector corresponding to said set of speech parameters from a codebook which stores, for each code, a speech parameter vector and an emphasized-state appearance probability of said speech parameter vector, each of said speech parameter vectors including at least one of fundamental frequency, power and temporal variation of a dynamic measure and/or an inter-frame difference in at least any one of these parameters;

(D) calculating the emphasized-state likelihood of a speech sub-block based on said emphasized-state appearance probability obtained from said codebook;

(E) deciding that speech blocks each including a speech sub-block whose emphasized-state likelihood is higher than a predetermined value are summarized portions; and (F) sending to said user terminal at least either one of the starting and finishing time of each summarized portion of said content corresponding to the auxiliary information received from said user terminal.

According to a fifth aspect of Embodiment 4, in the method of the fourth aspect, said codebook has further stored therein the normal-state appearance probabilities of said speech parameter vectors in correspondence to said codes, respectively;

said step (C) includes a step of obtaining the normal-state appearance probability corresponding to that one of said set of speech parameters obtained by analyzing the speech signal for each frame;

said step (D) includes a step of calculating the normal-state likelihood of said speech sub-block based on said normal-state appearance probability obtained from said codebook; and said step (E) includes steps of:

(E-1) calculating a likelihood ratio of said emphasized-state likelihood to said normal-state likelihood for each of speech sub-blocks;

(E-2) calculating the sum total of the durations of said summarized portions in descending order of said likelihood ratio; and (E-3) deciding that a speech block is said summarized portion for which a summarization rate, which is the ratio of the sum total of the durations of said summarized portions to the entire speech signal portion, is equal to a summarization rate received from said user terminal or predetermined summarization rate.

According to a sixth aspect of Embodiment 4, in the method of the fifth aspect, said step (C) includes steps of:

(C-1) deciding whether each frame of said speech signal is an unvoiced or voiced portion;

(C-2) deciding that a portion including a voiced portion preceded and succeeded by more than a predetermined number of unvoiced portions is a speech sub-block; and (C-3) deciding that a speech sub-block sequence, which terminates with a speech sub-block including voiced portions whose average power is smaller than a multiple of a predetermined constant of the average power of said speech sub-block, is a speech block;

said step (E-2) includes a step of obtaining the total sum of the durations of said summarized portions by accumulation for each speech block; and said step (F) includes a step of sending the starting time of said each speech block as the starting time of said summarized portion and the finishing time of said each speech block as the finishing time of said summarized portion.

According to a seventh aspect of Embodiment 4, there is provided a content information distributing apparatus, which uses content database in which contents each including a speech signal and auxiliary information indicating their attributes are stored in correspondence with each other, and sends to a user terminal a content summarized portion corresponding to auxiliary information received from said user terminal, the apparatus comprising:

a codebook which stores, for each code, a speech parameter vector and an emphasized-state appearance probability of said speech parameter vector, each of said speech parameter vectors including at least one of fundamental frequency, power and temporal variation of a dynamic measure and/or an inter-frame difference in at least any one of these parameters;

an emphasized state probability calculating part for quantizing a set of speech parameters obtained by analyzing said speech for each frame, obtaining, from said codebook, an emphasized-state appearance probability of the speech parameter vector corresponding to said set of speech parameters, and calculating an emphasized-state likelihood of a speech sub-block based on said emphasized-state appearance probability;

a summarized portion deciding part for deciding that speech blocks each including a speech sub-block whose emphasized-state likelihood is higher than a predetermined value are summarized portions; and a content distributing part for distributing content information corresponding to each summarized portion of said content to said user terminal.

According to an eighth aspect of Embodiment 4, there is provided a content information distributing apparatus, which uses content database in which contents each including a speech signal and auxiliary information indicating their attributes are stored in correspondence with each other, and sends to said user terminal at least either one of the starting and finishing time of each summarized portion of said content corresponding to the auxiliary information received from said user terminal, the apparatus comprising:

a codebook which stores, for each code, a speech parameter vector and an emphasized-state appearance probability of said speech parameter vector, each of said speech parameter vectors including at least one of fundamental frequency, power and temporal variation of a dynamic measure and/or an inter-frame difference in at least any one of these parameters;

an emphasized state probability calculating part for quantizing a set of speech parameters obtained by analyzing said speech for each frame, obtaining, from said codebook, an emphasized-state appearance probability of the speech parameter vector corresponding to said set of speech parameters, and calculating the emphasized-state likelihood of a speech sub-block based on said emphasized-state appearance probability;

a summarized portion deciding part for deciding that speech blocks each including a speech sub-block whose emphasized-state likelihood is higher than a predetermined value are summarized portions; and a content distributing part for sending to said user terminal at least either one of the starting and finishing time of each summarized portion of said content corresponding to the auxiliary information received from said user terminal.

According to a ninth aspect of Embodiment 4, there is provided a content information distributing program described in computer-readable form, for implementing any one of the content information distributing methods of the first to sixth aspect of this embodiment on a computer.

Embodiment 5

Figure 31:
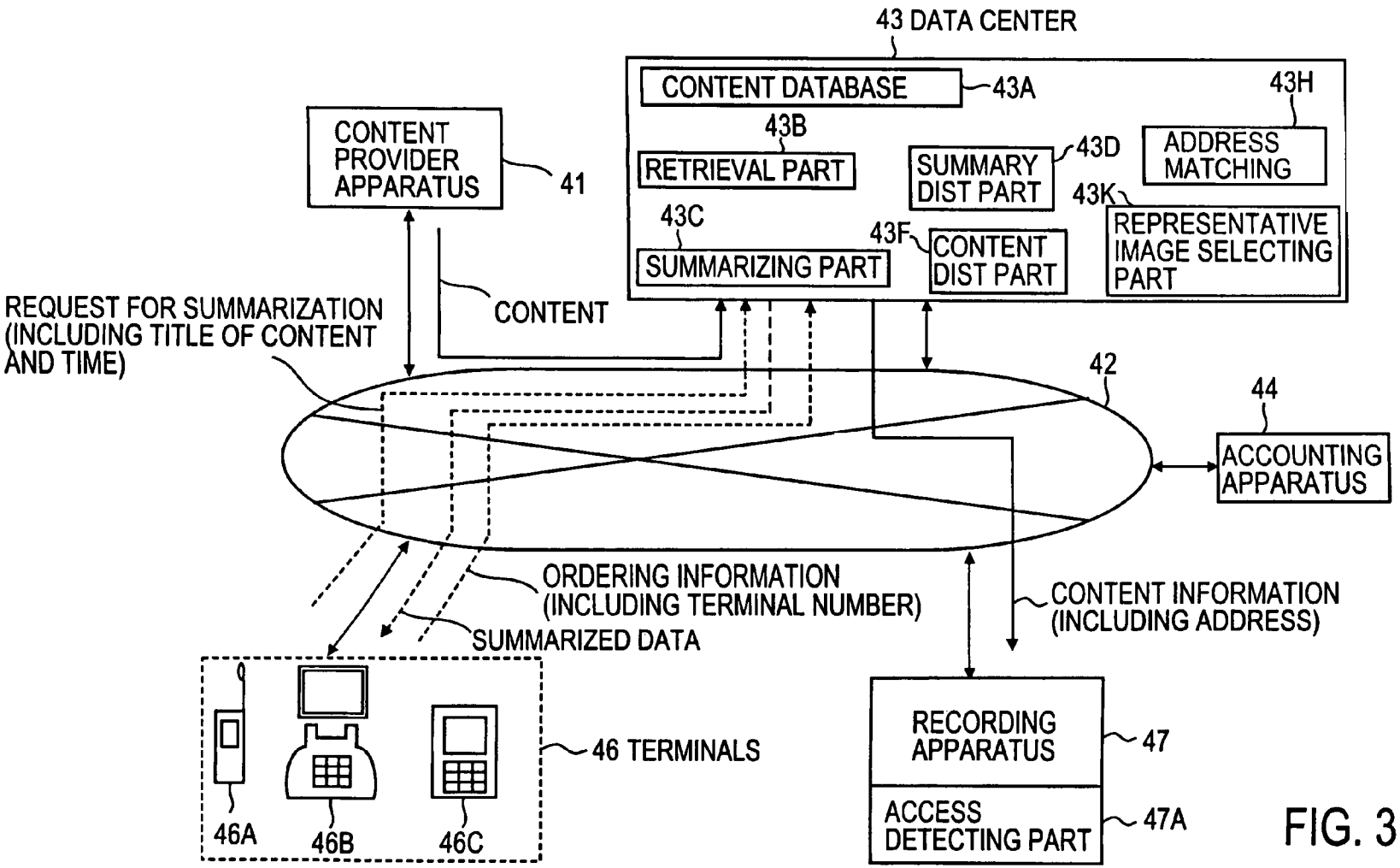
FIG. 31 is a block diagram illustrating the configuration of a content information distribution system according to a fifth embodiment of the present invention.

FIG. 31 illustrates in block form for explaining a content information distributing method and apparatus according to this embodiment of the invention. Reference numeral 41 denotes a content provider apparatus, 42 a communication network, 43 a data center, 44 an accounting apparatus, 46 a terminal group, and 47 recording apparatus. Used as the communication network 42 is such as a telephone network, the Internet or cable TV network.

The content provider apparatus 41 is a computer or communication equipment placed under control of a content server or supplier such as a TV station or movie distribution agency. The content provider apparatus 41 records, as auxiliary information, bibliographical information and copyright information such as the contents created or managed by the supplier, their titles, the dates of production and names of producers. In FIG. 31 only one content provider apparatus 41 is shown, but in practice, many provider apparatuses are present. The content provider apparatus 41 sends contents desired to sell (usually sound-accompanying video information like a movie) to the data center 43 via the communication network 42. The contents may be sent to the data center 43 in the form of a magnetic tape, DVD or similar recording medium as well as via the communication network 42.

The data center 43 may be placed under control of, for example, a communication company running the communication network 42, or a third party. The data center 43 is provided with a content database 43A, in which contents and auxiliary information received from the content provider apparatus 41 are stored in association with each other. In the data center 43 there are further placed a retrieval part 43B, a summarizing part 43C, a summary distributing part 43D, a content distributing part 43F, a destination address matching part 43H and a representative image selecting part 43K.

The terminal group 46 can be formed by a portable telephone or similar portable terminal equipment capable of receiving moving picture information, or an Internet-connectable, display-equipped telephone 46B, or an information terminal 46C capable of sending and receiving moving picture information. For the sake of simplicity, this embodiment will be described to use the portable telephone 46A to request a summary and order a content.

The recording apparatus 47 is an apparatus owned by the user of the portable telephone 46A. Assume that the recording apparatus 47 is placed at the user's home.

The accounting apparatus 44 is connected to the communication network 42, receives from the data center a signal indicating that a content has been distributed, and performs accounting of the value of the content to the content destination.

A description will be given of a procedure from the distribution of a summary of the content to the portable telephone 46A to the completion of the sale of the content after its distribution to the recording apparatus 47.

(A) The title of a desired content or its identification information is sent from the portable telephone 46A to the data center 43, if necessary, together with the summarization rate or time of summary.

(B) In the data center 43, based on the title of the content sent from the portable telephone 46, the retrieval part 43B retrieves the specified content from the content database 43A.

(C) The content retrieved by the retrieval part 43B is input to the summarizing part 43C, which produces a summary of the content. In the summarization of the content, the speech processing procedure described previously with reference to FIG. 18 is followed to decide the emphasized state of the speech signal contained in the content in accordance with the user's specified summarization rate or time of summary sent from the portable telephone 46A, and the speech block including the speech sub-block in emphasized state is decided as a summarized portion. The summarization rate or the time of summary need not always be input from the portable telephone 46A, but instead provision may be made to display preset numerical values (for example, 5 times, 20 sec and so on) on the portable telephone 46A so that the user can select a desired one of them.

A representative still image of at least one frame is selected from that portion of the content image signal synchronized with every summarized portion decided as mentioned above. The representative still image may also be an image with which the image signal of each summarized portion starts or ends, or a cut-point image, that is an image of a frame t time after a reference frame and spaced apart from the image of the latter in excess of a predetermined threshold value but smaller in the distance to the image of a nearby frame than the threshold value as described in Japanese Patent Application Laid-Open Gazette No. 32924/96. Alternatively, it is possible to select, as the representative still image, an image frame at a time the emphasized state probability $P_{Semp}$ of speech is maximum, or an image frame at a time the probability ratio $P_{Semp}/P_{Snrm}$ between the emphasized and normal state probabilities $P_{Semp}$ and $P_{Snrm}$ of speech is maximum. Such a representative still image may be selected for each speech block.

In this way, the speech signal and the representative still image of each summarized portion obtained as the summarized content is determined.

(D) The summary distributing part 43D distributes to the portable terminal 46A the summarized content produced by the summarizing part 43C.

(E) On the portable telephone 46A the representative still images of the summarized content distributed from the data center 43 are displayed by the display and speech of the summarized portions is played back. This eliminates the necessity of sending all pieces of image information and permits compensation for dropouts of information by speech of the summarized portions. Accordingly, even in the case of extremely limited channel capacity as in mobile communications, the gist of the content can be distributed with a minimum of lack of information.

(F) After viewing the summarized content the user sends to the data center 43 content ordering information indicating that he desires the distribution of an unabridged version of the content to him.

(G) Upon receiving the ordering information, the data center 43 specifies, by the destination address matching part 43H, the identification information of the destination apparatus corresponding to a telephone number, e-mail address or similar terminal identification information assigned to the portable telephone 46A.

(H) In the address matching part 43H, the name of the user of each portable telephone 46A, its terminal identification information and identification information of each destination apparatus are prestored in correspondence with one another. The destination apparatus may be the user's portable telephone or personal computer.

(I) The content distributing part 43F inputs thereto the desired content from the content database 43A and sends it to the destination indicated by the identification information.

(J) The recording apparatus 47 detects the address assigned from the communication network 42 by the access detecting part 47A and starts the recording apparatus 47 by the detection signal to read and record therein content information added to the address.

(K) The accounting apparatus 44 performs accounting procedure associated with the content distribution, for example, by deducing the value of the distributed content from the balance in the user's bank account and then adding the value of the content to the balance in the bank account of the content distributor.

In the above a representative still image is extracted for each summarized portion of speech and the summarized speech information is distributed together with such representative still images, but it is also possible to distribute the speech in its original form without summarizing it, in which case representative still pictures, which are extracted by such methods as listed below, are sent during the distribution of speech.

(1) For each t-sec. period, an image, which is synchronized with a speech signal of the highest emphasized state probability in that period, is extracted as a representative still picture.

(2) For each speech sub-block, S images (where S is a predetermined integer equal to or greater than 1), which are synchronized with frames of high emphasized state probabilities in the speech sub-block, are extracted as representative still picture.

(3) For each speech sub-block of a y-sec duration, y/t representative still pictures (where y/t represents the normalization of y by a fixed time length t) are extracted in synchronization with speech signals of high emphasized state probability.

(4) The number of representative still pictures extracted is in proportion to the value of the emphasized state probability of each frame of the speech sub-block, or the value of the ratio between emphasized and normal state probabilities, or the value of the weighting coefficient W.

(5) The above representative still picture extracting method according to any one of (1) to (4) is performed for the speech block instead of for the speech sub-block.

That is, item (1) refers to a method that, for each t sec., for example, one representative still picture synchronized with a speech signal of the highest emphasized state probability in the t-sec. period.

Item (2) refers to a method that, for each speech sub-block, extracts as representative still pictures, an arbitrary number S of images synchronized with those frames of the speech sub-block which are high in the emphasized state probability.

Item (3) refers to a method that extracts still pictures in the number proportional to the length of the time y of the speech sub-block.

Item (4) refers to a method that extracts still pictures in the number proportional to the value of the emphasized state probability.

In the case of distributing the speech content in its original form while at the same time sending representative still pictures as mentioned above, the speech signal of the content retrieved by the retrieval part 43B is distributed intact from the content distributing part 43F to the user terminal 46A, 46B, or 46C. At the same time, the summarizing part 43C calculates the value of the weighting coefficient W for changing the threshold value that is used to decide the emphasized state probability of the speech signal, or the ratio, $P_{Semp}/P_{Snrm}$, between the emphasized and normal state probabilities, or the emphasized state of the speech signal. Based on the value thus calculated, the representative image selecting part 43K extracts representative still pictures, which are distributed from the content distributing part 43F to the user terminal, together with the speech signal.

The above scheme permits playback of the whole speech signal without any dropouts. On the other hand, the still pictures synchronized with voiced portions decided as emphasized are intermittently displayed in synchronization with the speech. This enables the user to easily understand the plot of a TV drama, for instance; hence, the amount of data actually sent to the user is small although the amount of information conveyable to him is large.

While in the above the destination address matching part 43H is placed in the data center 43, it is not always be necessary. That is, when the destination is the portable telephone 46A, its identification information can be used as the identification information of the destination apparatus.

The summarizing part 43C may be equipped with speech recognizing means so that it specifies a phoneme sequence from the speech signal of the summarized portion and produces text information representing the phoneme sequence. The speech recognizing means may be one that needs only to determine from the speech signal waveform the text information indicating the contents of utterance. The text information may be sent as part of the summarized content in place of the speech signal. In such instance, the portable telephone 46A may also be adapted to prestore character codes and character image patters in correspondence to each other so that the character image patterns corresponding to character codes forming the text of the summarized content are superimposed on the representative pictures just like subtitles to display character-superimposed images.

In the case where the speech signal is transmitted as the summarized content, too, the portable telephone 46A may be provided with speech recognizing means so that character image patterns based on text information obtained by recognizing the transmitted speech signal are produced and superimposed on the representative pictures to display character-superimposed image patterns.

In the summarizing part 43C character codes and character image patterns are prestored in correspondence to each other so that the character image patterns corresponding to character codes forming the text of the summarized content are superimposed on the representative pictures to display character-superimposed images. In this case, character-superimposed images are sent as the summarized content to the portable telephone 46A. The portable telephone needs only to be provided with means for displaying the character-superimposed images and is not required to store the correspondence between the character codes and the character image patterns nor is it required to use speech recognizing means.

At any rate, the summarized content can be displayed as image information without the need for playback of speech—this allows playback of the summarized content even in circumstances where the playback of speech is limited as in public transportation.

In the above-mentioned step (E), in the case of displaying on the portable telephone 46A a sequence of representative still pictures received as a summary, the pictures may sequentially be displayed one after another in synchronization with the speech of the summarized portion, but it is also possible to fade out each representative still image for the last 20 to 50% of its display period and start displaying the next still image at the same time as the start of the fade-out period so that the next still image overlaps the preceding one. As a result, the sequence of still images looks like moving pictures.

The data center 43 needs only to distribute the content to the address of the recording apparatus 47 attached to the ordering information.

The above-described content information distributing method according to the present invention can be implemented by executing a content information distributing program on a computer. The program is installed in the computer via a communication line, or installed from a CD-ROM or magnetic disk.

As described above, this embodiment enables any of the portable telephone 46A, the display-equipped telephone 46A and the portable terminal 46C to receive summaries of contents stored in the data center as long as they can receive moving pictures. Accordingly, users are allowed to access summaries of their desired contents from the road or at any places.

In addition, since the length of summary or summarization rate can be freely set, the content can be summarized as desired.

Furthermore, when the user wants to buy the content after checking its summary, he can make an order for it on the spot, and the content is immediately distributed to and recorded in his recording apparatus 47. This allows ease in checking the content and simplifies the procedure of its purchase.

As described above, according to a first aspect of Embodiment 5, there is provided, which uses content database in which contents each including a video signal synchronized with a speech signal and auxiliary information indicating their attributes are stored in correspondence with each other, and which sends at least one part of the content corresponding to the auxiliary information received from a user terminal, the method comprising steps of:

(A) receiving auxiliary information from a user terminal;

(B) extracting the speech signal of the content corresponding to said auxiliary information;

(C) quantizing a set of speech parameters obtained by analyzing said speech for each frame, and obtaining an emphasized-state appearance probability of the speech parameter vector corresponding to said set of speech parameters from a codebook which stores, for each code, a speech parameter vector and an emphasized-state appearance probability of said speech parameter vector, each of said speech parameter vectors including at least one of fundamental frequency, power and temporal variation of a dynamic measure and/or an inter-frame difference in at least any one of these parameters;

(D) calculating an emphasized-state likelihood of a speech sub-block based on said emphasized-state appearance probability obtained from said codebook;

(E) deciding that speech blocks each including a speech sub-block whose emphasized-state likelihood is higher than a given value are summarized portions; and (F) selecting, as a representative image signal, an image signal of at least one frame from that portion of the entire image signal synchronized with each of said summarized portions; and (G) sending information based on said representative image signal and a speech signal of at least one part of said each summarized portion to said user terminal.

According to a second aspect of Embodiment 5, in the method of the first aspect, said codebook has further stored therein the normal-state appearance probabilities of said speech parameter vectors in correspondence to said codes, respectively;

said step (C) includes a step of obtaining from said codebook the normal-state appearance probability of the speech parameter vector corresponding to said speech parameter vector obtained by quantizing the speech signal for each frame;

said step (D) includes a step of calculating the normal-state likelihood of said speech sub-block based on said normal-state appearance probability; and said step (E) includes steps of:

(E-1) provisionally deciding that speech blocks each including a speech sub-block, in which a likelihood ratio of said emphasized-state likelihood to said normal-state likelihood is larger than a predetermined coefficient, are summarized portions;

(E-2) calculating the sum total of the durations of said summarized portions, or the ratio of said sum total of the durations of said summarized portions to the entire speech signal portion as the summarization rate thereto;

(E-3) deciding said summarized portions by calculating a predetermined coefficient such that the sum total of the durations of said summarized portions or the summarization rate, which is the ratio of said sum total to said entire speech portion, becomes the duration of summary or summarization rate preset or received from said user terminal.

According to a third aspect of Embodiment 5, in the method of the first aspect, said codebook has further stored therein the normal-state appearance probabilities said speech parameter vectors in correspondence to said codes, respectively;

said step (C) includes a step of obtaining from said codebook the normal-state appearance probability of the speech parameter vector corresponding to the set of speech parameters obtained by analyzing the speech signal for each frame;

said step (D) includes a step of calculating the normal-state likelihood of said speech sub-block based on said normal-state appearance probability obtained from said codebook; and said step (E) includes steps of:

(E-1) calculating a likelihood ratio of said emphasized-state likelihood to said normal-state likelihood for each of speech sub-blocks;

(E-2) calculating the sum total of the durations of said summarized portions in descending order of said probability ratio; and (E-3) deciding that a speech block is said summarized portion for which a summarization rate, which is the ratio of the sum total of the durations of said summarized portions to the entire speech signal portion, is equal to a summarization rate received from said user terminal or predetermined summarization rate.

According to a fourth aspect of Embodiment 5, in the method of the second or third aspect, said step (C) includes steps of:

(C-1) deciding whether each frame of said speech signal is an unvoiced or voiced portion;

(C-2) deciding that a portion including a voiced portion preceded and succeeded by more than a predetermined number of unvoiced portions is a speech sub-block; and (C-3) deciding that a speech sub-block sequence, which terminates with a speech sub-block including voiced portions whose average power is smaller than a multiple of a predetermined constant of the average power of said speech sub-block, is a speech block; and said step (E-2) includes a step of obtaining the total sum of the durations of said summarized portions by accumulation for each speech block including an emphasized speech sub-block.

According to a fifth aspect of Embodiment 5, there is provided a content information distributing method which distributes the entire speech signal of content intact to a user terminal, said method comprising steps of:

(A) extracting a representative still image synchronized with each speech signal portion in which the emphasized speech probability becomes higher than a predetermined value or the ratio between speech emphasized and normal speech probabilities becomes higher than a predetermined value during distribution of said speech signal; and (B) distributing said representative still images to said user terminal, together with said speech signal.

According to a sixth aspect of Embodiment 5, in the method of any one of the first to fourth aspects, said step (G) includes a step of producing text information by speech recognition of speech information of each of said summarized portions and sending said text information as information based on said speech signal.

According to a seventh aspect of Embodiment 5, in the method of any one of the first to fourth aspects, said step (G) includes a step of producing character-superimposed images by superimposing character image patterns, corresponding to character codes forming at least one part of said text information, on said representative still images, and sending said character-superimposed images as information based on said representative still images and the speech signal of at least one portion of said each voiced portion.

According to an eighth aspect of Embodiment 5, there is provided a content information distributing apparatus which is provided with content database in which contents each including an image signal synchronized with a speech signal and auxiliary information indicating their attributes are stored in correspondence with each other, and which sends at least one part of the content corresponding to the auxiliary information received from a user terminal, the method comprising:

a codebook which stores, for each code, a speech parameter vector and an emphasized-state appearance probability of said speech parameter vector, each of said speech parameter vectors including at least one of fundamental frequency, power and temporal variation of a dynamic measure and/or an inter-frame difference in at least any one of these parameters;

an emphasized state likelihood calculating part for quantizing a set of speech parameters obtained by analyzing said speech for each frame, obtaining an emphasized-state appearance probability of the speech parameter vector corresponding to said set of speech parameters from said codebook, and calculating an emphasized-state likelihood of a speech sub-block based on said emphasized-state appearance probability;

a summarized portion deciding part for deciding that speech blocks each including a speech sub-block whose emphasized-state likelihood is higher than a given value are summarized portions; representative image selecting part for selecting, as a representative image signal, an image signal of at least one frame from that portion of the entire image signal synchronized with each of said summarized portions; and summary distributing part for sending information based on said representative image signal and a speech signal of at least one part of said each summarized portion.

According to a ninth aspect of Embodiment 5, there is provided a content information distributing apparatus which is provided with content database in which contents each including an image signal synchronized with a speech signal and auxiliary information indicating their attributes are stored in correspondence with each other, and which sends at least one part of the content corresponding to the auxiliary information received from a user terminal, the method comprising:

a codebook which stores, for each code, a speech parameter vector and an emphasized-state appearance probability of said speech parameter vector, each of said speech parameter vectors including at least one of fundamental frequency, power and temporal variation of a dynamic measure and/or an inter-frame difference in at least any one of these parameters;

an emphasized state likelihood calculating part for quantizing a set of speech parameters obtained by analyzing said speech for each frame, obtaining an emphasized-state appearance probability of the speech parameter vector corresponding to said set of speech parameters from said codebook, and calculating the emphasized-state likelihood based on said emphasized-state appearance probability;

a representative image selecting part for selecting, as a representative image signal, an image signal of at least one frame from that portion of the entire image signal synchronized with each speech sub-block whose emphasized-state likelihood is higher than a predetermined value; and a summary distributing part for sending the entire speech information of said content and said representative image signals to said user terminal.

According to a tenth aspect of Embodiment 5, in the apparatus of the eighth or ninth aspect, said codebook has further stored therein a normal-state appearance probability of a speech parameter vector in correspondence to each code;

a normal state likelihood calculating part for obtaining from said codebook the normal-state appearance probability corresponding to said set of speech parameters obtained by analyzing the speech signal for each frame, and calculating the normal-state likelihood of a speech sub-block based on said normal-state appearance probability;

a provisional summarized portion deciding part for provisionally deciding that speech blocks each including a speech sub-block, in which a likelihood ratio of said emphasized-state likelihood to said normal-state likelihood is larger than a predetermined coefficient, are summarized portions; and a summarized portion deciding part for calculating the sum total of the durations of said summarized portions, or the ratio of said sum total of the durations of said summarized portions to the entire speech signal portion as the summarization rate thereto, and for deciding said summarized portions by calculating a predetermined coefficient such that the sum total of the durations of said summarized portions or the summarization rate, which is the ratio of said sum total to said entire speech portion, becomes the duration of summary or summarization rate preset or received from said user terminal.

According to an eleventh aspect of Embodiment 5, in the apparatus of the eight or ninth aspect, said codebook has further stored therein the normal-state appearance probability of said speech parameter vector in correspondence to said each code, respectively;

a normal state likelihood calculating part for obtaining from said codebook the normal-state appearance probability corresponding to said set of speech parameters obtained by analyzing the speech signal for each frame and calculating the normal-state likelihood of a speech sub-block based on said normal-state appearance probability;

a provisional summarized portion deciding part for calculating a ratio of the emphasized-state likelihood to the normal-state likelihood for each speech sub-block, for calculating the sum total of the durations of said summarized portions by accumulation to a predetermined value in descending order of said probability ratios, and for provisionally deciding that speech blocks each including said speech sub-block, in which the likelihood ratio of said emphasized-state likelihood to said normal-state likelihood is larger than a predetermined coefficient, are summarized portions; and a summarized portion deciding part for deciding said summarized portions by calculating a predetermined coefficient such that the sum total of the durations of said summarized portions or the summarization rate, which is the ratio of said sum total to said entire speech portion, becomes the duration of summary or summarization rate preset or received from said user terminal.

According to a twelfth aspect of Embodiment 5, there is provided a content information distributing program described in computer-readable form, for implementing any one of the content information distributing methods of the first to seventh aspect of this embodiment on a computer.

Embodiment 6

Figure 32:
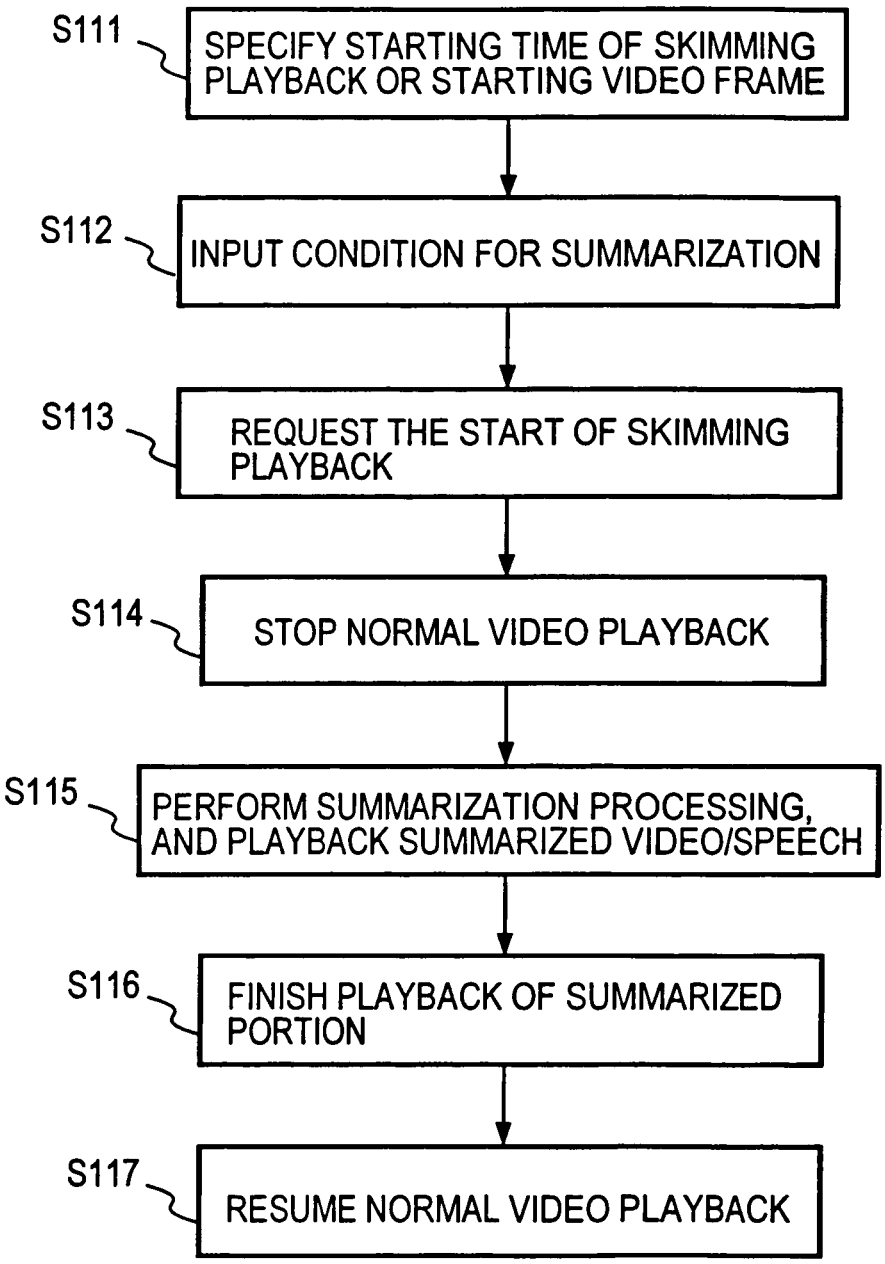
FIG. 32 is a flowchart showing an example of the procedure for implementing a video playback method according to a sixth embodiment of the present invention.
Figure 33:
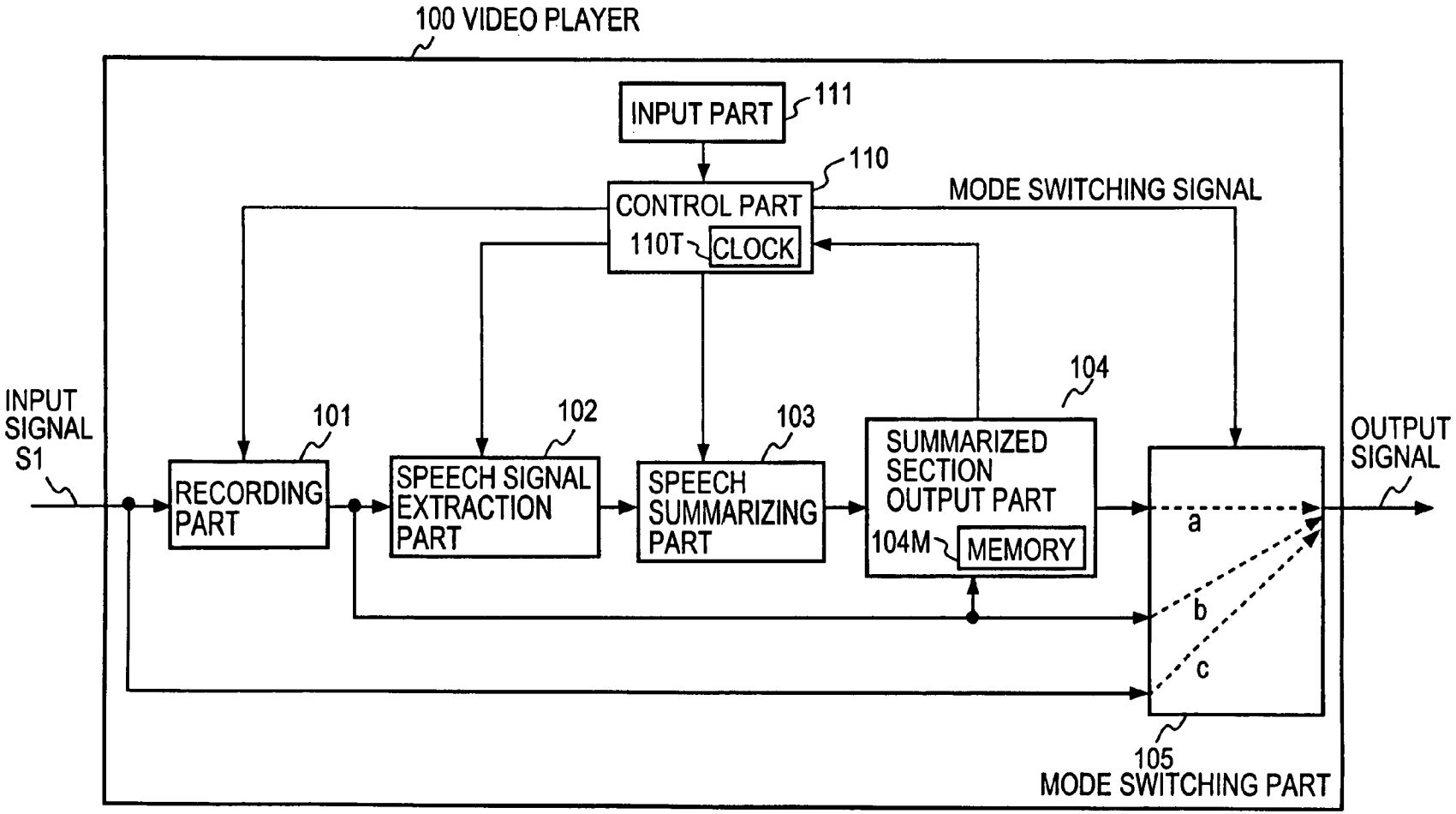
FIG. 33 is a block diagram illustrating an example of the configuration of a video player using the video playback method according to the sixth embodiment.

Turning next to FIGS. 32 and 33, a description will be given of a method by which real-time image and speech signals of a currently telecast program are recorded and at the same time the recording made so far is summarized and played back by the emphasized speech block extracting method of any one of Embodiments 1 to 3 so that the summarized image being played back catches up with the telecast image at the current point in time. This playback processing will hereinafter be referred to as skimming playback.

Step S111 is a step to specify the original time or frame of the skimming playback. For example, when a viewer of a TV program leaves his seat provisionally, he specifies his seat-leaving time by a pushbutton manipulation via an input part 111. Alternatively, a sensor is mounted on the room door so that it senses his leaving room by the opening and shutting of the door, specifying the seat-quitting time. Also there is a case where the viewer fast-forward plays back part of the program already recorded and specifies his desired original frame for skimming playback.

In step S112 the condition for summarization (the length of the summary or summarization rate) is input. This condition is input at the time when the viewer returns to his seat. For example, when the viewer was away from his seat for 30 minutes, he inputs his desired condition for summarization, that is, how much the content of the program telecast during his 30-minute absence is to be compressed browsing. Alternatively, the video player is adapted to display predetermined default values, for example, 3 minutes and so on for selection by the viewer.

Occasionally a situation arises where although programmed unattended recording of a TV program is being made, the viewer wants to view a summary of the already recorded portion of the program before he watches the rest of the program in real time. Since the recording start time is known due to programming in this case, the time of designating the start of playback of the summarized portion is decided as the summarization stop time. For example, if the condition for summarization is predetermined by a default value or the like, the recorded portion is summarized from the recording start time to the summarization stop time according to the condition for summarization.

In step S113 a request is made for the start of skimming playback. As a result, the stop point of the portion to be summarized (the stop time of summarization) is specified. The start time of the skimming playback may be input by a pushbutton manipulation; alternatively, a viewer's room-entering time sensed by the sensor mounted on the room door as referred to above may also be used as the playback start time.

In step S114 the playback of the currently telecast program is stopped.

In step S115 summarization processing is performed, and image and speech signals of the summarized portion are played back. The summarization processing specifies the portion to be summarized in accordance with the conditions for summarization input in step S113, and plays back the speech and image signals of the specified portion to be summarized. For summarization, the recorded image is read out at high speed and emphasized speech blocks are extracted; the time necessary therefor is negligibly short as compared with usual playback time.

In step S116 the playback of the summarized portion ends.

In step S117 the playback of the program being currently telecast is resumed.

FIG. 33 illustrates in block form an example of a video player, designated generally by 100, for the skimming playback described above. The video player 100 comprises a recording part 101, a speech signal extracting part 102, a speech summarizing part 103, a summarized portion output part 104, a mode switching part 105, a control part 110 and an input part 111.

The recording part 101 is formed by a record/playback means capable of fast read/write operation, such as a hard disk, semiconductor memory, DVD-ROM, or the like. With the fast read/write performance, it is possible to play back an already recorded portion while recording the program currently telecast. An input signal S1 is input from a TV tuner or the like; the input signal may be either an analog or digital signal. The recording in the recording part 101 is in digital form.

The speech signal extracting part 102 extracts a speech signal from the image signal of a summarization target portion specified by the control part 110. The extracted speech signal is input to the speech summarizing part 103. The speech summarizing part 103 uses the speech signal to extract an emphasized speech portion, specifying the portion to be summarized.

The speech summarizing part 103 always analyzes speech signals during recording, and for each program being recorded, produces a speech emphasized probability table depicted in FIG. 16 and stores it in a storage part 104M. Accordingly, in the case of playing back the recorded portion in summarized form halfway through telecasting of the program, the recorded portion is summarized using the speech emphasized state probability table of the storage part 104M. In the case of playing back the summary of the recorded program afterwards, too, the speech emphasized state probability table is used for summarization.

The summarized portion output part 104 reads out of the recording part 101 a speech-accompanied image signal of the summarized portion specified by the speech summarizing portion 103, and outputs the image signal to the mode switching part 105. The mode switching part 105 outputs, as a summarized image signal, the speech-accompanied image signal readout by the summarized portion output portion 104.

The mode switching part 105 is controlled by the control part 110 to switch between a summarized image output mode a, playback mode b for outputting the image signal read out of the recording part 101, and a mode for presenting the input signal S1 directly for viewing.

The control part 110 has a built-in timer 110T, and controls: the recording part 101 to start or stop recording at a recording start time manually inputted from the input part (a recording start/stop button, numeric input keys, or the like) or at the current time; the speech summarizing part 103 to perform speech summarization according to the summarizing conditions set from the input part 111; the summarized portion output part 104 to read out of the recording part 101 the image corresponding to the extracted summarized speech; and mode switching part 105 to enter the mode set via the input part 111.

Incidentally, according to the above-described skimming playback method, the image telecast during the skimming playback is not included in the summarization target portion, and hence it is not presented to the viewer.

As a solution to this problem, upon each completion of the playback of the summarized portion, the summarization processing and the summarized image and speech playback processing are repeated with the previous playback start time and stop time set as the current playback start time and stop time, respectively. When the time interval between the previous playback start time and the current playback stop time is shorter than a predetermined value (for example, 5 to 10 seconds), the repetition is discontinued.

In this case, there arises a problem that the summarized portion is played back in excess of the specified summarization rate or for a longer time than specified. Letting the length of the portion to be summarized be represented by TA and the summarization rate by r (where $0<r<1$, r=the overall time of the summary/the time of each portion to be summarized), the length (or duration) $T_1$ of the first summarized portion is $T_A r$. In the second round of summarization, the time $T_A r$ of the first summarized portion is further summarized by the rate r, and consequently the time of the second summarized portion is $T_A r^2$. Since this processing is carried out for each round of summarization, the overall time needed for the entire summarization processing is $T_A r/(1-r)$.

In view of this, the specified summarization rate r is adjusted to $r/(1+r)$, which is used for summarization. In this instance, the elapsed time until the end of the above-mentioned repeated operation is $T_A r$, which is the time of summarization that matches the specified summarization rate. Similarly, even when the length $T_1$ of the summarized portion is specified, if the time $T_A$ of the portion to be summarized is given, since the specified summarization rate r is $T_1/T_A$, the time of the first summarization may be adjusted to $T_A T_1/(T_A+T_1)$ even by setting the summarization rate to $T_1/(T_A+T_1)$.

Figure 34:
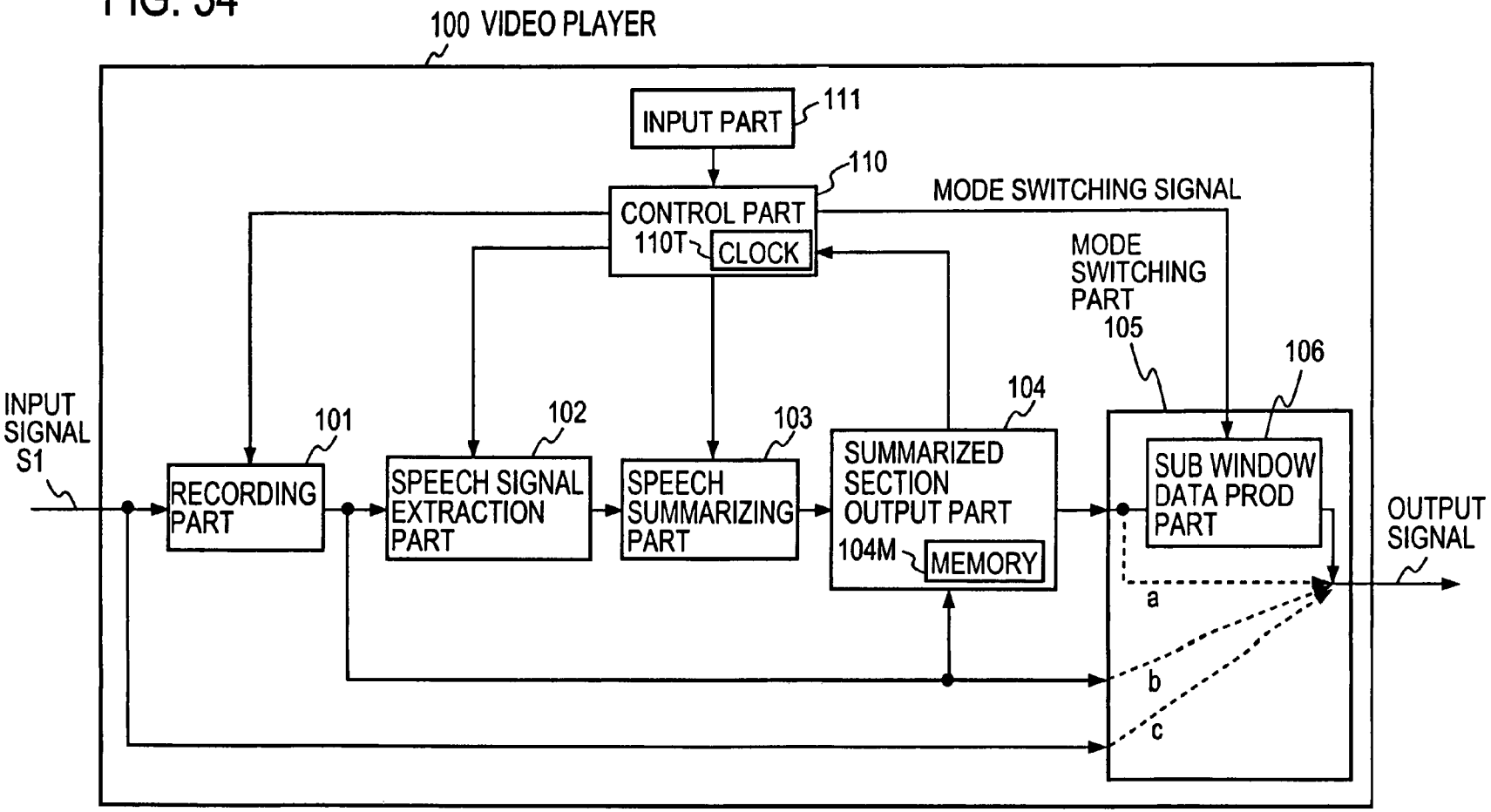
FIG. 34 is a block diagram illustrating a modified form of the video player according to the sixth embodiment.
Figure 35:
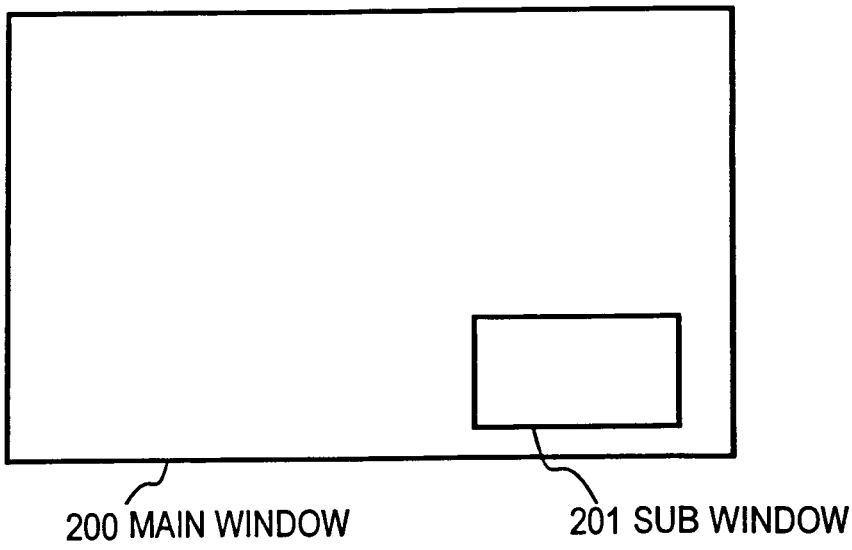
FIG. 35 is a diagram depicting an example of a display produced by the video player shown in FIG. 34.

FIG. 34 illustrates a modified form of this embodiment intended to solve the problem that a user cannot view the image telecast during the above-described skimming playback. In this example, the input signal S1 is output intact to display the image currently telecast on a main window 200 of a display (see FIG. 35). In the mode switching part 105 there is provided a sub-window data producing part 106, from which a summarized image signal obtained by image reduction is output while being superimposed on the input signal S1 for display on a sub window 201 (see FIG. 35). That is, this example has such a hybrid mode d.

This example presents a summary of the previously-telecast portion of a program on the sub window 201 while at the same time providing a real-time display of the currently-telecast portion of the same program on the main window 200. As a result, the viewer can watch on the main window 200 the portion of the program telecast while at the same time watching the summarized portion on the sub window 201, and hence at the time of completion of the playback of the summarized information, he can substantially fully understand the contents of the program from the first half portion to the currently telecast portion.

The image playback method according to this embodiment described above implemented by executing an image playback program on a computer. In this case, the image playback program is downloaded via a communication line or stored in a recording medium such as CD-ROM or magnetic disk and installed in the computer for execution therein by a CPU or like processor.

According to this embodiment, a recorded program can be compressed at an arbitrary compression rate to provide a summary for playback. This allows short-time browsing of the contents of many recorded programs, and hence allows ease in searching for a viewer's desired program.

Moreover, even when the viewer could not watch the first half portion of a program, he can enjoy the program since he can watch its first half portion in summarized form.

As described above, according to a first aspect of Embodiment 6, there is provided an image playback method comprising steps of:

(A) storing real-time image and speech signals in correspondence with a playback time, inputting a summarization start time, and inputting the time of summary that is the overall time of summarized portions, or summarization rate that is the ratio between the overall time of the summarized and the entire summarization target portion;

(B) deciding that those portions of said entire summarization target portion in which the speech signal is decided as being emphasized are each decided as the portion to be summarized, said entire summarization target portion being defined by said time of summary or summarization rate so that it starts at said summarization start time and stops at said summarization stop time; and (C) playing back speech and image signals in each of said portions to be summarized.

According to a second aspect of Embodiment 6, in the method of the first aspect, said step (C) includes a step of deciding said portion to be summarized, with the stop time of the playback of the speech and image signals in said each summarized portion set to the next summary playback start time, and repeating the playback of speech and image signals in said portion to be summarized in said step (C).

According to a third aspect of Embodiment 6, in the method of the second aspect, said step (B) includes a step of adjusting said summarization rate r to r/(1+r), where r is a real number 0<r<1, and deciding the portion to be summarized based on said adjusted summarization rate.

According to a fourth aspect of Embodiment 6, in the method of any one of the first to third aspects, said step (B) includes steps of:

(B-1) quantizing a set of speech parameters obtained by analyzing said speech for each frame, and obtaining an emphasized-state appearance probability and a normal-state appearance probability of the speech parameter vector corresponding to said set of speech parameters from a codebook which stores, for each code, a speech parameter vector and an emphasized-state appearance probability of said speech parameter vector, each of said speech parameter vectors including at least one of fundamental frequency, power and temporal variation of a dynamic measure and/or an inter-frame difference in at least any one of these parameters;

(B-2) obtaining from said codebook the normal-state appearance probability of the speech parameter vector corresponding to said speech parameter vector obtained by quantizing the speech signal for each frame;

(B-3) calculating the emphasized-state likelihood based on said emphasized-state appearance probability obtained from said codebook;

(B-4) calculating the normal-state likelihood based on said normal-state appearance probability obtained from said codebook;

(B-5) calculating the likelihood ratio of said emphasized-state likelihood to said normal-state likelihood for each speech signal portion;

(B-6) calculating the overall time of summary by accumulating the times of the summarized portions in descending order of said probability ratio; and (B-7) deciding that a speech block, for which the summarization rate, which is the ratio of the overall time of summarized portions to said entire summarization target portion, becomes equal to said input summarization rate, is said summarized portion.

According to a fifth aspect of Embodiment 6, in the method of any one of the first to third aspects, said step (B) includes steps of:

(B-1) quantizing a set of speech parameters obtained by analyzing said speech for each frame, and obtaining an emphasized-state appearance probability and a normal-state appearance probability of the speech parameter vector corresponding to said set of speech parameters from a codebook which stores, for each code, a speech parameter vector and an emphasized-state and normal-state appearance probabilities of said speech parameter vector, each of said speech parameter vectors including at least one of fundamental frequency, power and temporal variation of a dynamic measure and/or an inter-frame difference in at least any one of these parameters;

(B-2) obtaining from said codebook the normal-state appearance probability of the speech parameter vector corresponding to said speech parameter vector obtained by quantizing the speech signal for each frame;

(B-3) calculating the emphasized-state likelihood based on said emphasized-state appearance probability obtained from said codebook;

(B-4) calculating the normal-state likelihood based on said normal-state appearance probability obtained from said codebook;

(B-5) provisionally deciding that a speech block including a speech sub-block, for which a likelihood ratio of said emphasized-state likelihood to normal-state likelihood is larger than a predetermined coefficient, is a summarized portion;

(B-6) calculating the overall time of summarized portion, or as the summarization rate, the ratio of the overall time of said summarized portions to the entire summarization target portion; and (B-7) calculating said predetermined coefficient by which said overall time of said summarized portions becomes substantially equal to a predetermined time of summary or said summarization rate becomes substantially equal to a predetermined value, and deciding the summarized portion.

According to a sixth aspect of Embodiment 6, in the method of the fourth or fifth aspect, said step (B) includes steps of:

(B-1-1) deciding whether each frame of said speech signal is an unvoiced or voiced portion;

(B-1-2) deciding that a portion including a voiced portion preceded and succeeded by more than a predetermined number of unvoiced portions is a speech sub-block; and (B-1-3) deciding that a speech sub-block sequence, which terminates with a speech sub-block including voiced portions whose average power is smaller than a multiple of a predetermined constant of the average power of said speech sub-block, is a speech block; and said step (B-6) includes a step of obtaining the total sum of the durations of said summarized portions by accumulation for each speech block.

According to a seventh aspect of Embodiment 6, there is provided a video player comprising:

storage means for storing a real-time image and speech signals in correspondence to a playback time;

summarization start time input means for inputting a summarization start time;

condition-for-summarization input means for inputting a condition for summarization defined by the time of summary, which is the overall time of summarized portions, or the summarization rate which is the ratio between the overall time of the summarized portions and the time length the entire summarization target portion;

summarized portion deciding means for deciding that those portions of the summarization target portion from said summarization stop time to the current time in which speech signals are decided as emphasized are each a summarized portion; and playback means for playing back image and speech signals of the summarized portion decided by said summarized portion deciding means.

According to an eighth aspect of Embodiment 6, in the apparatus of the seventh aspect, said summarized portion deciding means comprises:

a codebook which stores, for each code, a speech parameter vector and an emphasized-state and normal-state appearance probabilities of said speech parameter vector, each of said speech parameter vectors including at least one of fundamental frequency, power and temporal variation of a dynamic measure and/or an inter-frame difference in at least any one of these parameters;

an emphasized state likelihood calculating part for quantizing a set of speech parameters obtained by analyzing said speech for each frame, obtaining an emphasized-state appearance probability of the speech parameter vector corresponding to said set of speech parameters from said codebook, calculating the emphasized-state likelihood of a speech sub-block based on said emphasized-state appearance probability;

a normal state likelihood calculating part for quantizing a set of speech parameters obtained by analyzing said speech for each frame, obtaining a normal-state appearance probability of the speech parameter vector corresponding to said set of speech parameters from said codebook, and calculating the normal-state likelihood of said speech sub-block based on said normal-state appearance probability;

a provisional summarized portion deciding part for calculating sub-block the likelihood ratio of said emphasized-state likelihood to normal-state likelihood of each speech sub-block, calculating the time of summary by accumulating summarized portions in descending order of said probability ratio, and provisionally deciding the summarized portions; and a summarized portion deciding part for deciding that a speech signal portion, which the ratio of said summarized portions to the entire summarization target portion meets said summarization rate, is said summarized portion.

According to a ninth aspect of Embodiment 6, in the apparatus of the seventh aspect, said summarized portion deciding means comprises:

a codebook which stores, for each code, a speech parameter vector and an emphasized-state and normal-state appearance probabilities of said speech parameter vector, each of said speech parameter vectors including at least one of fundamental frequency, power and temporal variation of a dynamic measure and/or an inter-frame difference in at least any one of these parameters;

an emphasized state likelihood calculating part for quantizing a set of speech parameters obtained by analyzing said speech for each frame, obtaining an emphasized-state appearance probability of the speech parameter vector corresponding to said set of speech parameters from said codebook, calculating the emphasized-state likelihood of a speech sub-block based on said emphasized-state appearance probability;

a normal state likelihood calculating part for calculating the normal-state likelihood of said speech sub-block based on the normal-state appearance probability obtained from said codebook;

a provisional summarized portion deciding part for provisionally deciding that a speech block including a speech sub-block, for which the likelihood ratio of said emphasized-state likelihood to said normal-state likelihood of said speech sub-block is larger than a predetermined coefficient, is a summarized portion; and a summarized portion deciding part for calculating said predetermined coefficient by which the overall time of summarized portions or said summarization rate becomes substantially equal a predetermined value, and deciding a summarized portion for each channel or for each speaker.

According to a tenth aspect of Embodiment 6, there is provided a video playback program described in computer-readable form, for implementing any one of the video playback methods of the first to sixth aspect of this embodiment on a computer.

EFFECT OF THE INVENTION

As described above, according to the present invention, a speech emphasized state and speech blocks of natural spoken language can be extracted, and the emphasized state of utterance of speech sub-blocks can be decided. With this method, speech reconstructed by joining together speech blocks, each including an emphasized speech sub-block, can be used to generate summarized speech that conveys important portions of the original speech. This can be achieved with no speaker dependence and without the need for presetting conditions for summarization such as modeling.

What is claimed is:

1. A speech processing method performed using a processor for deciding whether a portion of input speech is emphasized or not based on a set of speech parameters for each frame, comprising the steps of:

(a) obtaining from a codebook a plurality of speech parameter vectors each corresponding to a respective set of speech parameters obtained from respective ones of a plurality of frames in the portion of the input speech, said codebook storing, for each of a plural number of predetermined speech parameter vectors, a corresponding pair of a normal-state appearance probability and an emphasized-state appearance probability both predetermined using a training speech signal, each of said plural number of predetermined speech parameter vectors being composed of a set of speech parameters including at least one of a fundamental frequency, power and a temporal variation of dynamic-measure and/or an inter-frame difference in at least one of those speech parameters, and obtaining from said codebook a pair of an emphasized-state appearance probability and a normal-state appearance probability both corresponding to each speech parameter vector obtained for the respective ones of the plurality of frames in the portion of the input speech;

(b) using the processor, calculating an emphasized-state likelihood of the portion of the input speech by multiplying together emphasized-state appearance probabilities corresponding to the respective speech parameter vectors for the plurality of frames in the portion of the input speech, and calculating a normal-state likelihood of the portion of the input speech by multiplying together normal-state appearance probabilities corresponding to the respective speech parameter vectors for the plurality of frames in the portion of the input speech; and (c) deciding whether the portion of the input speech is emphasized or not based on said calculated emphasized-state likelihood and said calculated normal-state likelihood, and outputting a decision result of said deciding, the decision result indicating whether the portion of the input speech is emphasized or not, wherein the codebook stores, for each of the plural predetermined speech parameter vectors, a respective independent emphasized-state appearance probability and a respective set of conditional emphasized-state appearance probabilities, both used as respective said emphasized-state appearance probability, and stores, for each of the plural predetermined speech parameter vectors, a respective independent normal-state appearance probability and a set of conditional normal-state appearance probabilities, both used as respective said normal-state appearance probability, such that there is at least stored a separate conditional emphasized-state appearance probability and a separate conditional normal-state appearance probability for a possible speech parameter vector that immediately follows the respective speech parameter vector in the codebook, and wherein the step of calculating the emphasized-state likelihood in said step (b) is implemented by multiplying together the independent emphasized-state appearance probability and the conditional emphasized-state appearance probabilities corresponding to the speech parameter vectors of respective first frame and subsequent frames in said portion of the input speech, and the step of calculating the normal-state likelihood in said step (b) is implemented by multiplying together the independent normal-state appearance probability and the conditional normal-state appearance probabilities corresponding to the speech parameter vectors of respective said first frame and said subsequent frames in said portion of the input speech.

2. The method of claim 1, wherein said codebook stores, for the plural number of predetermined speech parameter vectors, respective codes representing the respective predetermined speech parameter vectors, and said step (a) further includes a step of quantizing each set of speech parameters obtained from respective one of the plurality of the frames in the portion of the input speech by using said codebook to obtain the code.

3. The method of claim 2, wherein a set of speech parameters of each of said plural number of predetermined speech parameter vectors includes at least temporal variation of dynamic measure.

4. The method of claim 2, wherein a set of speech parameters of each of said plural number of predetermined speech parameter vectors includes at least a fundamental frequency, power and temporal variation of dynamic measure.

5. The method of claim 2, wherein a set of speech parameters of each of said plural number of predetermined speech parameter vectors includes at least a fundamental frequency, power and temporal variation of dynamic-measure or an inter-frame difference in each of the parameters.

6. The method of claim 2, wherein said deciding step (c) is based on said calculated emphasized-state likelihood being larger than said calculated normal likelihood.

7. The method of claim 2, wherein said step (c) is performed based on a ratio of said calculated emphasized-state likelihood to said calculated normal-state likelihood.

8. The method of any one of claims 3 to 5 and 2, wherein said step (a) is based on normalizing each of said speech parameters in each set obtained from respective ones of the plurality of frames in said portion of the input speech by an average of corresponding speech parameters over said plurality of frames in said portion of the input speech to produce normalized speech parameters, a set of said normalized speech parameters obtained for each frame being used as said set of speech parameters for each said frame.

9. The method of claim 2, wherein said step (b) includes a step of calculating a conditional probability of emphasized-state by linear interpolation of said independent emphasized-state appearance probability and said conditional emphasized-state appearance probabilities.

10. The method of claim 2, wherein said step (b) includes a step of calculating a conditional probability of normal state by linear interpolation of said independent normal-state appearance probability and said conditional normal-state appearance probabilities.

11. The method of claim 1, wherein said step (a) includes a step of deciding, as a speech block, a series of speech sub-blocks in which an average power of a voiced portion in the last sub-block in said series is smaller than a product of an average power of said last sub-block and a constant, and wherein said step (c) includes a step of comparing said calculated emphasized-state likelihood with said normal-state likelihood to decide, as a portion of summarized speech, a speech block including a speech sub-block which is decided to be an emphasized sub-block, and outputting the portion of summarized speech.

12. The method of claim 1, wherein said step (a) includes a step of deciding, as a speech block, a series of speech sub-blocks in which an average power of a voiced portion in the last sub-block is smaller than a product of an average power of said last sub-block and a constant, and wherein said step (c) includes:

(c-1) a step of calculating a likelihood ratio of said calculated emphasized state likelihood to said normal state likelihood;

(c-2) a step of deciding a speech sub-block of the series of sub-blocks to be in an emphasized state if said likelihood ratio is greater than a threshold value; and (c-3) a step of deciding a speech block including the emphasized speech sub-block as a portion of summarized speech, and outputting the portion of summarized speech.

13. The method of claim 12, wherein said step (c) further includes a step of varying the threshold value, and repeating the steps (c-2) and (c-3) to obtain portions of summarized speech with a desired summarization ratio.

14. The method of claim 1, wherein said step (a) includes the steps of:

(a-1) judging each frame as voiced or unvoiced;

(a-2) judging, as a speech sub-block, every portion which includes a voiced portion of at least one frame and which is laid between unvoiced portions longer than a predetermined number of frames; and (a-3) judging, as a speech block, a series of at least one speech sub-block including a final sub-block, in which an average power of a voiced portion in said final sub-block is smaller than an average power of said final sub-block multiplied by a constant, wherein said step (c) includes a step of judging every speech sub-block as said portion of the input speech, judging a speech block including an emphasized speech sub-block as a portion of summarized speech, and outputting the portion of summarized speech.

15. The method of claim 14, wherein;

said step (b) includes a step of calculating each normal-state likelihood for respective speech sub-block based on said normal-state appearance probabilities; and said step (c) includes the steps of:

(c-1) judging, as a provisional portion, each speech block including a speech sub-block, for which a likelihood ratio of said emphasized-state likelihood to said normal-state likelihood is larger than a threshold;

(c-2) calculating a total duration of provisional portions or a ratio of a total duration of whole portions to said total duration of provisional portions as a summarization ratio; and (c-3) adjusting a threshold to adjust a number of provisional portions so that a total duration of the provisional portions is equal or approximate to a predetermined summarization time, or said summarization ratio is equal or approximate to a predetermined summarization ratio.

16. The method of claim 15 wherein said step (c-3) includes:

(c-3-1) increasing said threshold to decrease the number of provisional portions, when said total duration of the provisional portions is longer than said predetermined summarization time, or said summarization ratio is smaller than said predetermined summarization ratio, and repeating said steps (c-1) and (c-2);

(c-3-2) decreasing said threshold to increase the number of provisional portions, when said total duration of the provisional portions is shorter than said predetermined summarization time or said summarization ratio is larger than said predetermined summarization ratio and repeating said steps (c-1) and (c-2).

17. The method of claim 14, wherein said step (b) includes a step of calculating each normal-state likelihood for respective speech sub-blocks based on said normal-state appearance probabilities; and wherein said step (c) includes the steps of:

(c-1) calculating a likelihood ratio of said emphasized-state likelihood to said normal-state likelihood for each said speech sub-block;

(c-2) calculating a total duration by accumulating durations of each said speech block including a speech sub-block in a decreasing order of said likelihood ratio; and (c-3) deciding said speech blocks as portions to be summarized, at which a total duration of provisional portions is equal or approximate to a predetermined summarization time, or a summarization ratio is equal or approximate to a predetermined summarization ratio.

18. A non-transitory computer-readable storage medium having program code recorded thereon that, when executed by the processor, execute the method of any one of claim 3-5, 6-7, 10 or 2.

19. A speech processing method performed using a processor for deciding whether a portion of input speech is emphasized or not based on a set of speech parameters for each frame using an acoustical model including a codebook, wherein said codebook stores, as a normal initial-state appearance probability and an emphasized initial-state appearance probability, both for each of a plural number of predetermined speech parameter vectors, a corresponding pair of normal-state appearance probability and an emphasized-state appearance probability, both predetermined using a training speech signal, a predetermined number of states including an initial state and a final state, state transitions each defining a transition from each state to itself or another state, an output probability table storing emphasized-state output probabilities and normal-state output probabilities both for each of the plural number of speech parameter vectors at the respective states and a transition probability table storing an emphasized-state transition probability and a normal-state transition probability both for each of the state transitions, and wherein each of said speech parameter vectors is composed of a set of speech parameters including at least one of a fundamental frequency, power and a temporal variation of dynamic-measure and/or an inter-frame difference in at least one of those parameters, the method comprising the steps of:

judging each frame as voiced or unvoiced;

judging, as a speech sub-block, a portion which includes a voiced portion of at least one frame and which is laid between unvoiced portions longer than a predetermined number of frames;

obtaining from the codebook an emphasized initial-state probability and a normal initial-state probability both corresponding to a speech parameter vector which is a quantized set of speech parameters for an initial frame in said speech sub-block;

obtaining from the output probability table emphasized-state output probabilities and normal-state output probabilities both for respective state transitions corresponding to respective speech parameter vectors each of which is a quantized set of speech parameters obtained for respective one of frames after said initial frame in said speech sub-block, and obtaining from the transition probability table emphasized-state transition probabilities and normal-state transition probabilities both corresponding to state transitions for respective frames after said initial frame in said speech sub-block;

calculating, using the processor, a probability of emphasized-state by multiplying together said emphasized initial-state probability, said emphasized-state output probabilities and said emphasized-state transition probabilities both along every path of state transitions via the predetermined number of states and calculating, using the processor, a probability of normal-state by multiplying together said normal initial-state probability, said output probability and said normal-state transition probability both alone every state transition path;

deciding a largest one or total sum of the probabilities of emphasized-state for all the state transition paths as an emphasized-state likelihood and a largest one or total sum of the probabilities of normal-state for all the state transition paths as a normal-state likelihood; and comparing said emphasized-state likelihood with said normal-state likelihood to decide whether the speech sub-block is emphasized state or normal state.

20. A speech processing apparatus for deciding whether a portion of input speech is emphasized or not based on a set of speech parameters for each frame of said input speech, said apparatus comprising:

a codebook which stores, for each of a plural number of predetermined speech parameter vectors, a corresponding pair of a normal state appearance probability and an emphasized-state appearance probability, both predetermined using a training speech signal, each of said predetermined speech parameter vectors being composed of a set of speech parameters including at least two of a fundamental frequency, power and temporal variation of dynamic measure and/or an inter-frame difference in at least one of those speech parameters;

means for obtaining from said codebook a plurality of speech parameter vectors each corresponding to a respective set of speech parameters for obtained from each of a plurality of frames in the portion of the input speech;

a normal state likelihood calculating part that calculates a normal-state likelihood of the portion of the input speech by multiplying together normal-state appearance probabilities corresponding to the respective speech parameter vectors for the plurality of frames in the portion of the input speech;

an emphasized-state likelihood calculating part that calculates an emphasized-state likelihood of the portion of the input speech by multiplying together emphasized-state appearance probabilities corresponding to the respective speech parameter vectors for the plurality of frames in the portion of the input speech;

an emphasized state deciding part that decides whether the portion of the input speech is emphasized or not based on a comparison of said calculated emphasized-state likelihood to said calculated normal-state likelihood; and outputting unit that outputs the decision result representing whether the portion of the input speech is emphasized or not, wherein the codebook further stores, for each of the plural predetermined speech parameter vectors, a respective independent emphasized-state appearance probability and a respective independent normal-state appearance probability, both predetermined using the training speech signal, and stores for each of the plural predetermined speech parameter vectors, a respective set of conditional emphasized-state appearance probabilities and a respective set of conditional normal-state appearance probabilities, both predetermined using the training speech signal, such that there is at least stored a separate conditional emphasized-state appearance probability and a separate conditional normal-state appearance probability for a possible instance speech parameter vector that immediately follows the respective speech parameter vector in the codebook, wherein said emphasized-state likelihood calculating part is configured to calculate the emphasized-state likelihood by multiplying together an independent emphasized-state appearance probability and conditional emphasized-state appearance probabilities corresponding to the speech parameter vectors of respective first frame and subsequent frames in the portion of the input speech, and wherein said normal-state likelihood calculating part is configured to calculate the normal-state likelihood by multiplying together an independent normal-state appearance probability and conditional normal-state appearance probabilities corresponding to the speech parameter vectors of respective first frame and subsequent frames in the portion of the input speech.

21. The apparatus of claim 20, wherein said codebook stores, for the plural predetermined speech parameter vectors, respective codes representing the respective speech parameter vectors, and said means for obtaining a speech parameter vector is configured to quantize each set of speech parameters obtained from respective one of the plurality of the frames in the portion of the input speech by using said codebook to obtain the code.

22. The apparatus of claim 21, wherein a set of speech parameters of each of said plural predetermined speech parameter vectors includes at least a temporal variation of dynamic measure.

23. The apparatus of claim 21, wherein a set of speech parameters of each of said plural predetermined speech parameter vectors includes at least a fundamental frequency, a power and a temporal variation of dynamic measure.

24. The apparatus of claim 21, wherein a set of speech parameters of each of said plural predetermined speech parameter vectors includes at least a fundamental frequency, power and a temporal variation of a dynamic-measure or an inter-frame difference in each of the parameters.

25. The apparatus of any one of claims 22 to 24 and 21, wherein said emphasized-state deciding part includes emphasized state deciding means for deciding, said for the portion of the input speech, whether a ratio of said emphasized-state likelihood to said normal state likelihood is higher than a predetermined value, and if so, deciding that the portion of the input speech is emphasized.

26. The apparatus of claim 21, further comprising:

an unvoiced portion deciding part that decides whether each frame of said input speech is an unvoiced portion;

a voiced portion deciding part that decides whether each frame of said input speech is a voiced portion;

a speech sub-block deciding part that decides that every portion preceded and succeeded by more than a predetermined number of unvoiced portions and including a voiced portion is a speech sub-block;

a speech block deciding part that decides that when an average power of said voiced portion included in the last speech sub-block in said sequence of speech sub-blocks is smaller than a product of the average power of said speech sub-block and a constant, the sequence of the speech sub-blocks is a speech block; and a summarized portion output part that decides that a speech block including a speech sub-block which is decided as emphasized by said emphasized state deciding part is a portion of summarized speech, and that outputs said speech block as the portion of summarized speech.

27. The apparatus of claim 26, wherein said normal-state likelihood calculating part is configured to calculate the normal-state likelihood of each said speech sub-block; and said emphasized state deciding part includes:

a provisionally summarized portion deciding part that decides that a speech block including a speech sub-block is a provisionally summarized portion if a likelihood ratio between the emphasized-state likelihood of said portion decided by said speech sub-block deciding part as said speech sub-block to its normal-state likelihood is higher than a reference value; and a summarized portion deciding part that calculates the total amount of time of said provisionally summarized portions, or as the summarization rate, a ratio of the overall time of the entire portion of said input speech to said total amount of time of said provisionally summarized portions, that calculates said reference value on the basis of which the total amount of time of said provisionally summarized portions becomes substantially equal to a predetermined value or said summarization rate becomes substantially equal to a predetermined value, and that determines said provisionally summarized portions as portions of summarized speech.

28. The apparatus of claim 26, wherein said normal-state likelihood calculating part is configured to calculate a normal-state likelihood of said each said speech sub-block; and said emphasized state deciding part includes:

a provisionally summarized portion deciding part that calculates a likelihood ratio of said emphasized-state likelihood of each speech sub-block to its normal-state likelihood, and that provisionally decides that each speech block including speech sub-blocks having likelihood ratios down to a predetermined likelihood ratio in descending order is a provisionally summarized portion; and a summarized portion deciding part that calculates the total amount of time of provisionally summarized portions, or as the summarization rate, a ratio of said total amount of time of said provisionally summarized portions to the overall time of the entire portion of said input speech, that calculates said predetermined likelihood ratio on the basis of which the total amount of time of said provisionally summarized portions becomes substantially equal to a predetermined value or said summarization rate becomes substantially equal to a predetermined value, and that determines said provisionally summarized portions as portions of summarized speech.

* * * * *